US006369025B1

(12) United States Patent
Trinh et al.

(10) Patent No.: US 6,369,025 B1
(45) **Date of Patent: *Apr. 9, 2002**

(54) CONCENTRATED, WATER DISPERSIBLE, STABLE, FABRIC SOFTENING COMPOSITIONS

(75) Inventors: Toan Trinh, Maineville; Helen Bernardo Tordil, West Chester; Errol Hoffman Wahl, Cincinnati; Jennifer Lea Rinker, Fairfield, all of OH (US); Hugo Jean Marie Demeyere, Merchtem; Marc Johan Declercq, Strombeek-Bever, both of (BE); Eugene Paul Gosselink, Cincinnati, OH (US); James Carey Letton, Forest Park, OH (US); Deborah Jean Back, Cleves, OH (US); John Cort Severns, West Chester, OH (US); Mark Robert Sivik, Fairfield, OH (US); Alice Marie Vogel, Middletown, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/983,544

(22) PCT Filed: Jul. 11, 1996

(86) PCT No.: PCT/US96/11580

§ 371 Date: Apr. 27, 1998

§ 102(e) Date: Apr. 27, 1998

(87) PCT Pub. No.: WO97/03170

PCT Pub. Date: Jan. 30, 1997

Related U.S. Application Data

(63) Continuation-in-part of application No. 08/638,024, filed on Apr. 26, 1996, now abandoned, and a continuation-in-part of application No. 08/621,019, filed on Mar. 22, 1996, now abandoned.

(60) Provisional application No. 60/001,057, filed on Jul. 11, 1995.

(51) Int. Cl.[7] ..... C11D 3/20; C11D 1/62

(52) U.S. Cl. ..... 510/515; 510/276; 510/329; 510/504; 510/521; 510/522; 510/524; 510/525; 510/527

(58) Field of Search ..... 510/515, 276, 510/329, 504, 521, 522, 524, 525, 527

(56) References Cited

U.S. PATENT DOCUMENTS

| | | | | | |
|---|---|---|---|---|---|
| 3,644,203 | A | * | 2/1972 | Lamberti et al. | 510/331 |
| 4,429,859 | A | | 2/1984 | Steiner et al. | |
| 4,454,049 | A | | 6/1984 | MacGilp et al. | |
| 4,547,301 | A | * | 10/1985 | Ooms | 510/515 |
| 5,023,003 | A | | 6/1991 | Yamamura et al. | |
| 5,482,635 | A | | 1/1996 | Behan et al. | |
| 5,490,944 | A | * | 2/1996 | Suazon | 510/522 |
| 5,525,245 | A | * | 6/1996 | Grandmaire et al. | 510/524 |
| 5,545,340 | A | | 8/1996 | Wahl et al. | |
| 5,562,849 | A | | 10/1996 | Wahl et al. | |
| 5,574,179 | A | | 11/1996 | Wahl et al. | |
| 5,637,743 | A | | 6/1997 | Contet et al. | |
| 5,656,585 | A | | 8/1997 | Grandmaire et al. | |
| 5,747,443 | A | | 5/1998 | Wahl et al. | |
| 5,759,990 | A | | 6/1998 | Wahl et al. | |
| 5,773,409 | A | | 6/1998 | Haq et al. | |
| 5,830,845 | A | | 11/1998 | Trinh et al. | |
| 5,861,370 | A | | 1/1999 | Trinh et al. | |
| 5,877,145 | A | * | 3/1999 | Wahl et al. | 510/515 |

FOREIGN PATENT DOCUMENTS

| | | | | |
|---|---|---|---|---|
| DE | 4307186 A1 | | 9/1994 | D06M/13/46 |
| EP | 296995 | * | 12/1988 | |
| EP | 443313 A1 | | 1/1991 | |
| EP | 0296995 01 | | 5/1994 | C11D/1/645 |
| JP | 4-333667 | | 11/1992 | |

* cited by examiner

*Primary Examiner*—Anthony Green
(74) *Attorney, Agent, or Firm*—Frank C. Turner; Jason J. Camp; Kim William Zerby

(57) ABSTRACT

The present invention discloses an aqueous, concentrated, stable, translucent, or preferably, clear, rinse added liquid fabric softening compositions which provide excellent water dispersibility in rinse water, comprising a fabric softening active and a principal solvent having a ClogP of from about 0.15 to about 0.64, and an asymmetric structure. In order to achieve the main object of the invention, namely excellent water dispersibility, the molar ratio of a principal solvent of a fabric softening active should be not less than 3, preferably from about 3.6 to about 100.

12 Claims, No Drawings

CONCENTRATED, WATER DISPERSIBLE, STABLE, FABRIC SOFTENING COMPOSITIONS

CROSS REFERENCE TO RELATED APPLICATIONS

This is an application under 35 U.S.C. §371 of International Application Serial No. PCT/US96/11580 filed Jul. 11, 1996 which is a continuation-in-part of U.S. application Ser. No. 08/638,024, filed Apr. 26, 1996 abandoned, and Ser. No. 08/621,019, filed Mar. 22, 1996 abandoned, and which further claims the benefit of U.S. Provisional Application Serial No. 60/001,057, filed Jul. 11, 1995.

TECHNICAL FIELD

The present invention relates to preferably translucent, or, more preferably, clear, aqueous, concentrated, liquid softening compositions useful for softening cloth. It especially relates to textile softening compositions for use in the rinse cycle of a textile laundering operation to provide excellent fabric-softening/static-control benefits, the compositions being characterised especially by excellent water dispersibility, and by e.g., reduced staining of fabric, and excellent rewettability, and/or improved storage and viscosity stability at sub-normal temperatures, i.e., temperatures below normal room temperature, e.g., 25° C.

BACKGROUND OF THE INVENTION

The art discloses problems associated with formulating and preparing clear, concentrated fabric conditioning formulations. For example, European Patent Application No. 404,471, Machin et al., published Dec. 27, 1990, teaches isotropic liquid softening compositions with at least 20% by weight softener and at least 5% by weight of a short chain organic acid.

Fabric softening compositions containing high solvent levels are known in the art. However, softener agglomerates can form when composition is added in the rinse cycle and can deposit on clothes which can result in staining and reduced softening performance. Also, compositions may thicken and/or precipitate at lower temperatures, i.e., at about 40° F. (about 4° C.) to about 65° F. (about 18° C.). These compositions can also be costly for the consumer due to the high solvent levels associated with making a concentrated, clear product.

In addition to the problem of the above high solvent level, there is a problem that some fabric softeners set to gel, or are thickened or solidified when it is added to rinse water (e.g. when the softener is added to the dispenser of the washing machine). Because of gellation, thickening or solidifying, this type of fabric softener is not be able to dispersed well in rinse water, and softening performance is poor.

For the foregoing reasons, there is a need for a fabric softener which is low in viscosity with low solvent level.

The present invention provides concentrated aqueous liquid textile treatment compositions with relatively low solvent level (i.e., preferably not more than about 50%, by weight of the composition), characterised by defined range of molar ratio of organic solvent to fabric softener that have excellent water dispersibility (i.e., low viscosity and do not gel, thicken, or solidify) and have improved stability (i.e., remain clear or translucent and do not precipitate) at normal, i.e., room temperatures and sub-normal temperatures under prolonged storage, conditions. Said compositions also provide reduced staining of fabrics, good cold water dispersibility, together with excellent softening, anti-static and fabric rewettability characteristics, as well as reduced dispenser residue build-up and excellent freeze-thaw recovery.

The object of the present invention is to provide aqueous, concentrated, stable, translucent, or, preferably, clear, rinse-added liquid fabric softening compositions which provide excellent water dispersibility in rinse water, acceptable low viscosity and viscosity stability at low temperatures, and/or recovery from freezing.

SUMMARY OF THE INVENTION

The composition herein comprises:

A. from about 15% to about 70%, preferably from about 17% to about 65%, more preferably from about 19% to about 60%, by weight of the composition, of a fabric softener active selected from the group consisting of 1. softener having the formula:

$$\left[(R)_{4-m}-N^{(+)}-[(CH_2)_n-Y-R^1]_m\right] X^{(-)} \quad (1)$$

wherein each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl, or mixtures thereof; each m is 2 or 3; each n is from 1 to about 4; each Y is —O—(O)C—, or —C(O)—O—; the sum of carbons in each $R^1$, plus one when Y is —O—(O)C—, is $C_6$–$C_{22}$, preferably $C_{14}$–$C_{20}$, but no more than one $R^1$ or $YR^1$ sum being less than about 12 and then the other $R^1$ or $YR^1$ sum is at least about 16, with each $R^1$ being a long chain $C_5$–$C_{22}$ (or $C_7$–$C_{21}$)hydrocarbyl, or substituted hydrocarbyl substituent, preferably $C_{10}$–$C_{20}$ (or $C_9$–$C_{19}$) alkyl or alkylene, most preferably $C_{12}$–$C_{18}$ (or $C_{11}$–$C_{17}$) alkyl or alkylene, and where, when said sum of carbons is $C_{16}$–$C_{18}$ and $R^1$ is a straight chain alkyl or alkylene group, the Iodine Value (hereinafter referred to as IV) of the parent fatty acid of this $R^1$ group is preferably from about 40 to about 140, more preferably from about 50 to about 130; and most preferably from about 70 to about 115 (As used herein, the Iodine Value of a "parent" fatty acid, or "corresponding" fatty acid, is used to define a level of unsaturation for an $R^1$ groups that is the same as the level of unsaturation that would be present in a fatty acid containing the same $R^1$ group.); and wherein the counterion, $X^-$, can be any softener-compatible anion, preferably, chloride, bromide, methylsulfate, sulfate, and nitrate, more preferably chloride;

2. softener having the formula:

$$\left[R_3N^{(+)}CH2CH\begin{matrix}YR^1\\CH_2YR^1\end{matrix}\right] X^{(-)} \quad (2)$$

wherein each Y, R, $R^1$, and $X(^-)$ have the same meanings as before (Such compounds include those having the formula:

$$[CH_3]_3N^{(+)}[CH_2CH(CH_2O(O)CR^1)O(O)CR^1]Cl^{(-)}$$

where $C(O)R^1$ is derived from unsaturated, e.g., oleic, fatty acid and, preferably, each R is a methyl or ethyl group and preferably each $R^1$ is in the range of $C_{15}$ to $C_{19}$ with degrees of branching and substitution optionally being present in the alkyl chains); and 3. mixtures thereof;

[In one preferred biodegradable quaternary ammonium fabric softening compound, $C(O)R^1$ is derived from unsaturated fatty acid, e.g., oleic acid, and/or fatty acids and/or partially hydrogenated fatty acids, derived from vegetable oils and/or partially hydrogenated vegetable oils, such as: canola oil; safflower oil; peanut oil; sunflower oil; soybean oil; corn oil; tall oil; rice bran oil; etc. and in another preferred biodegradable quaternary ammonium fabric softening compound, $C(O)R^1$ is a saturated, (the Iodine Value is preferably 10 or less, more preferably less than about 5), $C_8$–$C_{14}$, preferably a $C_{12-14}$ hydrocarbyl, or substituted hydrocarbyl substituent derived from, e.g., coconut oil.]

B. less than about 40%, preferably from about 10% to about 35%, more preferably from about 12% to about 25%, and even more preferably from about 14% to about 20%, by weight of the composition of principal solvent having a ClogP of from about 0.15 to about 0.64, preferably from about 0.25 to about 0.62, and more preferably from about 0.40 to about 0.60, said principal solvent containing insufficient amounts of solvents selected from the group consisting of: 2,2,4-trimethyl-1,3-pentanediol; the ethoxylate, diethoxylate, or triethoxylate derivatives of 2,2,4trimethyl-1,3-pentanediol; and/or 2ethyl-1,3-hexanediol, and/or mixtures thereof when used by themselves, to provide a clear product, preferably insufficient to provide a stable product, more preferably insufficient to provide a detectable change in the physical characteristics of the composition, and especially completely free thereof and the principal solvent preferably being selected from the group consisting of:

I. mono-ols including:

a. n-propanol; and/or b. 2-butanol and/or 2-methyl-2-propanol;

II. hexane diol isomers including: 2,3-butanediol, 2,3-dimethyl-; 1,2-butanediol, 2,3-dimethyl-; 1,2-butanediol, 3,3-dimethyl-; 2,3-pentanediol, 2-methyl-; 2,3-pentanediol, 3-methyl-; 2,3-pentanediol, 4-methyl-; 2,3-hexanediol; 3,4-hexanediol; 1,2-butanediol, 2-ethyl-; 1,2-pentanediol, 2-methyl-; 1,2-pentanediol, 3-methyl-; 1,2-pentanediol, 4-methyl-; and/or 1,2-hexanediol;

III. heptane diol isomers including: 1,3-propanediol, 2-butyl-; 1,3-propanediol, 2,2-diethyl-; 1,3-propanediol, 2-(1-methylpropyl); 1,3-propanediol, 2-(2-methylpropyl)-; 1,3-propanediol, 2-methyl-2-propyl-; 1,2-butanediol, 2,3,3-trimethyl-; 1,4-butanediol, 2-ethyl-2-methyl-; 1,4-butanediol, 2-ethyl-3-methyl-; 1,4-butanediol, 2-propyl-; 1,4-butanediol, 2-isopropyl-; 1,5-pentanediol, 2,2-dimethyl-; 1,5-pentanediol, 2,3-dimethyl-; 1,5-pentanediol, 2,4-dimethyl-; 1,5-pentanediol, 3,3-dimethyl-, 2,3-pentanediol, 2,3dimethyl-; 2,3-pentanediol, 2,4dimethyl-; 2,3-pentanediol, 3,4-dimethyl-; 2,3-pentanediol, 4,4-dimethyl-; 3,4-pentanediol, 2,3-dimethyl-; 1,5-pentanediol, 2-ethyl-; 1,6-hexanediol, 2-methyl-; 1,6-hexanediol, 3-methyl-; 2,3-hexanediol, 2-methyl-; 2,3-hexanediol, 3-methyl-; 2,3-hexanediol, 4-methyl-; 2,3-hexanediol, 5-methyl-; 3,4-hexanediol, 2-methyl-; 3,4-hexanediol, 3-methyl-; 1,3-heptanediol; 1,4-heptanediol; 1,5-heptanediol; and/or 1,6-heptanediol;

IV. octane diol isomers including: 1,3-propanediol, 2-(2-methylbutyl); 1,3-propanediol, 2-(1,1-dimethylpropyl)-1, 3-propanediol, 2-(1,2-diethylpropyl)-; 1,3-propanediol, 2-(1-ethylpropyl)-; 1,3-propanediol, 2-(1-methylbutyl)-; 1,3-propanediol, 2-(2,2dimethylpropyl)-; 1,3-propanediol, 2-(3-methylbutyl)-; 1,3-propanediol, 2-butyl-2-methyl-; 1,3-propanediol, 2-ethyl-2-isopropyl-; 1,3-propanediol, 2-ethyl-2-propyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2,2-diethyl-; 1,3-butanediol, 2-(1-methylpropyl)-; 1,3-butanediol, 2-butyl-; 1,3-butanediol, 2-ethyl-2,3-dimethyl-; 1,3-butanediol, 2-(1,1-dimethylethyl)-; 1,3-butanediol, 2-(2-methylpropyl)-; 1,3-butanediol, 2-methyl-2-isopropyl-; 1,3-butanediol, 2-methyl-2-propyl-; 1,3-butanediol, 3-methyl-2 -isopropyl-; 1,3-butanediol, 3-methyl-2-propyl-; 1,4-butanediol, 2,2-diethyl-; 1,4-butanediol, 2-methyl-2-propyl-; 1,4-butanediol, 2-(1-methylpropyl)-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,4-butanediol, 2-(2-methylpropyl)-; 1,4-butanediol, 2-methyl-3-propyl-; 1,4-butanediol, 3-methyl-2-isopropyl-; 1,3-pentanediol, 2,2,3-trimethyl-; 1,3-pentanediol, 2,2,4-trimethyl-; 1,3-pentanediol, 2,3,4-trimethyl-; 1,3-pentanediol, 2,4,4-trimethyl-; 1,3-pentanediol, 3,4,4-trimethyl-; 1,4-pentanediol, 2,2,3-trimethyl-; 1,4-pentanediol, 2,2,4-trimethyl-; 1,4-pentanediol, 2,3,3-trimethyl-; 1,4-pentanediol, 2,3,4-trimethyl-; 1,4-pentanediol, 3,3,4-trimethyl-; 1,5-pentanediol, 2,2,3-trimethyl-; 1,5-pentanediol, 2,2,4-trimethyl-; 1,5-pentanediol, 2,3,3-trimethyl-; 1,5-pentanediol, 2,3,4-trimethyl-; 2,4-pentanediol, 2,3,3-trimethyl-; 2,4-pentanediol, 2,3,4-trimethyl-; 1,3-pentanediol, 2-ethyl-2-methyl-; 1,3-pentanediol, 2-ethyl-3-methyl-; 1,3-pentanediol, 2-ethyl-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,4-pentanediol, 3-ethyl-2-methyl-; 1,4-pentanediol, 3-ethyl-3-methyl-; 1,5-pentanediol, 2-ethyl-2-methyl-; 1,5-pentanediol, 2-ethyl-3-methyl-; 1,5-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol 2-isopropyl-; 1,4-pentanediol, 2-propyl-; 1,4-pentanediol, 3-isopropyl-; 1,5-pentanediol, 2-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol 3,4-dimethyl-; 1,3-hexanediol, 3,5-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-, 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,3-hexanediol, 4,4-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4dimethyl-; 1,5-hexanediol, 3,5-dimethyl-; 1,5-hexanediol, 4,5-dimethyl-; 1,6-hexanediol, 2,2-dimethyl-; 1,6-hexanediol 2,3-dimethyl-; 1,6-hexanediol, 2,4-dimethyl-; 1,6-hexanediol, 2,5-dimethyl-; 1,6hexanediol, 3,3-dimethyl-; 1,6-hexanediol, 3,4-dimethyl-; 2,4-hexanediol, 2,3-dimethyl-; 2,4-hexanediol, 2,4-dimethyl-; 2,4-hexanediol, 2,5-dimethyl-; 2,4-hexanediol, 3,3-dimethyl-; 2,4-hexanediol, 3,4-dimethyl-; 2,4-hexanediol, 3,5-dimethyl-; 2,4-hexanediol, 4,5-dimethyl-; 2,4-hexanediol, 5,5-dimethyl-; 2,5-hexanediol, 2,3-dimethyl-;

2,5-hexanediol, 2,4-dimethyl-; 2,5-hexanediol, 2,5-dimethyl-; 2,5-hexanediol, 3,3-dimethyl-; 2,5-hexanediol, 3,4-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 1,5-heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 3-methyl-; 3,5-heptanediol, 4-methyl-; 2,4-octanediol; 2,5-octanediol; 2,6-octanediol; 2,7-octanediol; 3,5-octanediol; and/or 3,6-octanediol;

V. nonane diol isomers including: 2,4-pentanediol, 2,3,3,4-tetramethyl-; 2,4-pentanediol, 3-tertiarybutyl-; 2,4-hexanediol, 2,5,5-trimethyl-; 2,4-hexanediol, 3,3,4-trimethyl-; 2,4-hexanediol, 3,3,5-trimethyl-; 2,4-hexanediol, 3,5,5-trimethyl-; 2,4-hexanediol, 4,5,5-trimethyl-; 2,5-hexanediol, 3,3,4-trimethyl-; and/or 2,5-hexanediol, 3,3,5-trimethyl-;

VI. glyceryl ethers and/or di(hydroxyalkyl)ethers including: 1,2-propanediol, 3-(n-pentyloxy)-; 1,2-propanediol, 3-(2-pentyloxy)-; 1,2-propanediol, 3-(3-pentyloxy)-; 1,2-propanediol, 3-(2-methyl-1-butyloxy)-; 1,2-propanediol, 3-(iso-amyloxy)-; 1,2-propanediol, 3-(3-methyl-2-butyloxy)-; 1,2-propanediol, 3-(cyclohexyloxy)-; 1,2-propanediol, 3-(1-cyclohex-1-enyloxy)-; 1,3-propanediol, 2-(pentyloxy)-; 1,3-propanediol, 2-(2-pentyloxy)-; 1,3-propanediol, 2-(3-pentyloxy)-; 1,3-propanediol, 2-(2-methyl-1-butyloxy)-; 1,3-propanediol, 2-(iso-amyloxy)-; 1,3-propanediol, 2-(3-methyl-2-butyloxy)-; 1,3-propanediol, 2-(cyclohexyloxy)-; 1,3-propanediol, 2-(1-cyclohex-1-enyloxy); 1,2-propanediol, 3-(butyloxy)-, triethoxylated; 1,2-propanediol, 3(butyloxy)-, tetraethoxylated; 1,2-propanediol, 3-(butyloxy)-, pentaethoxylated; 1,2-propanediol, 3-(butyloxy)-, hexaethoxylated; 1,2-propanediol, 3-(butyloxy)-, heptaethoxylated; 1,2-propanediol, 3-(butyloxy)-, octaethoxylated; 1,2-propanediol, 3-(butyloxy)-, nonaethoxylated; 1,2-propanediol, 3-(butyloxy)-, monopropoxylated; 1,2-propanediol, 3-(butyloxy)-, dibutyleneoxylated; 1,2-propanediol, 3-(butyloxy)-, tributyleneoxylated; 1,2-propanediol, 3-phenyloxy-; 1,2-propanediol, 3-benzyloxy-; 1,2-propanediol, 3-(2-phenylethyloxy); 1,2-propanediol, 3-(1-phenyl-2-propanyloxy)-; 1,3-propanediol, 2-phenyloxy-; 1,3-propanediol, 2-(m-cresyloxy)-; 1,3-propanediol, 2-(p-cresyloxy)-; 1,3-propanediol, -benzyloxy-; 1,3-propanediol, 2-(2-phenylethyloxy)-; 1,3-propanediol, 2-(1-phenylethyloxy)-; bis(2-hydroxybutyl)ether; and/or bis(2-hydroxycyclopentyl)ether;

VII. saturated and unsaturated alicyclic diols and their derivatives including:

(a) the saturated diols and their derivatives, including: 1-isopropyl-1,2-cyclobutanediol; 3-ethyl-4methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 2,4,5-trimethyl-1,3-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1,3-dimethyl-1,3-cyclohexanediol; 1,6-dimethyl-1,3-cyclohexanediol; 1-hydroxy-cyclohexaneethanol; 1-hydroxy-cyclohexanemethanol; 1-ethyl-1,3-cyclohexanediol; 1-methyl-1,2-cyclohexanediol; 2,2-dimethyl-1,3-cyclohexanediol; 2,3-dimethyl-1,4-cyclohexanediol; 2,4-dimethyl-1,3-cyclohexanediol; 2,5-dimethyl-1,3-cyclohexanediol; 2,6-dimethyl-1,4-cyclohexanediol; 2-ethyl-1,3-cyclohexanediol; 2-hydroxycyclohexaneethanol; 2-hydroxyethyl-1-cyclohexanol; 2-hydroxymethylcyclohexanol; 3-hydroxyethyl-1-cyclohexanol; 3-hydroxycyclohexaneethanol; 3-hydroxymethylcyclohexanol; 3-methyl-1,2-cyclohexanediol; 4,4-dimethyl-1,3-cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-hydroxymethylcyclohexanol; 4-methyl-1,2-cyclohexanediol; 5,5-dimethyl-1,3-cyclohexanediol; 5-ethyl-1,3-cyclohexanediol; 1,2-cycloheptanediol; 2-methyl-1,3-cycloheptanediol; 2-methyl-1,4-cycloheptanediol; 4-methyl-1,3-cycloheptanediol; 5-methyl-1,3-cycloheptanediol; 5-methyl-1,4-cycloheptanediol; 6-methyl-1,4-cycloheptanediol; ; 1,3-cyclooctanediol; 1,4-cyclooctanediol; 1,5-cyclooctanediol; 1,2-cyclohexanediol, diethoxylate; 1,2-cyclohexanediol, triethoxylate; 1,2-cyclohexanediol, tetraethoxylate; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; 1,2-cyclohexanediol, monobutylenoxylate; 1,2-cyclohexanediol, dibutylenoxylate; and/or 1,2-cyclohexanediol, tributylenoxylate; and (b). the unsaturated alicyclic diols including: 1,2-cyclobutanediol, 1-ethenyl-2-ethyl-; 3-cyclobutene-1,2-diol, 1,2,3,4-tetramethyl-; 3-cyclobutene-1,2-diol, 3,4-diethyl-; 3-cyclobutene-1,2-diol, 3-(1,1-dimethylethyl)-; 3-cyclobutene-1,2-diol, 3-butyl-; 1,2-cyclopentanediol, 1,2-dimethyl-4-methylene-; 1,2-cyclopentanediol, 1-ethyl-3-methylene-; 1,2-cyclopentanediol, 4-(1-propenyl); 3-cyclopentene-1,2-diol, 1-ethyl-3-methyl-; 1,2cyclohexanediol, 1-ethenyl-; 1,2-cyclohexanediol, 1-methyl-3-methylene-; 1,2-cyclohexanediol, 1-methyl-4-methylene-; 1,2-cyclohexanediol, 3-ethenyl-; 1,2-cyclohexanediol, 4-ethenyl-; 3-cyclohexene-1,2-diol, 2,6-dimethyl-; 3-cyclohexene-1,2-diol, 6,6-dimethyl-; 4-cyclohexene-1,2-diol, 3,6-dimethyl-; 4-cyclohexene-1,2-diol, 4,5-dimethyl-; 3-cyclooctene-1,2-diol; 4-cyclooctene-1,2-diol; and/or 5-cyclooctene-1,2-diol;

VIII. Alkoxylated derivatives of $C_{3-8}$ diols [In the following disclosure, "EO" means polyethoxylates, i.e., —$(CH_2CH_2O)_nH$; Me—$E_n$ means methyl-capped polyethoxylates —$(CH_2CH_2O)_nCH_3$; "2(Me—En)" means 2 Me—En groups needed; "PO" means polypropoxylates, —$(CH(CH_3)CH_2O)_nH$; "BO" means polybutyleneoxy groups, $(CH(CH_2CH_3)CH_2O)_nH$; and "n-BO" means poly(n-butyleneoxy) or poly(tetramethylene)oxy groups —$CH_2CH_2CH_2CH_2O)_nH$. The use of the term "$(C_x)$" herein refers to the number of carbon atoms in the base material which is alkoxylated.] including:

1. 1,2-propanediol (C3) 2(Me—$E_{1-4}$); 1,2-propanediol (C3) $PO_4$; 1,2-propanediol, 2-methyl-(C4) (Me—$E_{4-10}$); 1,2-propanediol, 2-methyl-(C4) 2(Me—$E_1$); 1,2-propanediol, 2-methyl-(C4) $PO_3$; 1,2-propanediol, 2-methyl-(C4) $BO_1$; 1,3-propanediol(C3) 2(Me—$E_{6-8}$); 1,3-propanediol (C3) $PO_{5-6}$; 1,3-propanediol, 2,2-diethyl-(C7) $E_{1-7}$; 1,3-propanediol, 2,2-diethyl-(C7) $PO_1$; 1,3-propanediol, 2,2-diethyl-(C7) n-$BO_{1-2}$; 1,3-propanediol, 2,2-dimethyl-(C5) 2($MeE_{1-2}$); 1,3-propanediol, 2,2-dimethyl-(C5) $PO_{3-4}$; 1,3-propanediol, 2-(1-methylpropyl)-(C7) $E_{1-7}$; 1,3-propanediol, 2-(1-methylpropyl)-(C7) $PO_1$; 1,3-propanediol, 2-(1-methylpropyl)-(C7) n-$BO_{1-2}$; 1,3-propanediol, 2-(2-methylpropyl)-(C7) $E_{1-7}$; 1,3-propanediol, 2-(2-methylpropyl)-(C7) $PO_1$; 1,3-propanediol, 2-(2-methylpropyl)-(C7) n-$BO_{1-2}$; 1,3-propanediol, 2-ethyl-(C5) ($MeE_{6-10}$); 1,3-propanediol, 2-ethyl-(C5) 2($MeE_1$); 1,3-propanediol, 2-ethyl-(C5) $PO_3$; 1,3-propanediol, 2-ethyl-2-methyl-(C6) ($MeE_{1-6}$); 1,3-propanediol, 2-ethyl-2-methyl-(C6) $PO_2$; 1,3-propanediol, 2-ethyl-2-methyl-(C6) $BO_1$; 1,3-propanediol, 2-isopropyl-(C6) ($MeE_{1-6}$); 1,3-propanediol, 2-isopropyl-(C6) $PO_2$; 1,3-propanediol, 2-isopropyl-(C6) $BO_1$; 1,3-propanediol, 2-methyl-(C4) 2($MeE_{2-5}$); 1,3-propanediol, 2-methyl-(C4) $PO_{4-5}$; 1,3-propanediol, 2-methyl-(C4) $BO_2$; 1,3-propanediol, 2-methyl-2-isopropyl-(C7) $E_{2-9}$; 1,3-propanediol, 2-methyl-2-isopropyl-(C7) $PO_1$; 1,3-propanediol, 2-methyl-2-isopropyl-(C7) n-$BO_{1-3}$; 1,3-propanediol, 2-methyl-2-propyl-(C7) $E_{1-7}$; 1,3-propanediol, 2-methyl-2-propyl-(C7) $PO_1$; 1,3-propanediol, 2-methyl-2-propyl-(C7) n-$BO_{1-2}$; 1,3-propanediol, 2-propyl-(C6)($MeE_{1-4}$); 1,3-propanediol, 2-propyl-(C6) $PO_2$; 1,3-propanediol, 2-propyl-(C6) $BO_1$;

2. 1,2-butanediol (C4) ($MeE_{2-8}$); 1,2-butanediol(C4) $PO_{2-3}$; 1,2-butanediol(C4) $BO_1$; 1,2-butanediol, 2,3-dimethyl-(C6) $E_{1-6}$; 1,2-butanediol, 2,3-dimethyl-(C6) n-$BO_{1-2}$; 1,2-butanediol, 2-ethyl-(C6) $E_{1-3}$; 1,2-butanediol, 2-ethyl-(C6) n-$BO_1$; 1,2-butanediol, 2-methyl-(C5)($MeE_{1-2}$); 1,2-butanediol, 2-methyl-(C5) $PO_1$; 1,2-butanediol, 3,3-dimethyl-(C6) $E_{1-6}$; 1,2-butanediol, 3,3-dimethyl-(C6) n-$BO_{1-2}$; 1,2-butanediol, 3-methyl-(C5)($MeE_{1-2}$); 1,2-butanediol, 3-methyl-(C5) $PO_1$; 1,3-butanediol(C4) 2($MeE_{3-6}$); 1,3-butanediol (C4) $PO_5$; 1,3-butanediol(C4) $BO_2$; 1,3-butanediol, 2,2,3-trimethyl-(C7)($MeE_{1-3}$); 1,3-butanediol, 2,2,3-trimethyl-(C7) $PO_{1-2}$; 1,3-butanediol, 2,2-dimethyl-(C6)($MeE_{3-8}$); 1,3-butanediol, 2,2-dimethyl-(C6) $PO_3$; 1,3-butanediol, 2,3-dimethyl-(C6)($MeE_{3-8}$); 1,3-butanediol, 2,3-dimethyl-(C6) $PO_3$; 1,3-butanediol, 2-ethyl-(C6)($MeE_{1-6}$); 1,3-butanediol, 2-ethyl-(C6) $PO_{2-3}$; 1,3-butanediol, 2-ethyl-(C6) $BO_1$; 1,3-butanediol, 2-ethyl-2-methyl-(C7)($MeE_1$); 1,3-butanediol, 2-ethyl-2-methyl-(C7) $PO_1$; 1,3-butanediol, 2-ethyl-2-methyl-(C7) n-$BO_{2-4}$; 1,3-butanediol, 2-ethyl-3-methyl-(C7)($MeE_1$); 1,3-butanediol, 2-ethyl-3-methyl-(C7) $PO_1$; 1,3-butanediol, 2-ethyl-3-methyl-(C7) n-$BO_{2-4}$; 1,3-butanediol, 2-isopropyl-(C7)($MeE_1$); 1,3-butanediol, 2-isopropyl-(C7) $PO_1$; 1,3-butanediol, 2-isopropyl-(C7) n-$BO_{2-4}$; 1,3-butanediol, 2-methyl-(C5)2 ($MeE_{1-3}$); 1,3-butanediol, 2-methyl-(C5) $PO_4$; 1,3-butanediol, 2-propyl-(C7) $E_{2-9}$; 1,3-butanediol, 2-propyl-(C7) $PO_1$; 1,3-butanediol, 2-propyl-(C7) n-$BO_{1-3}$; 1,3-butanediol, 3-methyl-(C5) 2($MeE_{1-3}$); 1,3-butanediol, 3-methyl-(C5) $PO_4$; 1,4-butanediol (C4) 2($MeE_{2-4}$); 1,4-butanediol(C4) $PO_{4-5}$; 1,4-butanediol(C4) $BO_2$; 1,4-butanediol, 2,2,3-trimethyl-(C7) $E_{2-9}$; 1,4-butanediol, 2,2,3-trimethyl-(C7) $PO_1$; 1,4-butanediol, 2,2,3-trimethyl-(C7) n-$BO_{1-3}$; 1,4-butanediol, 2,2-dimethyl-(C6)($MeE_{1-6}$); 1,4-butanediol, 2,2-dimethyl-(C6) $PO_2$; 1,4-butanediol, 2,2-dimethyl-(C6) $BO_1$; 1,4-butanediol, 2,3-dimethyl-(C6)($MeE_{1-6}$); 1,4-butanediol, 2,3-dimethyl-(C6) $PO_2$; 1,4-butanediol, 2,3-dimethyl-(C6) $BO_1$; 1,4-butanediol, 2-ethyl-(C6)($MeE_{1-4}$); 1,4-butanediol, 2-ethyl-(C6) $PO_2$; 1,4-butanediol, 2-ethyl-(C6) $BO_1$; 1,4-butanediol, 2-ethyl-2-methyl-(C7) $E_{1-7}$; 1,4-butanediol, 2-ethyl-2-methyl-(C7) $PO_1$; 1,4-butanediol, 2-ethyl-2-methyl-(C7) n-$BO_{1-2}$; 1,4-butanediol, 2-ethyl-3-methyl-(C7) $E_{1-7}$: 1,4-butanediol, 2-ethyl-3-methyl-(C7) $PO_1$; 1,4-butanediol, 2-ethyl-3-methyl-(C7)n-$BO_{1-2}$; 1,4-butanediol, 2-isopropyl-(C7) $E_{1-7}$; 1,4-butanediol, 2-isopropyl-(C7) $PO_1$; 1,4-butanediol, 2-isopropyl-(C7) n-$BO_{1-2}$; 1,4-butanediol, 2-methyl-(C5) ($MeE_{6-10}$); 1,4-butanediol, 2-methyl-(C5) 2($MeE_1$); 1,4-butanediol, 2-methyl-(C5) $P_3$; 1,4-butanediol, 2-methyl-(C5) $BO_1$; 1,4-butanediol, 2-propyl-(C7) $E_{1-5}$; 1,4-butanediol, 2-propyl-(C7) n-$BO_{1-2}$; 1,4-butanediol, 3-ethyl-1-methyl-(C7) $E_{2-9}$; 1,4-butanediol, 3-ethyl-1-methyl-(C7) $PO_1$; 1,4-butanediol, 3-ethyl-1-methyl-(C7) n-$BO_{1-3}$; 2,3-butanediol(C4)($MeE_{6-10}$); 2,3-butanediol(C4) 2($MeE_1$); 2,3-butanediol(C4) $PO_{3-4}$; 2,3-butanediol (C4) $BO_1$; 2,3-butanediol, 2,3-dimethyl-(C6) $E_{3-9}$; 2,3-butanediol, 2,3-dimethyl-(C6) $PO_1$; 2,3-butanediol, 2,3-dimethyl-(C6) n-$BO_{1-3}$; 2,3-butanediol, 2-methyl-(C5)($MeE_{1-5}$); 2,3-butanediol, 2-methyl-(C5) $PO_2$; 2,3-butanediol, 2-methyl-(C5) $BO_1$;

3. 1,2-pentanediol (C5) $E_{3-10}$; 1,2-pentanediol, (C5) $PO_1$; 1,2-pentanediol, (C5) n-$BO_{2-3}$; 1,2-pentanediol, 2-methyl(C6) $E_{1-3}$; 1,2-pentanediol, 2-methyl (C6) n-$BO_1$; 1,2-pentanediol, 2-methyl(C6) $BO_1$; 1,2-pentanediol, 3-methyl(C6) $E_{1-3}$; 1,2-pentanediol, 3-methyl (C6) n-$BO_1$; 1,2-pentanediol, 4-methyl (C6) $E_{1-3}$; 1,2-pentanediol, 4-methyl (C6) n-$BO_1$; 1,3-pentanediol (C5) 2Me—$E_{1-2}$); 1,3-pentanediol (C5) $PO_{3-4}$; 1,3-pentanediol, 2,2-dimethyl-(C7)(Me—$E_1$); 1,3-pentanediol, 2,2-dimethyl-(C7) $PO_1$; 1,3-pentanediol, 2,2-dimethyl-(C7) n-$BO_{2-4}$; 1,3-pentanediol, 2,3-dimethyl-(C7)(Me—$E_1$); 1,3-pentanediol, 2,3-dimethyl-(C7) $PO_1$; 1,3-pentanediol, 2,3-dimethyl-(C7) n-$BO_{2-4}$; 1,3-pentanediol, 2,4-dimethyl-(C7)(Me—$E_1$); 1,3-pentanediol, 2,4-dimethyl-(C7) $PO_1$; 1,3-pentanediol 2,4-dimethyl-(C7) n-$BO_{2-4}$; 1,3-pentanediol, 2-ethyl-(C7) $E_{2-9}$; 1,3-pentanediol, 2-ethyl-(C7) $PO_1$; 1,3-pentanediol, 2-ethyl-(C7) n-$BO_{1-3}$; 1,3-pentanediol, 2-methyl-(C6) 2(Me—$E_{1-6}$); 1,3-pentanediol, 2-methyl-(C6) $PO_{2-3}$; 1,3-pentanediol, 2-methyl-(C6) $BO_1$; 1,3-pentanediol, 3,4-dimethyl-(C7)(Me—$E_1$); 1,3-pentanediol, 3,4-dimethyl-(C7) $PO_1$; 1,3-pentanediol, 3,4-dimethyl-(C7)n-$BO_{2-4}$; 1,3-pentanediol, 3-methyl-(C6)(Me—$E_{1-6}$); 1,3-pentanediol, 3-methyl-(C6) $PO_{2-3}$; 1,3-pentanediol, 3-methyl-(C6) $BO_1$; 1,3-pentanediol, 4,4-dimethyl-(C7)(Me—$E_1$); 1,3-pentanediol, 4,4-dimethyl-(C7) $PO_1$; 1,3-pentanediol, 4,4-dimethyl-(C7) n-$BO_{2-4}$; 1,3-pentanediol, 4-methyl-(C6)(Me—$E_{1-6}$); 1,3-pentanediol, 4-methyl-(C6) $PO_{2-3}$; 1,3-pentanediol, 4-methyl-(C6) $BO_1$; 1,4-pentanediol, (C5) 2(Me—$E_{1-2}$); 1,4-pentanediol (C5) $PO_{3-4}$; 1,4-pentanediol, 2,2-dimethyl-(C7)(Me—$E_1$); 1,4-pentanediol, 2,2-dimethyl-(C7) $PO_1$; 1,4-pentanediol, 2,2-dimethyl-(C7) n-$BO_{2-4}$; 1,4-pentanediol, 2,3-dimethyl-(C7)(Me—$E_1$); 1,4-pentanediol, 2,3-dimethyl-(C7) $PO_1$; 1,4-pentanediol, 2,3-dimethyl-(C7) n-$BO_{2-4}$; 1,4-pentanediol, 2,4-dimethyl-(C7) (Me—$E_1$); 1,4-pentanediol, 2,4-dimethyl-(C7) $PO_1$; 1,4-pentanediol, 2,4-dimethyl-(C7) n-$BO_{2-4}$; 1,4-pentanediol, 2-methyl-(C6)(Me—$E_{1-6}$); 1,4-pentanediol, 2-methyl-(C6) $PO_{2-3}$; 1,4-pentanediol, 2-methyl-(C6) $BO_1$; 1,4-pentanediol, 3,3-dimethyl-(C7)(Me—$E_1$); 1,4-pentanediol, 3,3-dimethyl-(C7) $PO_1$; 1,4-pentanediol, 3,3-dimethyl-(C7) n-$BO_{2-4}$; 1,4-pentanediol, 3,4-dimethyl-(C7)(M—$E_1$); 1,4-pentanediol, 3,4-dimethyl-(C7) $PO_1$; 1,4-pentanediol, 3,4-dimethyl-(C7) n-$BO_{2-4}$; 1,4-pentanediol, 3-methyl-(C6)2(Me—$E_{1-6}$); 1,4-pentanediol, 3-methyl-(C6) $PO_{2-3}$; 1,4-pentanediol, 3-methyl-(C6) $BO_1$; 1,4-pentanediol, 4-methyl-(C6)2(Me—$E_{1-6}$); 1,4-pentanediol, 4-methyl-(C6) $PO_{2-3}$; 1,4-pentanediol, 4-methyl-(C6) $BO_1$; 1,5-pentanediol, (C5)(Me—$E_{4-10}$); 1,5-pentanediol (C5)2(Me—$E_1$); 1,5-pentanediol (C5) $PO_3$; 1,5-pentanediol, 2,2-dimethyl-(C7) $E_{1-7}$; 1,5-pentanediol, 2,2-dimethyl-(C7) PO1; 1,5-pentanediol, 2,2-dimethyl-(C7) n-$BO_{1-2}$; 1,5-pentanediol, 2,3-dimethyl-(C7) $E_{1-7}$; 1,5-pentanediol, 2,3-dimethyl-(C7) $PO_1$; 1,5-pentanediol, 2,3-dimethyl-(C7) n-$BO_{1-2}$; 1,5-pentanediol, 2,4-dimethyl-(C7) $E_{1-7}$; 1,5-pentanediol, 2,4-dimethyl-(C7) $PO_1$; 1,5-pentanediol, 2,4-dimethyl-(C7) n-$BO_{1-2}$; 1,5-pentanediol, 2-ethyl-(C7) $E_{1-5}$; 1,5-pentanediol, 2-ethyl-(C7) n-$BO_{1-2}$; 1,5-pentanediol, 2-methyl-(C6) (Me—$E_{1-4}$); 1,5-pentanediol, 2-methyl-(C6) $PO_2$; 1,5-pentanediol, 3,3-dimethyl-(C7) $E_{1-7}$; 1,5-pentanediol, 3,3-dimethyl-(C7) $PO_1$; 1,5-pentanediol, 3,3-dimethyl-(C7) n-$BO_{1-2}$; 1,5-pentanediol, 3-methyl-(C6)(Me—$E_{1-4}$); 1,5-pentanediol, 3-methyl-(C6) $PO_2$; 2,3-pentanediol, (C5)(Me—$EI_{1-3}$); 2,3pentanediol, (C5) $PO_2$; 2,3-pentanediol, 2-methyl-(C6) $E_{1-7}$; 2,3-pentanediol, 2-methyl-(C6) $PO_1$; 2,3-pentanediol, 2-methyl-(C6) n-$BO_{1-2}$; 2,3-pentanediol, 3-methyl-(C6) $E_{1-7}$; 2,3-pentanediol, 3-methyl-(C6) $PO_1$; 2,3-pentanediol 3-methyl-(C6) n-$BO_{1-2}$; 2,3-pentanediol, 4-methyl-(C6) $E_{1-7}$; 2,3-pentanediol, 4-methyl-(C6) $PO_1$; 2,3-pentanediol, 4-methyl-(C6) n-$BO_{1-2}$; 2,4-pentanediol, (C5)2(Me—$E_{1-4}$); 2,4-pentanediol (C5) $PO_4$; 2,4-pentanediol, 2,3-dimethyl-(C7)(Me—$E_{1-4}$); 2,4-pentanediol, 2,3-dimethyl-(C7) $PO_2$; 2,4-pentanediol, 2,4-dimethyl-(C7)(Me—$E_{1-4}$); 2,4-pentanediol, 2,4-dimethyl-(C7) $PO_2$; 2,4-pentanediol, 2-methyl-(C7)(Me—$E_{5-10}$); 2,4-pentanediol, 2-methyl-(C7) $PO_3$; 2,4-pentanediol, 3,3-dimethyl-(C7)(Me—$E_{1-4}$); 2,4-pentanediol, 3,3-dimethyl-(C7) $PO_2$; 2,4-pentanediol, 3-methyl-(C6)(Me—$E_{5-10}$); 2,4-pentanediol, 3-methyl-(C6) $PO_3$;

4. 1,3-hexanediol (C6)(Me—$E_{1-5}$); 1,3-hexanediol (C6) $PO_2$; 1,3-hexanediol (C6) $BO_1$; 1,3-hexanediol, 2-methyl-(C7) $E_{2-9}$; 1,3-hexanediol, 2-methyl-(C7) $PO_1$; 1,3-hexanediol, 2-methyl-(C7) n-$BO_{1-3}$; 1,3-hexanediol, 2-methyl-(C7) $BO_1$; 1,3-hexanediol, 3-methyl-(C7) $E_{2-9}$; 1,3-hexanediol, 3-methyl-(C7) $PO_1$; 1,3-hexanediol, 3-methyl-(C7) n-$BO_{1-3}$; 1,3-hexanediol, 4-methyl-(C7) $E_{2-9}$; 1,3-hexanediol, 4-methyl-(C7) $PO_1$; 1,3-hexanediol, 4-methyl-(C7) n-$BO_{1-3}$; 1,3-hexanediol, 5-methyl-(C7) $E_{2-9}$; 1,3-hexanediol, 5-methyl-(C7) $PO_1$; 1,3-hexanediol, 5-methyl-(C7) n-$BO_{1-3}$; 1,4-hexanediol (C6)(Me—E5); 1,4-hexanediol(C6) $PO_2$; 1,4-hexanediol (C6) $BO_1$; 1,4-hexanediol, 2-methyl-(C7) $E_{2-9}$; 1,4-hexanediol, 2-methyl-(C7) $PO_1$; 1,4-hexanediol, 2-methyl-(C7)n-$BO_{1-3}$; 1,4-hexanediol, 3-methyl-(C7) $E_{2-9}$; 1,4-hexanediol, 3-methyl-(C7) $PO_1$; 1,4-hexanediol, 3-methyl-(C7) n-$BO_{1-3}$; 1,4-hexanediol, 4-methyl-(C7) $E_{2-9}$; 1,4-hexanediol, 4-methyl-(C7) $PO_1$; 1,4-hexanediol, 4-methyl-(C7) n-$BO_{1-3}$; 1,4-hexanediol, 5-methyl-(C7) $E_{2-9}$; 1,4-hexanediol, 5-methyl-(C7) $PO_1$; 1,4-hexanediol, 5-methyl-(C7) n-$BO_{1-3}$; 1,5-hexanediol (C6)(Me—$E_{15}$); 1,5-hexanediol(C6) $PO_2$; 1,5-hexanediol (C6) $BO_1$; 1,5-hexanediol, 2-methyl-(C7) $E_{2-9}$; 1,5-hexanediol, 2-methyl-(C7) $PO_1$; 1,5-hexanediol, 2-methyl-(C7) n-$BO_{1-3}$; 1,5-hexanediol, 3-methyl-(C7) $E_{2-9}$; 1,5-hexanediol, 3-methyl-(C7) $PO_1$; 1,5-hexanediol, 3-methyl-(C7) n-$BO_{1-3}$; 1,5-hexanediol, 4-methyl-(C7) $E_{2-9}$; 1,5-hexanediol, 4-methyl-(C7) $PO_1$; 1,5-hexanediol, 4-methyl-(C7) n-$BO_{1-3}$; 1,5-hexanediol, 5-methyl-(C7) $E_{2-9}$; 1,5-hexanediol, 5-methyl-(C7) $PO_1$; 1,5-hexanediol, 5-methyl-(C7) n-$BO_{1-3}$; 1,6-hexanediol (C6)(Me—$E_{1-2}$); 1,6-hexanediol(C6) $PO_{1-2}$; 1,6-hexanediol (C6) n-$BO_4$; 1,6-hexanediol, 2-methyl-(C7) $E_{1-5}$; 1,6-hexanediol, 2-methyl-(C7) n-$BO_{1-2}$; 1,6-hexanediol, 3-methyl-(C7) $E_{1-5}$; 1,6-hexanediol, 3-methyl-(C7) n-$BO_{1-2}$; 2,3-hexanediol (C6) $E_{1-5}$; 2,3-hexanediol (C6) n-$BO_1$; 2,3-hexanediol (C6) $BO_1$; 2,4-hexanediol (C6)(Me—$E_{3-8}$); 2,4-hexanediol(C6) $PO_3$; 2,4-hexanediol, 2-methyl-(C7) (Me—$E_{1-2}$); 2,4-hexanediol 2-methyl-(C7) $PO_{1-2}$; 2,4-hexanediol, 3-methyl-(C7)(Me—$E_{1-2}$); 2,4-hexanediol 3-methyl-(C7) $PO_{1-2}$; 2,4-hexanediol, 4-methyl-(C7) (Me—$E_{1-2}$); 2,4-hexanediol 4-methyl-(C7) $PO_{1-2}$; 2,4-hexanediol, 5-methyl-(C7)(Me—$E_{1-2}$); 2,4-hexanediol 5-methyl-(C7) $PO_{1-2}$; 2,5-hexanediol (C6)(Me—$E_{3-8}$); 2,5-hexanediol (C6) $PO_3$; 2,5-hexanediol, 2-methyl-(C7)(Me—$E_{1-2}$); 2,5-hexanediol 2-methyl-(C7) $PO_{1-2}$; 2,5-hexanediol, 3-methyl-(C7)(Me—$E_{1-2}$); 2,5-hexanediol 3-methyl-(C7) $PO_{1-2}$; 3,4-hexanediol (C6) $EO_{1-5}$; 3,4-hexanediol (C6) n-$BO_1$; 3,4-hexanediol (C6) $BO_1$;

5. 1,3-heptanediol (C7) $E_{1-7}$; 1,3-heptanediol (C7) $PO_1$; 1,3-heptanediol (C7) n-$BO_{1-2}$; 1,4-heptanediol (C7) $E_{1-7}$; 1,4-heptanediol (C7) $PO_1$; 1,4-heptanediol (C7) n-$BO_{1-2}$; 1,5-heptanediol (C7) $E_{1-7}$; 1,5-heptanediol (C7) $PO_1$; 1,5-heptanediol (C7) n-$BO_{1-2}$; 1,6-heptanediol (C7) $E_{1-7}$; 1,6-heptanediol(C7) $PO_1$; 1,6-heptanediol (C7) n-$BO_{1-2}$; 1,7-heptanediol (C7)$E_{1-2}$; 1,7-heptanediol (C7) n-$BO_1$; 2,4-heptanediol (C7) $E_{3-10}$; 2,4-heptanediol (C7)(Me—$E_1$); 2,4-heptanediol (C7) $PO_1$; 2,4-heptanediol (C7) n-$BO_3$; 2,5-heptanediol (C7) $E_{3-10}$; 2,5-heptanediol (C7)(Me—$E_1$); 2,5-heptanediol (C7) $PO_1$; 2,5-heptanediol (C7) n-$BO_3$; 2,6-heptanediol (C7) $E_{3-10}$; 2,6-heptanediol (C7)(Me—$E_1$); 2,6-heptanediol(C7) $PO_1$; 2,6-heptanediol (C7) n-$BO_3$; 3,5-heptanediol (C7)$E_{3-10}$; 3,5-heptanediol(C7) (Me—$E_1$); 3,5-heptanediol (C7) $PO_1$; 3,5-heptanediol (C7) n-$BO_3$;

6. 1,3-butanediol, 3-methyl-2-isopropyl-(C8) $PO_1$; 2,4-pentanediol, 2,3,3-trimethyl-(C8) $PO_1$; 1,3-butanediol, 2,2-diethyl-(C8) $E_{2-5}$; 2,4-hexanediol, 2,3-dimethyl-(C8) $E_{2-5}$; 2,4-hexanediol, 2,4-dimethyl-(C8) $E_{2-5}$; 2,4-hexanediol, 2,5-dimethyl-(C8) $E_{2-5}$; 2,4-hexanediol, 3,3-dimethyl-(C8) $E_{2-5}$; 2,4-hexanediol, 3,4-dimethyl-(C8) $E_{2-5}$; 2,4-hexanediol, 3,5-dimethyl-(C8) $E_{2-5}$; 2,4-hexanediol, 4,5-dimethyl-(C8) $E_{2-5}$; 2,4-hexanediol, 5,5-dimethyl-(C8) $E_{2-5}$; 2,5-hexanediol, 2,3-dimethyl-(C8) $E_{2-5}$; 2,5-hexanediol, 2,4-dimethyl-(C8) $E_{2-5}$; 2,5-hexanediol, 2,5-dimethyl-(C8) $E_{2-5}$; 2,5-hexanediol, 3,3-dimethyl-(C8) $E_{2-5}$; 2,5-hexanediol, 3,4-dimethyl-(C8) $E_{2-5}$; 3,5-heptanediol, 3-methyl-(C8) $E_{2-5}$; 1,3-butanediol, 2,2-diethyl-(C8) n-$BO_{1-2}$; 2,4-hexanediol, 2,3-dimethyl-(C8) n-$BO_{1-2}$; 2,4-hexanediol, 2,4-dimethyl-(C8) n-$BO_{1-2}$; 2,4-hexanediol, 2,5-dimethyl-(C8) n-$BO_{1-2}$; 2,4-hexanediol, 3,3-dimethyl-(C8) n-$BO_{1-2}$; 2,4-hexanediol, 3,4-dimethyl-(C8) n-$BO_{1-2}$; 2,4-hexanediol, 3,5-dimethyl-(C8) n-$BO_{1-2}$; 2,4-hexanediol, 4,5-dimethyl-(C8) n-$BO_{1-2}$; 2,4-hexanediol, 5,5-dimethyl-, n-$BO_{1-2}$; 2,5-hexanediol, 2,3-dimethyl-(C8) n-$BO_{1-2}$; 2,5-hexanediol, 2,4-dimethyl-(C8) n-$BO_{1-2}$; 2,5-hexanediol, 2,5-dimethyl-(C8) n-$BO_{1-2}$; 2,5-hexanediol, 3,3-dimethyl-(C8) n-$BO_{1-2}$; 2,5-hexanediol, 3,4-dimethyl-(C8) n-$BO_{1-2}$; 3,5-heptanediol, 3-methyl-(C8) n-$BO_{1-2}$; 1,3-propanediol, 2-(1,2-dimethylpropyl)-(C8) n-$BO_1$; 1,3-butanediol, 2-ethyl-2,3-dimethyl-(C8) n-$BO_1$; 1,3-butanediol, 2-methyl-2-isopropyl-(C8) n-$BO_1$; 1,4-butanediol, 3-methyl-2-isopropyl-(C8) n-$BO_1$; 1,3-pentanediol, 2,2,3-trimethyl-(C8) n-$BO_1$; 1,3-pentanediol, 2,2,4-trimethyl-(C8) n-$BO_1$; 1,3-pentanediol, 2,4,4-trimethyl-(C8) n-$BO_1$; 1,3-pentanediol, 3,4,4-trimethyl-(C8)n-$BO_1$; 1,4-pentanediol, 2,2,3-trimethyl-(C8) n-$BO_1$; 1,4-pentanediol, 2,2,4-trimethyl-(C8) n-$BO_1$; 1,4-pentanediol, 2,3,3-trimethyl-(C8) n-$BO_1$; 1,4-pentanediol, 2,3,4-trimethyl-(C8) n-$BO_1$; 1,4-pentanediol, 3,3,4-trimethyl-(C8) n-$BO_1$; 2,4-pentanediol, 2,3,4-trimethyl-(C8) n-$BO_1$; 2,4-hexanediol, 4-ethyl-(C8) n-$BO_1$; 2,4-heptanediol, 2-methyl-(C8) n-$BO_1$; 2,4-heptanediol, 3-methyl-(C8) n-$BO_1$; 2,4-heptanediol, 4-methyl-(C8) n-$BO_1$; 2,4-heptanediol, 5-methyl-(C8) n-$BO_1$; 2,4-heptanediol, 6-methyl-(C8) n-$BO_1$; 2,5-heptanediol, 2-methyl-(C8) n-$BO_1$; 2,5-heptanediol, 3-methyl-(C8) n-$BO_1$; 2,5-heptanediol, 4-methyl-(C8) n-$BO_1$; 2,5-heptanediol, 5-methyl-(C8) n-$BO_1$; 2,5-heptanediol, 6-methyl-(C8) n-$BO_1$; 2,6-heptanediol, 2-methyl-(C8) n-$BO_1$; 2,6-heptanediol, 3-methyl-(C8) n-$BO_1$; 2,6-heptanediol, 4-methyl-(C8) n-$BO_1$; 3,5-heptanediol, 2-methyl-(C8) n-$BO_1$; 1,3-propanediol, 2-(1,2-dimethylpropyl)-(C8) $E_{1-3}$; 1,3-butanediol, 2-ethyl-2,3-dimethyl-(C8) $E_{1-3}$; 1,3-butanediol, 2-methyl-2-isopropyl-(C8) $E_{1-3}$; 1,4-butanediol, 3-methyl-2-isopropyl-(C8) $E_{1-3}$; 1,3-pentanediol, 2,2,3-trimethyl-(C8) $E_{1-3}$; 1,3-pentanediol, 2,2,4-trimethyl-(C8) $E_{1-3}$; 1,3-pentanediol, 2,4,4-trimethyl-(C8) $E_{1-3}$; 1,3-pentanediol, 3,4,4-trimethyl-(C8) $E_{1-3}$; 1,4-pentanediol, 2,2,3-trimethyl-(C8) $E_{1-3}$; 1,4-pentanediol, 2,2,4-trimethyl-(C8) $E_{1-3}$; 1,4-pentanediol, 2,3,3-trimethyl-(C8) $E_{1-3}$; 1,4-pentanediol, 2,3,4-trimethyl-(C8) $E_{1-3}$; 1,4-pentanediol, 3,3,4-trimethyl-(C8) $E_{1-3}$; 2,4-pentanediol, 2,3,4-trimethyl-(C8) $E_{1-3}$; 2,4-hexanediol, 4-ethyl-(C8) $E_{1-3}$; 2,4-heptanediol, 2-methyl-(C8) $E_{1-3}$; 2,4-heptanediol, 3-methyl-(C8) $E_{1-3}$; 2,4-heptanediol, 4-methyl-(C8) $E_{1-3}$; 2,4-heptanediol, 5-methyl-(C8) $E_{1-3}$; 2,4-heptanediol, 6-methyl-(C8) $E_{1-3}$; 2,5-heptanediol, 2-methyl-(C8) $E_{1-3}$; 2,5-heptanediol, 3-methyl-(C8) $E_{1-3}$; 2,5-heptanediol, 4-methyl-(C8) $E_{1-3}$; 2,5-heptanediol, 5-methyl-(C8) $E_{1-3}$; 2,5-heptanediol, 6-methyl-(C8) $E_{1-3}$; 2,6-heptanediol, 2-methyl-(C8) $E_{1-3}$; 2,6-heptanediol, 3-methyl-(C8) $E_{1-3}$; 2,6-heptanediol, 4-methyl-(C8) $E_{1-3}$; and/or 3,5-heptanediol, 2-methyl-(C8) $E_{1-3}$; and 7. mixtures thereof;

IX. aromatic diols including: 1-phenyl-1,2-ethanediol; 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl-1,3-propanediol; 1-phenyl-1,3-butanediol; 3-phenyl-1,3-butanediol; 1-phenyl-1,4-butanediol; 2-phenyl-1,4-butanediol; and/or 1-phenyl-2,3-butanediol;

X. principal solvents which are homologs, or analogs, of the above structures where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant, including the following: 1,3-Propanediol, 2,2-di-2-propenyl-; 1,3-Propanediol, 2-(1-pentenyl)-; 1,3-Propanediol, 2-(2-methyl-2-propenyl)-2-(2-propenyl)-; 1,3-Propanediol, 2-(3-methyl-1-butenyl)-; 1,3-Propanediol, 2-(4-pentenyl)-; 1,3-Propanediol, 2-ethyl-2-(2-methyl-2-propenyl)-; 1,3-Propanediol, 2-ethyl-2-(2-propenyl)-; 1,3-Propanediol, 2-methyl-2-(3-methyl-3-butenyl)-; 1,3-Butanediol, 2,2-diallyl-; 1,3-Butanediol, 2-(1-ethyl-1-propenyl)-; 1,3-Butanediol, 2-(2-butenyl)-2-methyl-; 1,3-Butanediol, 2-(3-methyl-2-butenyl)-; 1,3-Butanediol, 2-ethyl-2-(2-propenyl)-; 1,3-Butanediol, 2-methyl-2-(1-methyl-2-propenyl)-; 1,4-Butanediol, 2,3-bis(1-methylethylidene)-; 1,4-Butanediol, 2-(3-methyl-2-butenyl)-3-methylene-; 2-Butene-1,4-diol, 2-(1,1-dimethylpropyl)-; 2-Butene-1,4-diol 2-(1-methylpropyl)-; 2-Butene-1,4-diol, 2-butyl-; 1,3-Pentanediol, 2-ethenyl-3-ethyl-; 1,3-Pentanediol, 2-ethenyl-4,4-dimethyl-; 1,4-Pentanediol, 3-methyl-2-(2-propenyl)-; 1,5-Pentanediol, 2-(1-propenyl)-; 1,5-Pentanediol, 2-(2-propenyl)-; 1,5-Pentanediol, 2-ethylidene-3-methyl-; 1,5-Pentanediol, 2-propylidene-; 2,4-Pentanediol 3-ethylidene-2,4-dimethyl-; 4-Pentene-1,3-diol, 2-(1,1-dimethylethyl)-; 4-Pentene-1,3-diol, 2-ethyl-2,3-dimethyl-; 1,4-Hexanediol, 4-ethyl-2-methylene-; 1,5-Hexadiene-3,4-diol, 2,3,5-trimethyl-; 1,5-Hexadiene-3,4-diol, 5-ethyl-3-methyl-; 1,5-Hexanediol, 2-(1-methylethenyl)-; 1,6-Hexanediol, 2-ethenyl-; 1-Hexene-3,4-diol, 5,5-dimethyl-; 1-Hexene-3,4-diol, 5,5-methyl-; 2-Hexene-1,5-diol, 4-ethenyl-2,5-dimethyl-; 3-Hexene-1,6-diol, 2-ethenyl-2,5-dimethyl-; 3-Hexene-1,6-diol, 2-ethyl-; 3-Hexene-1,6-diol, 3,4-dimethyl-; 4-Hexene-2,3-diol, 2,5-dimethyl-; 4-Hexene-2,3-diol, 3,4-dimethyl-; 5-Hexene-1,3-diol, 3-(2-propenyl)-; 5-Hexene-2,3-diol, 2,3-dimethyl-; 5-Hexene-2,3-diol, 3,4-dimethyl-; 5-Hexene-2,3-diol, 3,5-dimethyl-; 5-Hexene-2,4-diol, 3-ethenyl-2,5-dimethyl-; 1,4-Heptanediol, 6-methyl-5-methylene-; 1,5-Heptadiene-3,4-diol, 2,3-dimethyl-; 1,5-Heptadiene-3,4-diol, 2,5-dimethyl-; 1,5-Heptadiene-3,4-diol, 3,5-dimethyl-, 1,7-Heptanediol, 2,6-bis(methylene)-; 1,7-Heptanediol, 4-methylene-; 1-Heptene-3,5-diol, 2,4-dimethyl-; 1-Heptene-3,5-diol, 2,6-dimethyl-; 1-Heptene-3,5-diol, 3-ethenyl-5-methyl; 1-Heptene-3,5-diol, 6,6-dimethyl-; 2,4-Heptadiene-2,6-diol, 4,6-dimethyl-; 2,5-Heptadiene-1,7-diol, 4,4-dimethyl-; 2,6-Heptadiene-1,4-diol, 2,5,5-trimethyl-; 2-Heptene-1,4-diol, 5,6-dimethyl-; 2-Heptene-1,5-diol, 5-ethyl-; 2-Heptene-1,7-diol, 2-methyl-; 3-Heptene-1,5-diol, 4,6-dimethyl-; 3-Heptene-1,7-diol, 3-methyl-6-methylene-; 3-Heptene-2,5-diol, 2,4-dimethyl-; 3-Heptene-2,5-diol, 2,5-dimethyl-; 3-Heptene-2,6-diol, 2,6-dimethyl-; 3-Heptene-2,6-diol 4,6-dimethyl-; 5-Heptene-1,3-diol, 2,4-dimethyl-; 5-Heptene-1,3-diol, 3,6-dimethyl-; 5-Heptene-1,4-diol, 2,6-dimethyl-; 5-Heptene-1,4-diol, 3,6-dimethyl-; 5-Heptene-2,4-diol, 2,3-dimethyl-; 6-Heptene-1,3-diol, 2,2-dimethyl-; 6-Heptene-1,4-diol, 4-(2-propenyl)-; 6-Heptene-1,4-diol, 5,6-dimethyl-; 6-Heptene-1,5-diol, 2,4-dimethyl-; 6-Heptene-1,5-diol, 2-ethylidene-6-methyl-; 6-Heptene-2,4-diol, 4-(2-propenyl)-; 6-Heptene-2,4-diol, 5,5-dimethyl-; 6-Heptene-2,5-diol, 4,6-dimethyl-; 6-Heptene-2,5-diol, 5-ethenyl-4-methyl-; 1,3-Octanediol, 2-methylene-; 1,6-Octadiene-3,5-diol, 2,6-dimethyl-; 1,6-Octadiene-3,5-diol, 3,7-dimethyl-; 1,7 Octadiene-3,6-diol, 2,6-dimethyl-; 1,7-Octadiene-3,6-diol, 2,7-dimethyl-; 1,7-Octadiene-3,6-diol, 3,6-dimethyl-; 1-Octene-3,6-diol, 3-ethenyl-; 2,4,6-Octadiene-1,8-diol, 2,7-dimethyl-; 2,4-Octadiene-1,7-diol, 3,7-dimethyl-; 2,5-Octadiene-1,7-diol, 2,6-dimethyl-; 2,5-Octadiene-1,7-diol, 3,7-dimethyl-; 2,6-Octadiene-1,4-diol, 3,7-dimethyl-(Rosiridol); 2,6-Octadiene-1,8-diol, 2-methyl-; 2,7-Octadiene-1,4-diol, 3,7-dimethyl-; 2,7-Octadiene-1,5-diol, 2,6-dimethyl-; 2,7-Octadiene-1,6-diol, 2,6-dimethyl-(8-Hydroxylinalool); 2,7-Octadiene-1,6-diol, 2,7-dimethyl-; 2-Octene-1,4-diol; 2-Octene-1,7-diol; 2-Octene-1,7-diol, 2-methyl-6-methylene-; 3,5-Octadiene-1,7-diol, 3,7-dimethyl-; 3,5-Octadiene-2,7-diol, 2,7-dimethyl-; 3,5-Octanediol, 4-methylene-; 3,7-Octadiene-1,6-diol, 2,6-dimethyl-; 3,7Octadiene-2,5-diol, 2,7-dimethyl-; 3,7-Octadiene-2,6-diol, 2,6-dimethyl-; 3-Octene-1,5-diol, 4-methyl-; 3-Octene-1,5-diol, 5-methyl-; 4,6-Octadiene-1,3-diol, 2,2-dimethyl-; 4,7-Octadiene-2,3-diol, 2,6-dimethyl-; 4,7-Octadiene-2,6-diol, 2,6-dimethyl-; 4-Octene-1,6-diol, 7-methyl-; 2,7-bis(methylene)-; 2-methylene-; 5,7-Octadiene-1,4-diol, 2,7-dimethyl-; 5,7-Octadiene-1,4-diol, 7-methyl-; 5-Octene-1,3-diol; 6-Octene-1,3-diol, 7-methyl-; 6-Octene-1,4-diol, 7-methyl-; 6-Octene-1,5-diol; 6-Octene-1,5-diol, 7-methyl-; 6-Octene-3,5-diol, 2-methyl-; 6-Octene-3,5-diol, 4-methyl-; 7-Octene-1,3-diol, 2-methyl-; 7-Octene-1,3-diol, 4-methyl-; 7-Octene-1,3-diol, 7-methyl-; 7-Octene-1,5-diol; 7-Octene-1,6-diol; 7-Octene-1,6-diol, 5-methyl-; 7-Octene-2,4-diol, 2-methyl-6-methylene-; 7-Octene-2,5-diol, 7-methyl-; 7-Octene-3,5-diol, 2-methyl-; 1-Nonene-3,5-diol; 1-Nonene-3,7-diol; 3-Nonene-2,5-diol; 4,6-Nonadiene-1,3-diol, 8-methyl-; 4-Nonene-2,8-diol; 6,8-Nonadiene-1,5-diol; 7-Nonene-2,4-diol; 8-Nonene-2,4-diol; 8-Nonene-2,5-diol; 1,9-Decadiene-3,8-diol; and/or 1,9-Decadiene-4,6-diol; and XI. mixtures thereof;

C. optionally, but preferably, an effective amount, sufficient to improve clarity, of low molecular weight water soluble solvents like ethanol, isopropanol, propylene glycol, 1,3-propanediol, propylene carbonate, etc., said water soluble solvents being at a level that will not form clear compositions by themselves;

D. optionally, but preferably, an effective amount to improve clarity, of water soluble calcium and/or magnesium salt, preferably chloride; and E. the balance being water.

wherein molar ratio of said principal solvent to said fabric softener active is not less than 3.

Preferably, when the fabric softener active is one in which the Y group is an amido group, the solvent is not a mono-ol, especially t-butanol, or 2-methyl-pentanediol.

DETAILED DESCRIPTION OF THE INVENTION

I. Fabric Softening Active

The present invention contains as an essential component, normally from about 15% to about 70%, preferably from about 17% to about 65%, more preferably from about 19% to about 60%, by weight of the composition, of a fabric softener active selected from the compounds identified hereinafter, and mixtures thereof.

(A) Diester Quaternary Ammonium Fabric Softening Active Compound (DEQA)

(1) The first type of DEQA preferably comprises, as the principal active, compounds of the formula $$\left[(R)_{4-m}-N^{(+)}-[(CH_2)_n-Y-R^1]_m\right] X^{(-)} \quad (1)$$

wherein: each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl or mixtures thereof; each m is 2 or 3; each n is from 1 to about 4; each Y is —O—(O)C—, or —C(O)—O—, but not —OC(O)O—; the sum of carbons in each $R^1$, plus one when Y is —O—(O)C—, is $C_6$–$C_{22}$, preferably $C_{14}$–$C_{20}$, but no more than one $YR^1$ sum being less than about 12 and then the other $YR^1$ sum is at least about 16, with each $R^1$ being a long chain $C_8$–$C_{22}$ (or $C_7$–$C_{21}$)hydrocarbyl, or substituted hydrocarbyl substituent, preferably $C_{10}$–$C_{20}$ (or $C_9$–$C_{19}$) alkyl or alkylene, most preferably $C_{12}$–$C_{18}$ (or $C_{11}$–$C_{17}$) alkyl or alkylene, and where, when said sum of carbons is $C_{16}$–$C_{18}$ and $R^1$ is a straight chain alkyl or alkylene group, the Iodine Value (hereinafter referred to as IV) of the parent fatty acid of this $R^1$ group is preferably from about 40 to about 140, more preferably from about 50 to about 130; and most preferably from about 70 to about 115. (As used herein, the Iodine Value of a "parent" fatty acid, or "corresponding" fatty acid, is used to define a level of unsaturation for an $R^1$ group that is the same as the level of unsaturation that would be present in a fatty acid containing the same $R^1$ group.)

The counterion, $X^{(-)}$ above, can be any softener-compatible anion, preferably the anion of a strong acid, for example, chloride, bromide, methylsulfate, sulfate, nitrate and the like, more preferably chloride. The anion can also, but less preferably, carry a double charge in which case $X^{(-)}$ represents half a group.

Preferred biodegradable quaternary ammonium fabric softening compounds can contain the group $C(O)R^1$ which is derived from unsaturated, and polyunsaturated, fatty acids, e.g., oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, etc. Non-limiting examples of DEQAs prepared from preferred fatty acids have the following approximate distributions:

| Fatty Acyl Group | DEQA[1] | DEQA[2] | DEQA[3] | DEQA[4] | DEQA[5] |
|---|---|---|---|---|---|
| C12 | trace | 66 | 0 | 0 | 0 |
| C14 | 3 | 22 | 0 | 0 | 0 |

-continued

| Fatty Acyl Group | DEQA[1] | DEQA[2] | DEQA[3] | DEQA[4] | DEQA[5] |
|---|---|---|---|---|---|
| C16 | 4 | 12 | 5 | 5 | 5 |
| C18 | 0 | — | 5 | 6 | 6 |
| C14:1 | 3 | — | 0 | 0 | 0 |
| C16:1 | 11 | — | 0 | 0 | 3 |
| C18:1 | 74 | — | 71 | 68 | 67 |
| C18:2 | 4 | — | 8 | 11 | 11 |
| C18:3 | 0 | — | 1 | 2 | 2 |
| C20:1 | 0 | — | 2 | 2 | 2 |
| C20 and up | 0 | — | 2 | 0 | 0 |
| Unknowns | 0 | — | 6 | 6 | 7 |
| Total | 99 | 100 | 100 | 100 | 102 |
| IV | 86–90 | Unknown | 99 | 100 | 95 |
| cis/trans (C18:1) | 20–30 | — | 4 | 5 | 5 |
| TPU* | 4 | — | 10 | 13 | 13 |

*Total Polyunsaturates

Mixtures of fatty acids, and mixtures of DEQAs that are derived from different fatty acids can be used, and are preferred. Non limiting examples of DEQA's that can be blended, to form DEQA's of this invention are as follows:

| Fatty Acyl Group | DEQA[6] | DEQA[7] |
|---|---|---|
| C14 | 0 | 1 |
| C16 | 11 | 25 |
| C18 | 4 | 20 |
| C14:1 | 0 | 0 |
| C16:1 | 1 | 0 |
| C18:1 | 27 | 45 |
| C18:2 | 50 | 6 |
| C18:3 | 7 | 0 |
| Unknowns | 0 | 3 |
| Total | 100 | 100 |
| IV | 125–138 | 56 |
| cis/trans (C18:1) | Not Available | 7 |
| TPU | 57 | 6 |

DEQA[6] is prepared from a soy bean fatty acid, and DEQA[7] is prepared from a slightly hydrogenated tallow fatty acid.

Also optionally, but preferably, $R^1$ groups can comprise branched chains, e.g., from isostearic acid, for at least part of the $R^1$ groups. The total of active represented by the branched chain groups, when they are present, is typically from about 1% to about 90%, preferably from about 10% to about 70%, more preferably from about 20% to about 50%.

| Fatty Acyl Group | DEQA[8] | DEQA[9] | DEQA[10] |
|---|---|---|---|
| Isomyristic acid | — | 1–2 | — |
| Myristic acid | 7–11 | 0.5–1 | — |
| Isopalmitic acid | 6–7 | 6–7 | 1–3 |
| Palmitic acid | 4–5 | 6–7 | — |
| Isostearic acid | 70–76 | 80–82 | 60–66 |
| Stearic acid | — | 2–3 | 8–10 |
| Isoleic acid | — | — | 13–17 |
| Oleic acid | — | — | 6–12 |
| IV | 3 | 2 | 7–12 |

DEQA[8]–DEQA[10] are prepared from different commercially available isostearic acids.

The more preferred DEQA's are those that are prepared as a single DEQA from blends of all the different fatty acids that are represented (total fatty acid blend), rather than from blends of mixtures of separate finished DEQA's that are prepared from different portions of the total fatty acid blend.

It is preferred that at least a majority of the fatty acyl groups are unsaturated, e.g., from about 50% to 100%, preferably from about 55% to about 95%, more preferably from about 60% to about 90%, and that the total level of active containing polyunsaturated fatty acyl groups (TPU) be from about 3% to about 30%, preferably from about 5% to about 25%, more preferably from about 10% to about 18%. The cis/trans ratio for the unsaturated fatty acyl groups is important, with a cis/trans ratio of from 1:1 to about 50:1, the minimum being 1:1, preferably at least 3:1, and more preferably from about 4:1 to about 20:1. (As used herein, the "percent of softener active" containing a given $R^1$ group is the same as the percentage of that same $R^1$ group is to the total $R^1$ groups used to form all of the softener actives.)

The unsaturated, including the preferred polyunsaturated, fatty acyl groups, discussed hereinbefore and hereinafter, surprisingly provide effective softening, but also provide better rewetting characteristics, good antistatic characteristics, and especially, superior recovery after freezing and thawing.

The highly unsaturated materials are also easier to formulate into concentrated premixes that maintain their low viscosity and are therefore easier to process, e.g., pump, mixing, etc. These highly unsaturated materials with only the low amount of solvent that normally is associated with such materials, i.e., from about 5% to about 20%, preferably from about 8% to about 25%, more preferably from about 10% to about 20%, weight of the total softener/solvent mixture, are also easier to formulate into concentrated, stable compositions of the present invention, even at ambient temperatures. This ability to process the actives at low temperatures is especially important for the polyunsaturated groups, since it minimizes degradation. Additional protection against degradation can be provided when the compounds and softener compositions contain effective antioxidants and/or reducing agents, as disclosed hereinafter.

The present invention can contain medium-chain biodegradable quaternary ammonium fabric softening compound, DEQA, as a preferred component, having the above formula (1) and/or formula (2), below, wherein:

each Y is —O—(O)C—, or —C(O)—O—, preferably —O—(O)C—;

m is 2 or 3, preferably 2;

each n is 1 to 4, preferably 2;

each R substituent is a $C_1$–$C_6$ alkyl, preferably a methyl, ethyl, propyl, benzyl groups and mixtures thereof more preferably a $C_1$–$C_3$ alkyl group;

each $R^1$ is a saturated, (the IV is preferably about 10 or less, more preferably less than about 5), (The sum of the carbons in R+1 is increased by one when Y is —O—(O)C—.) $C_8$–$C_{14}$, preferably a $C_{1214}$ hydrocarbyl, or substituted hydrocarbyl substituent and the counterion, $X^-$, is the same as above.

Preferably $X^-$ does not include phosphate salts.

The saturated $C_8$–$C_{14}$ fatty acyl groups can be pure derivatives or can be mixed chainlengths.

Suitable fatty acid sources for said fatty acyl groups are coco, lauric, caprylic, and capric acids.

For $C_{12}$–$C_{14}$ (or $C_{11}$–$C_{13}$) hydrocarbyl groups, the groups are preferably saturated, e.g., the IV is preferably less than about 10, preferably less than about 5.

It will be understood that substituents R and $R^1$ can optionally be substituted with various groups such as alkoxyl or hydroxyl groups, and can be straight, or branched so long as the $R^1$ groups maintain their basically hydrophobic character. The preferred compounds can be considered to be biodegradable diester variations of ditallow dimethyl ammonium chloride (hereinafter referred to as "DTDMAC"), which is a widely used fabric softener.

A preferred long chain DEQA is the DEQA prepared from sources containing high levels of polyunsaturation, i.e., N,N-di(acyl-oxyethyl)-N,N-dimethyl ammonium chloride, where the acyl is derived from fatty acids containing sufficient polyunsaturation, e.g., mixtures of tallow fatty acids and soybean fatty acids. Another preferred long chain DEQA is the dioleyl (nominally) DEQA, i.e., DEQA in which N,N-(oleoyl-oxyethyl)-N,N-dimethyl ammonium chloride is the major ingredient. Preferred sources of fatty acids for such DEQAs are vegetable oils, and/or partially hydrogenated vegetable oils, such as canola oil, with high contents of unsaturated, e.g., oleoyl groups. Highly preferred medium chain DEQAs are dicocoyl DEQA (derived from coconut fatty acids), i.e., N,N-di(coco-oyl-oxyethyl)-N,N-dimethyl ammonium chloride, exemplified hereinafter as DEQA[6], and N,N-di(lauroyl-oxyethyl)-N,N-dimethyl ammonium chloride.

As used herein, when the diester is specified, it can include the monoester that is present. Preferably, at least about 80% of the DEQA is in the diester form, and from 0% to about 20% can be DEQA monoester, e.g., in formula (1), m is 2 and one $YR^1$ group is either H or —C(O)OH. For softening, under no/low detergent carry-over laundry conditions the percentage of monoester should be as low as possible, preferably no more than about 5%. However, under high, anionic detergent surfactant or detergent builder carry-over conditions, some monoester can be preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in manufacturing the DEQA.

The above compounds, used as the biodegradable quaternized ester-amine softening material in the practice of this invention, can be prepared using standard reaction chemistry. In one synthesis of a di-ester variation of DTDMAC, an amine of the formula $RN(CH_2CH_2OH)_2$ is esterified at both hydroxyl groups with an acid chloride of the formula $R^1C(O)Cl$, then quaternized with an alkyl halide, RX, to yield the desired reaction product (wherein R and $R^1$ are as defined hereinbefore). However, it will be appreciated by those skilled in the chemical arts that this reaction sequence allows a broad selection of agents to be prepared.

Yet another DEQA softener active that is suitable for the formulation of the concentrated, clear liquid fabric softener compositions of the present invention has the above formula (1) wherein one R group is a $C_{1-4}$ hydroxy alkyl group, preferably one wherein one R group is a hydroxyethyl group. An example of such a hydroxyethyl ester active is di(acyloxyethyl)(2-hydroxyethyl)methyl ammonium methyl sulfate, wherein the acyl group is the same as that of DEQA[1], exemplified hereinafter as DEQA[8].

(2) The second type of DEQA active has the general formula:

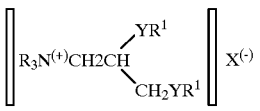

(2)

wherein each Y, R, $R^1$, and $X^{(-)}$ have the same meanings as before. Such compounds include those having the formula:

$$[CH_3]_3N^{(+)}[CH_2CH(CH_2O(O)CR^1)O(O)CR^1]Cl^{(-)}$$

where each R is a methyl or ethyl group and preferably each $R^1$ is in the range of $C_{15}$ to $C_{19}$. Degrees of branching and substitution can be present in the alkyl(ene) chains. The anion $X^{(-)}$ in the molecule is the same as in DEQA (1) above. As used herein, when the diester is specified, it can include the monoester that is present. The amount of monoester that can be present is the same as in DEQA (1). An example of a preferred DEQA of formula (2) is the "propyl" ester quaternary ammonium fabric softener active having the formula 1,2-di(acyloxy)-3-trimethylammoniopropane chloride, wherein the acyl group is the same as that of DEQA[5].

These types of agents and general methods of making them are disclosed in U.S. Pat. No. 4,137,180, Naik et al., issued Jan. 30, 1979, which is incorporated herein by reference.

In preferred softener actives (1) and (2), each $R^1$ is a hydrocarbyl, or substituted hydrocarbyl, group, preferably, alkyl, monounsaturated alkylene, and polyunsaturated alkylene groups, with the softener active containing polyunsaturated alkylene groups being at least about 3%, preferably at least about 5%, more preferably at least about 10%, and even more preferably at least about 15%, by weight of the total softener active present; the actives preferably containing mixtures of $R^1$ groups, especially within the individual molecules, and also, optionally, but preferably, the saturated $R^1$ groups comprising branched chains, e.g., from isostearic acid, for at least part of the saturated $R^1$ groups, the total of active represented by the branched chain groups preferably being from about 1% to about 90%, preferably from about 10% to about 70%, more preferably from about 20% to about 50%.

The DEQAs herein can contain a low level of fatty acid, which can be from unreacted starting material used to form the DEQA and/or as a by-product of any partial degradation (hydrolysis) of the softener active in the finished composition. It is preferred that the level of free fatty acid be low, preferably below about 10%, and more preferably below about 5%, by weight of the fabric softener active.

II. Principal Solvent

In order to provide excellent water dispersibility, the molar ratio of the principal solvent to the fabric softening active should be not less than about 3, preferably from about 3 to about 100, more preferably from about 3.6 to about 50, the most preferably from about 4 to about 25.

Said principal solvent is selected to minimize solvent odor impact in the composition and to provide a low viscosity to the final composition.

The compositions of the present invention comprise less than about 40%, preferably from about 10% to about 35%, more preferably from about 12% to about 25%, and even more preferably from about 14% to about 20%, of the principal solvent, by weight of the composition. Said principal solvent is selected to minimize solvent odor impact in the composition and to provide a low viscosity to the final composition. For example, isopropyl alcohol is not very effective and has a strong odor. n-Propyl alcohol is more effective, but also has a distinct odor. Several butyl alcohols also have odors but can be used for effective clarity/stability, especially when used as part of a principal solvent system to minimize their odor. The alcohols are also selected for optimum low temperature stability, that is they are able to form compositions that are liquid with acceptable low viscosities and translucent, preferably clear, down to about 40° F. (about 4.4° C.) and are able to recover after storage down to about 20° F. (about 6.7° C.).

The suitability of any principal solvent for the formulation of the liquid, concentrated, preferably clear, fabric softener compositions herein with the requisite stability is surprisingly selective. Suitable solvents can be selected based upon their octanol/water partition coefficient (P). Octanol/water partition coefficient of a principal solvent is the ratio between its equilibrium concentration in octanol and in water. The partition coefficients of the principal solvent ingredients of this invention are conveniently given in the form of their logarithm to the base 10, log P.

The log P of many ingredients has been reported; for example, the Pomona92 database, available from Daylight Chemical Information Systems, Inc. (Daylight CIS), Irvine, Calif., contains many, along with citations to the original literature. However, the log P values are most conveniently calculated by the "CLOGP" program, also available from Daylight CIS. This program also lists experimental log P values when they are available in the Pomona92 database. The "calculated log P" (C log P) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The C log P values, which are the most reliable and widely used estimates for this physiochemical property, are preferably used instead of the experimental log P values in the selection of the principal solvent ingredients which are useful in the present invention. Other methods that can be used to compute C log P include, e.g., Crippen's fragmentation method as disclosed in J. Chem. Inf Comput. Sci., 27, 21 (1987); Viswanadhan's fragmentation method as disclose in J. Chem. Inf Comput. Sci., 29, 163 (1989); and Broto's method as disclosed in Eur. J. Med. Chem.—Chim. Theor., 19, 71 (1984).

The principal solvents herein are selected from those having a C log P of from about 0.15 to about 0.64, preferably from about 0.25 to about 0.62, and more preferably from about 0.40 to about 0.60, said principal solvent preferably being asymmetric, and preferably having a melting, or solidification, point that allows it to be liquid at, or near room temperature. Solvents that have a low molecular weight and are biodegradable are also desirable for some purposes. The more asymmetric solvents appear to be very desirable, whereas the highly symmetrical solvents, having a center of symmetry, such as 1,7-heptanediol, or 1,4-bis (hydroxymethyl)cyclohexane, appear to be unable to provide the essentially clear compositions when used alone, even though their C log P values fall in the preferred range. One can select the most suitable principal solvent by determining whether a composition containing about 27% di(oleyoyloxyethyl)dimethylammonium chloride, about 16–20% of principal solvent, and about 4–6% ethanol remains clear during storage at about 40° F. (about 4.4° C.) and recovers from being frozen at about 0° F. (about −18° C.).

The most preferred principal solvents can be identified by the appearance of the freeze-dried dilute treatment compositions used to treat fabrics. These dilute compositions appear to have dispersions of fabric softener that exhibit a more uni-lamellar appearance than conventional fabric softener compositions. The closer to uni-lamellar the appearance, the better the compositions seem to perform. These compositions provide surprisingly good fabric softening as compared to similar compositions prepared in the conventional way with the same fabric softener active. The compositions also inherently provide improved perfume deposition as compared to conventional fabric softening compositions, especially when the perfume is added to the compositions at, or near, room temperature.

Operable principal solvents are listed below under various listings, e.g., aliphatic and/or alicyclic diols with a given number of carbon atoms; monols; derivatives of glycerine; alkoxylates of diols; and mixtures of all of the above. The preferred principal solvents are in italics and the most preferred principal solvents are in bold type. The reference numbers are the Chemical Abstracts Service Registry numbers (CAS No.) for those compounds that have such a number. Novel compounds have a method identified, described hereinafter, that can be used to prepare the compounds. Some inoperable principal solvents are also listed below for comparison purposes. The inoperable principal solvents, however, can be used in mixtures with operable principal solvents. Operable principal solvents can be used to make concentrated fabric softener compositions that meet the stability/clarity requirements set forth herein.

Many diol principal solvents that have the same chemical formula can exist as many stereoisomers and/or optical isomers. Each isomer is normally assigned with a different CAS No. For examples, different isomers of 4-methyl-2,3-hexanediol are assigned to at least the following CAS Nos: 146452-51-9; 146452-50-8; 146452-49-5; 146452-48-4; 123807-34-1; 123807-33-0; 123807-32-9; and 123807-31-8.

In the following listings, for simplicity, each chemical formula is listed with only one CAS No. This disclosure is only for exemplification and is sufficient to allow the practice of the invention. The disclosure is not limiting. Therefore, it is understood that other isomers with other CAS Nos, and their mixtures, are also included. By the same token, when a CAS No. represents a molecule which contains some particular isotopes, e.g., deuterium, tritium, carbon-13, etc., it is understood that materials which contain naturally distributed isotopes are also included, and vice versa.

TABLE I

| MONO-OLS | CAS No. |
|---|---|
| *n-propanol* | 71-23-8 |
| **2-butanol** | 15892-23-6 |
| 2-methyl-2-propanol | 75-65-0 |
| Inoperable Isomer | |
| 2-methyl-1-propanol | 78-83-1 |

TABLE II

| C6 DIOLS | CAS No. |
|---|---|
| Operable Isomers | |
| 2,3-butanediol, 2,3-dimethyl- | 76-09-5 |
| *1,2-butanediol, 2,3-dimethyl-* | 66553-15-9 |
| *1,2-butanediol, 3,3-dimethyl-* | 59562-82-2 |
| *2,3-pentanediol, 2-methyl-* | 7795-80-4 |
| *2,3-pentanediol, 3-methyl-* | 63521-37-9 |
| *2,3-pentanediol, 4-methyl-* | 7795-79-1 |
| *2,3-hexanediol* | 617-30-1 |
| *3,4-hexanediol* | 922-17-8 |
| **1.2-butanediol, 2-ethyl-** | 66553-16-0 |

TABLE II-continued

| C6 DIOLS | CAS No. |
|---|---|
| **1,2-pentanediol, 2-methyl-** | 20667-05-4 |
| **1,2-pentanediol, 3-methyl-** | 159623-53-7 |
| **1,2-pentanediol, 4-methyl-** | 72110-08-8 |
| **1,2-hexanediol** | 6920-22-5 |
| Inoperable Isomers | |
| 1,3-propanediol, 2-ethyl-2-methyl- | |
| 1,3-propanediol, 2-isopropyl- | |
| 1,3-propanediol, 2-propyl- | |
| 1,3-butanediol, 2,2-dimethyl- | |
| 1,3-butanediol, 2,3-dimethyl- | |
| 1,3-butanediol, 2-ethyl- | |
| 1,4-butanediol, 2,2-dimethyl- | |
| 1,4-butanediol, 2,3-dimethyl- | |
| 1,4-butanediol, 2-ethyl- | |
| 1,3-pentanediol, 2-methyl- | |
| 1,3-pentanediol, 3-methyl- | |
| 1,3-pentanediol, 4-methyl- | |
| 1,4-pentanediol, 2-methyl- | |
| 1,4-pentanediol, 3-methyl- | |
| 1,4-pentanediol, 4-methyl- | |
| 1,5-pentanediol, 2-methyl- | |
| 1,5-pentanediol, 3-methyl- | |
| 2,4-pentanediol, 2-methyl- | |
| 2,4-pentanediol, 3-methyl- | |
| 1,3-hexanediol | |
| 1,4-hexanediol | |
| 1,5-hexanediol | |
| 1,6-hexanediol | |
| 2,4-hexanediol | |
| 2,5-hexanediol | |

TABLE III

| C7 DIOLS | CAS No. |
|---|---|
| Operable Isomers | |
| 1,3-propanediol, 2-butyl- | 2612-26-2 |
| 1,3-propanediol, 2,2-diethyl- | 115-76-4 |
| 1,3-propanediol, 2-(1-methylpropyl)- | 33673-01-7 |
| 1,3-propanediol, 2-(2-methylpropyl)- | 26462-20-8 |
| 1,3-propanediol, 2-methyl-2-propyl- | 78-26-2 |
| 1,2-butanediol, 2,3,3-trimethyl- | **Method B** |
| 1,4-butanediol, 2-ethyl-2-methyl- | 76651-98-4 |
| 1,4-butanediol, 2-ethyl-3-methyl- | 66225-34-1 |
| 1,4-butanediol, 2-propyl- | 62946-68-3 |
| 1,4-butanediol, 2-isopropyl- | 39497-66-0 |
| 1,5-pentanediol, 2,2-dimethyl- | 3121-82-2 |
| 1,5-pentanediol, 2,3-dimethyl- | 81554-20-3 |
| 1,5-pentanediol, 2,4-dimethyl- | 2121-69-9 |
| 1,5-pentanediol, 3,3-dimethyl- | 53120-74-4 |
| 2,3-pentanediol, 2,3-dimethyl- | 6931-70-0 |
| 2,3-pentanediol, 2,4-dimethyl- | 66225-53-4 |
| 2,3-pentanediol, 3,4-dimethyl- | 37164-04-8 |
| 2,3-pentanediol, 4,4-dimethyl- | 89851-45-6 |
| 3,4-pentanediol, 2,3-dimethyl- | **Method B** |
| 1,5-pentanediol, 2-ethyl- | 14189-13-0 |
| 1,6-hexanediol, 2-methyl- | 25258-92-8 |
| 1,6-hexanediol, 3-methyl- | 4089-71-8 |
| 2,3-hexanediol, 2-methyl- | 59215-55-3 |
| 2,3-hexanediol, 3-methyl- | 139093-40-6 |
| 2,3-hexanediol, 4-methyl- | *** |
| 2,3-hexanediol, 5-methyl- | **Method B** |
| 3,4-hexanediol, 2-methyl- | **Method B** |
| 3,4-hexanediol, 3-methyl- | 18938-47-1 |
| 1,3-heptanediol | 23433-04-7 |
| 1,4-heptanediol | 40646-07-9 |
| 1,5-heptanediol | 60096-09-5 |
| 1,6-heptanediol | 13175-27-4 |

TABLE III-continued

| C7 DIOLS | CAS No. |
|---|---|
| Preferred Isomers | |
| *1,3-propanediol, 2-butyl-* | 2612-26-2 |
| *1,4-butanediol, 2-propyl-* | 62946-68-3 |
| *1,5-pentanediol, 2-ethyl-* | 14189-13-0 |
| *2,3-pentanediol, 2,3-dimethyl-* | 6931-70-0 |
| *2,3-pentanediol, 2,4-dimethyl-* | 66225-53-4 |
| *2,3-pentanediol, 3,4-dimethyl-* | 37164-04-8 |
| *2,3-pentanediol, 4,4-dimethyl-* | 89851-45-6 |
| *3,4-pentanediol, 2,3-dimethyl-* | **Method B** |
| *1,6-hexanediol, 2-methyl-* | 25258-92-8 |
| *1,6-hexanediol, 3-methyl-* | 4089-71-8 |
| *1,3-heptanediol* | 23433-04-7 |
| *1,4-heptanediol* | 40646-07-9 |
| *1,5-heptanediol* | 60096-09-5 |
| *1,6-heptanediol* | 13175-27-4 |
| More Preferred Isomers | |
| **2,3-pentanediol, 2,3-dimethyl-** | 6931-70-0 |
| **2,3-pentanediol, 2,4-dimethyl-** | 66225-53-4 |
| **2,3-pentanediol, 3,4-dimethyl-** | 37164-04-8 |
| **2,3-pentanediol, 4,4-dimethyl-** | 89851-45-6 |
| **3,4-pentanediol, 2,3-dimethyl-** | **Method B** |
| Inoperable Isomers | |
| 1,3-propanediol, 2-methyl-2-isopropyl- | |
| 1,2-butanediol, 2-ethyl-3-methyl- | |
| 1,3-butanediol, 2,2,3-trimethyl- | |
| 1,3-butanediol, 2-ethyl-2-methyl- | |
| 1,3-butanediol, 2-ethyl-3-methyl- | |
| 1,3-butanediol, 2-isopropyl- | |
| 1,3-butanediol, 2-propyl- | |
| 1,4-butanediol, 2,2,3-trimethyl | |
| 1,4-butanediol, 3-ethyl-1-methyl- | |
| 1,2-pentanediol, 2,3-dimethyl- | |
| 1,2-pentanediol, 2,4-dimethyl- | |
| 1,2-pentanediol, 3,3-dimethyl- | |
| 1,2-pentanediol, 3,4-dimethyl- | |
| 1,2-pentanediol, 4,4-dimethyl- | |
| 1,2-pentanediol, 2-ethyl- | |
| 1,3-pentanediol, 2,2-dimethyl- | |
| 1,3-pentanediol, 2,3-dimethyl- | |
| 1,3-pentanediol, 2,4-dimethyl- | |
| 1,3-pentanediol, 2-ethyl- | |
| 1,3-pentanediol, 3,4-dimethyl- | |
| 1,3-pentanediol, 4,4-dimethyl- | |
| 1,4-pentanediol, 2,2-dimethyl- | |
| 1,4-pentanediol, 2,3-dimethyl- | |
| 1,4-pentanediol, 2,4-dimethyl- | |
| 1,4-pentanediol, 3,3-dimethyl- | |
| 1,4-pentanediol, 3,4-dimethyl- | |
| 2,4-pentanediol, 2,3-dimethyl- | |
| 2,4-pentanediol, 2,4-dimethyl- | |
| 2,4-pentanediol, 3,3-dimethyl- | |
| 1,2-hexanediol, 2-methyl- | |
| 1,2-hexanediol, 3-methyl- | |
| 1,2-hexanediol, 4-methyl- | |
| 1,2-hexanediol, 5-methyl- | |
| 1,3-hexanediol, 2-methyl- | |
| 1,3-hexanediol, 3-methyl- | |
| 1,3-hexanediol, 4-methyl- | |
| 1,3-hexanediol, 5-methyl- | |
| 1,4-hexanediol, 2-methyl- | |
| 1,4-hexanediol, 3-methyl- | |
| 1,4-hexanediol, 4-methyl- | |
| 1,4-hexanediol, 5-methyl- | |
| 1,5-hexanediol, 2-methyl- | |
| 1,5-hexanediol, 3-methyl- | |
| 1,5-hexanediol, 4-methyl- | |
| 1,5-hexanediol, 5-methyl- | |
| 2,4-hexanediol, 2-methyl- | |
| 2,4-hexanediol, 3-methyl- | |
| 2,4-hexanediol, 4-methyl- | |
| 2,4-hexanediol, 5-methyl- | |
| 2,5-hexanediol, 2-methyl- | |

TABLE III-continued

| C7 DIOLS | CAS No. |
|---|---|
| 2,5-hexanediol, 3-methyl- | |
| 1,2-heptanediol | |
| 2,3-heptanediol | |
| 2,4-heptanediol | |
| 2,5-heptanediol | |
| 2,6-heptanediol | |
| 3,4-heptanediol | |
| 1,7-heptanediol | |
| 3,5-heptanediol | |

***146452-51-9; 146452-50-8; 146452-49-5; 146452-48-4; 123807-34-1; 123807-33-0; 123807-32-9; 123807-31-8; and mixtures thereof.

TABLE IV

| OCTANEDIOL ISOMERS | |
|---|---|
| Chemical Name | CAS No. |
| PROPANEDIOL DERIVATIVES | |
| Operable Isomers | |
| 1,3-propanediol, 2-(2-methylbutyl)- | 87194-40-9 |
| 1,3-propanediol, 2-(1,1-dimethylpropyl)- | **Method D** |
| 1,3-propanediol, 2-(1,2-dimethylpropyl)- | **Method D** |
| 1,3-propanediol, 2-(1-ethylpropyl)- | 25462-28-6 |
| 1,3-propanediol, 2-(1-methylbutyl)- | 22131-29-9 |
| 1,3-propanediol, 2-(2,2-dimethylpropyl)- | **Method D** |
| 1,3-propanediol, 2-(3-methylbutyl)- | 25462-27-5 |
| 1,3-propanediol, 2-butyl-2-methyl- | 3121-83-3 |
| 1,3-propanediol, 2-ethyl-2-isopropyl- | 24765-55-7 |
| 1,3-propanediol, 2-ethyl-2-propyl- | 25450-88-8 |
| 1,3-propanediol, 2-methyl-2-(1-methylpropyl)- | 813-60-5 |
| 1,3-propanediol, 2-methyl-2-(2-methylpropyl)- | 25462-42-4 |
| 1,3-propanediol, 2-tertiary-butyl-2-methyl- | 25462-45-7 |
| More Preferred Isomers | |
| **1,3-propanediol, 2-(1,1-dimethylpropyl)-** | **Method D** |
| **1,3-propanediol, 2-(1,2-dimethylpropyl)-** | **Method D** |
| **1,3-propanediol, 2-(1-ethylpropyl)-** | 25465-28-6 |
| **1,3-propanediol, 2-(2,2-dimethylpropyl)-** | **Method D** |
| **1,3-propanediol, 2-ethyl-2-isopropyl-** | 24765-55-7 |
| **1,3-propanediol, 2-methyl-2-(1-methylpropyl)-** | 813-60-5 |
| **1,3-propanediol, 2-methyl-2-(2-methylpropyl)-** | 25462-42-4 |
| **1,3-propanediol, 2-tertiary-butyl-2-methyl-** | 25462-45-7 |
| Inoperable Isomers | |
| 1,3-propanediol, 2-pentyl- | |
| BUTANEDIOL DERIVATIVES | |
| Operable Isomers | |
| 1,3-butanediol, 2,2-diethyl- | 99799-77-6 |
| 1,3-butanediol, 2-(1-methylpropyl)- | **Method C** |
| 1,3-butanediol, 2-butyl- | 83988-22-1 |
| 1,3-butanediol, 2-ethyl-2,3-dimethyl- | **Method D** |
| 1,3-butanediol, 2-(1,1-dimethylethyl)- | 67271-58-3 |
| 1,3-butanediol, 2-(2-methylpropyl)- | **Method C** |
| 1,3-butanediol, 2-methyl-2-isopropyl- | **Method C** |
| 1,3-butanediol, 2-methyl-2-propyl- | 99799-79-8 |
| 1,3-butanediol, 3-methyl-2-isopropyl- | **Method C** |
| 1,3-butanediol, 3-methyl-2-propyl- | **Method D** |
| 1,4-butanediol, 2,2-diethyl- | **Method H** |
| 1,4-butanediol, 2-methyl-2-propyl- | **Method H** |
| 1,4-butanediol, 2-(1-methylpropyl)- | **Method H** |
| 1,4-butanediol, 2-ethyl-2,3-dimethyl- | **Method F** |
| 1,4-butanediol, 2-ethyl-3,3-dimethyl- | **Method F** |
| 1,4-butanediol, 2-(1,1-dimethylethyl)- | 36976-70-2 |
| 1,4-butanediol, 2-(2-methylpropyl)- | **Method F** |
| 1,4-butanediol, 2-methyl-3-propyl | 90951-76-1 |
| 1,4-butanediol, 3-methyl-2-isopropyl- | 99799-24-3 |

TABLE IV-continued

| OCTANEDIOL ISOMERS | |
|---|---|
| Chemical Name | CAS No. |
| Preferred Isomers | |
| *1,3-butanediol, 2,2-diethyl-* | 99799-77-6 |
| *1,3-butanediol, 2-(1-methylpropyl)-* | **Method C** |
| *1,3-butanediol, 2-butyl-* | 83988-22-1 |
| *1,3-butanediol, 2-ethyl-2,3-dimethyl-* | **Method D** |
| *1,3-butanediol, 2-(1,1-dimethylethyl)-* | 67271-58-3 |
| *1,3-butanediol, 2-(2-methylpropyl)-* | **Method C** |
| *1,3-butanediol, 2-methyl-2-isopropyl-* | **Method C** |
| *1,3-butanediol, 2-methyl-2-propyl-* | 99799-79-8 |
| *1,3-butanediol, 3-methyl-2-propyl-* | **Method D** |
| *1,4-butanediol, 2,2-diethyl-* | **Method H** |
| *1,4-butanediol, 2-ethyl-2,3-dimethyl-* | **Method F** |
| *1,4-butanediol, 2-ethyl-3,3-dimethyl-* | **Method F** |
| *1,4-butanediol, 2-(1,1-dimethylethyl)-* | 36976-70-2 |
| *1,4-butanediol, 3-methyl-2-isopropyl-* | 99799-24-3 |
| More Preferred Isomers | |
| **1,3-butanediol, 2-(1-methylpropyl)-** | **Method C** |
| **1,3-butanediol, 2-(2-methylpropyl)-** | **Method C** |
| **1,3-butanediol, 2-butyl-** | 83988-22-1 |
| **1,3-butanediol, 2-methyl-2-propyl-** | 99799-79-8 |
| **1,3-butanediol, 3-methyl-2-propyl-** | **Method D** |
| **1,4-butanediol, 2,2-diethyl-** | **Method H** |
| **1,4-butanediol, 2-ethyl-2,3-dimethyl-** | **Method F** |
| **1,4-butanediol, 2-ethyl-3,3-dimethyl-** | **Method F** |
| **1,4-butanediol, 2-(1,1-dimethylethyl)-** | 36976-70-2 |
| Inoperable Isomers | |
| 1,4-butanediol, 2-butyl- | |
| 1,2-butanediol, 2-ethyl-3,3-dimethyl- | |
| 1,4-butanediol, 2-methyl-2-isopropyl- | |
| 1,2-butanediol, 3-methyl-2-isopropyl- | |
| 1,4-butanediol, 2,2,3,3-tetramethyl- | |
| TRIMETHYLPENTANEDIOL ISOMERS | |
| Operable Isomers | |
| 1,3-pentanediol, 2,2,3-trimethyl- | 35512-54-0 |
| 1,3-pentanediol, 2,2,4-trimethyl- | 144-19-4 |
| 1,3-pentanediol, 2,3,4-trimethyl- | 116614-13-2 |
| 1,3-pentanediol, 2,4,4-trimethyl- | 109387-36-2 |
| 1,3-pentanediol, 3,4,4-trimethyl- | 81756-50-5 |
| 1,4-pentanediol, 2,2,3-trimethyl- | **Method H** |
| 1,4-pentanediol, 2,2,4-trimethyl- | 80864-10-4 |
| 1,4-pentanediol, 2,3,3-trimethyl- | **Method H** |
| 1,4-pentanediol, 2,3,4-trimethyl- | 92340-74-4 |
| 1,4-pentanediol, 3,4,4-trimethyl- | 16466-35-6 |
| 1,5-pentanediol, 2,2,3-trimethyl- | **Method F** |
| 1,5-pentanediol, 2,2,4-trimethyl- | 3465-14-3 |
| 1,5-pentanediol, 2,3,3-trimethyl- | **Method A** |
| 1,5-pentanediol, 2,3,4-trimethyl- | 85373-83-7 |
| 2,4-pentanediol, 2,3,3-trimethyl- | 24892-51-1 |
| 2,4-pentanediol, 2,3,4-trimethyl- | 24892-52-2 |
| Preferred Isomers | |
| *1,3-pentanediol, 2,2,3-trimethyl-* | *35512-54-0* |
| *1,3-pentanediol, 2,2,4-trimethyl-* | *144-19-4* |
| *1,3-pentanediol, 2,3,4-trimethyl-* | *116614-13-2* |
| *1,3-pentanediol, 2,4,4-trimethyl-* | *109387-36-2* |
| *1,3-pentanediol, 3,4,4-trimethyl-* | *81756-50-5* |
| *1,4-pentanediol, 2,2,3-trimethyl-* | **Method H** |
| *1,4-pentanediol, 2,2,4-trimethyl-* | *80864-10-4* |
| *1,4-pentanediol, 2,3,3-trimethyl-* | **Method F** |
| *1,4-pentanediol, 3,3,4-trimethyl-* | *92340-74-4* |
| *1,4-pentanediol, 3,3,4-trimethyl-* | *16466-35-6* |
| *1,5-pentanediol, 2,2,3-trimethyl-* | **Method A** |
| *1,5-pentanediol, 2,2,4-trimethyl-* | *3465-14-3* |
| *1,5-pentanediol, 2,3,3-trimethyl-* | **Method A** |
| *2,4-pentanediol, 2,3,4-trimethyl-* | *24892-52-2* |
| More Preferred Isomers | |
| **1,3-pentanediol, 2,3,4-trimethyl-** | 116614-13-2 |
| **1,4-pentanediol, 2,3,4-trimethyl-** | 92340-74-4 |
| **1,5-pentanediol, 2,2,3-trimethyl-** | **Method A** |

TABLE IV-continued

OCTANEDIOL ISOMERS

| Chemical Name | CAS No. |
|---|---|
| **1,5-pentanediol, 2,2,4-trimethyl-** | 3465-14-3 |
| **1,5-pentanediol, 2,3,3-trimethyl-** | **Method A** |
| Inoperable Isomers | |
| 1,2-pentanediol, 2,3,3-trimethyl- | |
| 1,2-pentanediol, 2,3,4-trimethyl- | |
| 1,2-pentanediol, 2,4,4-trimethyl- | |
| 1,2-pentanediol, 3,3,4-trimethyl- | |
| 1.2-pentanediol, 3,4,4-trimethyl- | |
| 2,3-pentanediol, 2,3,4-trimethyl- | |
| 2,3-pentanediol, 2,4,4-trimethyl- | |
| 2.3-pentanediol, 3,4,4-trimethyl- | |
| ETHYLMETHYLPENTANEDIOL ISOMERS | |
| Operable Isomers | |
| 1,3-pentanediol, 2-ethyl-2-methyl- | **Method C** |
| 1,3-pentanediol, 2-ethyl-3-methyl- | **Method D** |
| 1,3-pentanediol, 2-ethyl-4-methyl- | 148904-97-6 |
| 1,3-pentanediol, 3-ethyl-2-methyl- | 55661-05-7 |
| 1.4-pentanediol, 2-ethyl-2-methyl- | **Method H** |
| 1,4-pentanediol, 2-ethyl-3-methyl- | **Method F** |
| 1.4-pentanediol, 2-ethyl-4-methyl- | **Method G** |
| 1,4-pentanediol, 3-ethyl-2-methyl- | **Method F** |
| 1,4-pentanediol, 3-ethyl-3-methyl- | **Method F** |
| 1,5-pentanediol, 2-ethyl-2-methyl- | **Method F** |
| 1,5-pentanediol, 2-ethyl-3-methyl- | 54886-83-8 |
| 1,5-pentanediol, 2-ethyl-4-methyl- | **Method F** |
| 1,5-pentanediol, 3-ethyl-3-methyl- | 57740-12-2 |
| 2,4-pentanediol, 3-ethyl-2-methyl- | **Method G** |
| More Preferred Isomers | |
| **1,3-pentanediol, 2-ethyl-2-methyl-** | **Method C** |
| **1,3-pentanediol, 2-ethyl-3-methyl-** | **Method D** |
| **1,3-pentanediol, 2-ethyl-4-methyl-** | 148904-97-6 |
| **1,3-pentanediol, 3-ethyl-2-methyl-** | 55661-05-7 |
| **1.4-pentanediol, 2-ethyl-2-methyl-** | **Method H** |
| **1,4-pentanediol, 2-ethyl-3-methyl-** | **Method F** |
| **1.4-pentanediol, 2-ethyl-4-methyl-** | **Method G** |
| **1,5-pentanediol, 3-ethyl-3-methyl-** | 57740-12-2 |
| **2,4-pentanediol, 3-ethyl-2-methyl-** | **Method G** |
| Inoperable Isomers | |
| 1,2-pentanediol, 2-ethyl-3-methyl- | |
| 1,2-pentanediol, 2-ethyl-4-methyl- | |
| 1,2-pentanediol, 3-ethyl-2-methyl- | |
| 1,2-pentanediol, 3-ethyl-3-methyl- | |
| 1,2-pentanediol, 3-ethyl-4-methyl- | |
| 1,3-pentanediol, 3-ethyl-4-methyl- | |
| 1,4-pentanediol, 3-ethyl-4-methyl- | |
| 1,5-pentanediol, 3-ethyl-2-methyl- | |
| 2,3-pentanediol, 3-ethyl-2-methyl- | |
| 2,3-pentanediol, 3-ethyl-4-methyl- | |
| 2,4-pentanediol, 3-ethyl-3-methyl- | |
| PROPYLPENTANEDIOL ISOMERS | |
| Operable Isomers | |
| 1,3-pentanediol, 2-isopropyl- | **Method D** |
| 1,3-pentanediol, 2-propyl- | **Method C** |
| 1,4-pentanediol, 2-isopropyl | **Method H** |
| 1,4-pentanediol, 2-propyl | **Method H** |
| 1,4-pentanediol, 3-isopropyl- | **Method H** |
| 1,5-pentanediol, 2-isopropyl- | 90951-89-6 |
| 2,4-pentanediol, 3-propyl- | **Method C** |
| More Preferred Isomers | |
| **1,3-pentanediol, 2-isopropyl-** | **Method D** |
| **1,3-pentanediol, 2-propyl-** | **Method C** |
| **1,4-pentanediol, 2-isopropyl** | **Method H** |
| **1,4-pentanediol, 3-isopropyl-** | **Method H** |
| **2,4-pentanediol, 3-propyl-** | **Method C** |

TABLE IV-continued

OCTANEDIOL ISOMERS

| Chemical Name | CAS No. |
|---|---|
| Inoperable Isomers | |
| 1,2-pentanediol, 2-propyl- | |
| 1,2-pentanediol, 2-isopropyl- | |
| 1,4-pentanediol, 3-propyl- | |
| 1,5-pentanediol, 2-propyl- | |
| 2,4-pentanediol, 3-isopropyl- | |
| DIMETHYLHEXANEDIOL ISOMERS | |
| Operable Isomers | |
| 1,3-hexanediol, 2,2-dimethyl- | 22006-96-8 |
| 1,3-hexanediol, 2,3-dimethyl- | **Method D** |
| 1,3-hexanediol, 2,4-dimethyl- | 78122-99-3 |
| 1,3-hexanediol, 2,5-dimethyl- | **Method C** |
| 1,3-hexanediol, 3,4-dimethyl- | **Method D** |
| 1,3-hexanediol, 3,5-dimethyl- | **Method D** |
| 1,3-hexanediol, 4,4-dimethyl- | **Method C** |
| 1,3-hexanediol, 4,5-dimethyl- | **Method C** |
| 1,4-hexanediol, 2,2-dimethyl- | **Method F** |
| 1,4-hexanediol, 2,3-dimethyl- | **Method F** |
| 1,4-hexanediol, 2,4-dimethyl- | **Method G** |
| 1,4-hexanediol, 2,5-dimethyl- | 22417-60-3 |
| 1,4-hexanediol, 3,3-dimethyl- | **Method F** |
| 1,4-hexanediol, 3,4-dimethyl- | **Method E** |
| 1,4-hexanediol, 3,5-dimethyl- | **Method H** |
| 1,4-hexanediol, 4,5-dimethyl- | **Method E** |
| 1,4-hexanediol, 5,5-dimethyl- | 38624-38-3 |
| 1,5-hexanediol, 2,2-dimethyl- | **Method A** |
| 1,5-hexanediol, 2,3-dimethyl- | 62718-05-2 |
| 1,5-hexanediol, 2,4-dimethyl- | 73455-82-0 |
| 1,5-hexanediol, 2,5-dimethyl- | 58510-28-4 |
| 1,5-hexanediol, 3,3-dimethyl- | 41736-99-6 |
| 1,5-hexanediol, 3,4-dimethyl- | **Method A** |
| 1,5-hexanediol, 3,5-dimethyl- | **Method G** |
| 1,5-hexanediol, 4,5-dimethyl- | **Method F** |
| 1,6-hexanediol, 2,2-dimethyl- | 13622-91-8 |
| 1,6-hexanediol, 2,3-dimethyl- | **Method F** |
| 1,6-hexanediol, 2,4-dimethyl- | **Method F** |
| 1,6-hexanediol, 2,5-dimethyl- | 49623-11-2 |
| 1,6-hexanediol, 3,3-dimethyl- | **Method F** |
| 1,6-hexanediol, 3,4-dimethyl- | 65363-45-3 |
| 2,4-hexanediol, 2,3-dimethyl- | 26344-17-2 |
| 2,4-hexanediol, 2,4-dimethyl- | 29649-22-7 |
| 2,4-hexanediol, 2,5-dimethyl- | 3899-89-6 |
| 2,4-hexanediol, 3,3-dimethyl- | 42412-51-1 |
| 2,4-hexanediol, 3,4-dimethyl- | 90951-83-0 |
| 2,4-hexanediol, 3,5-dimethyl- | 159300-34-2 |
| 2,4-hexanediol, 4,5-dimethyl- | **Method D** |
| 2,4-hexanediol, 5,5-dimethyl- | 108595-10-8 |
| 2,5-hexanediol, 2,3-dimethyl- | **Method G** |
| 2,5-hexanediol, 2,4-dimethyl- | **Method G** |
| 2,5-hexanediol, 2,5-dimethyl- | 110-03-2 |
| 2,5-hexanediol, 3,3-dimethyl- | **Method H** |
| 2,5-hexanediol, 3,4-dimethyl- | 99799-30-1 |
| 2,6-hexanediol, 3,3-dimethyl- | **Method A** |
| More Preferred Isomers | |
| 1,3-hexanediol, 2,2-dimethyl- | 22006-96-8 |
| 1,3-hexanediol, 2,3-dimethyl- | **Method D** |
| 1,3-hexanediol, 2,4-dimethyl- | 78122-99-3 |
| 1,3-hexanediol, 2,5-dimethyl- | **Method C** |
| 1,3-hexanediol, 3,4-dimethyl- | **Method D** |
| 1,3-hexanediol, 3,5-dimethyl- | **Method D** |
| 1,3-hexanediol, 4,4-dimethyl- | **Method C** |
| 1,3-hexanediol, 4,5-dimethyl- | **Method C** |
| 1,4-hexanediol, 2,2-dimethyl- | **Method H** |
| 1,4-hexanediol, 2,3-dimethyl- | **Method F** |
| 1,4-hexanediol, 2,4-dimethyl- | **Method G** |
| 1,4-hexanediol, 2,5-dimethyl- | 22417-60-3 |
| 1,4-hexanediol, 3,3-dimethyl- | **Method F** |
| 1,4-hexanediol, 3,4-dimethyl- | **Method E** |
| 1,4-hexanediol, 3,5-dimethyl- | **Method H** |
| 1,4-hexanediol, 4,5-dimethyl- | **Method E** |
| 1,4-hexanediol, 5,5-dimethyl- | 38624-38-3 |

TABLE IV-continued

| OCTANEDIOL ISOMERS | |
|---|---|
| Chemical Name | CAS No. |
| 1,5-hexanediol, 2,2-dimethyl- | **Method A** |
| 1,5-hexanediol, 2,3-dimethyl- | 62718-05-2 |
| 1,5-hexanediol, 2,4-dimethyl- | 73455-82-0 |
| 1,5-hexanediol, 2,5-dimethyl- | 58510-28-4 |
| 1,5-hexanediol, 3,3-dimethyl- | 41736-99-6 |
| 1,5-hexanediol, 3,4-dimethyl- | **Method A** |
| 1,5-hexanediol, 3,5-dimethyl- | **Method G** |
| 1,5-hexanediol, 4,5-dimethyl- | **Method F** |
| 2,6-hexanediol, 3,3-dimethyl- | **Method A** |
| Inoperable Isomers | |
| 1,2-hexanediol, 2,3-dimethyl- | |
| 1,2-hexanediol, 2,4-dimethyl- | |
| 1,2-hexanediol, 2,5-dimethyl- | |
| 1,2-hexanediol, 3,3-dimethyl- | |
| 1,2-hexanediol, 3,4-dimethyl- | |
| 1,2-hexanediol, 3,5-dimethyl- | |
| 1,2-hexanediol, 4,4-dimethyl- | |
| 1,2-hexanediol, 4,5-dimethyl- | |
| 1,2-hexanediol, 5,5-dimethyl- | |
| 2,3-hexanediol, 2,3-dimethyl- | |
| 2,3-hexanediol, 2,4-dimethyl- | |
| 2,3-hexanediol, 2,5-dimethyl- | |
| 2,3-hexanediol, 3,4-dimethyl- | |
| 2,3-hexanediol, 3,5-dimethyl- | |
| 2,3-hexanediol, 4,4-dimethyl- | |
| 2,3-hexanediol, 4,5-dimethyl- | |
| 2,3-hexanediol, 5,5-dimethyl- | |
| 3,4-hexanediol, 2,2-dimethyl- | |
| 3,4-hexanediol, 2,3-dimethyl- | |
| 3,4-hexanediol, 2,4-dimethyl- | |
| 3,4-hexanediol, 2,5-dimethyl- | |
| 3,4-hexanediol, 3,4-dimethyl- | |
| ETHYLHEXANEDIOL ISOMERS | |
| More Preferred Isomers | |
| **1,3-hexanediol, 2-ethyl-** | 94-96-2 |
| **1,3-hexanediol, 4-ethyl-** | **Method C** |
| **1,4-hexanediol, 2-ethyl-** | 148904-97-6 |
| **1,4-hexanediol, 4-ethyl-** | 1113-00-4 |
| **1,5-hexanediol, 2-ethyl-** | 58374-34-8 |
| **2,4-hexanediol, 3-ethyl-** | **Method C** |
| **2,4-hexanediol, 4-ethyl-** | 33683-47-5 |
| **2,5-hexanediol, 3-ethyl-** | **Method F** |
| Inoperable Isomers | |
| 1,5-hexanediol, 4-ethyl- | |
| 1,6-hexanediol, 2-ethyl- | |
| 1,4-hexanediol, 3-ethyl- | |
| 1,5-hexanediol, 3-ethyl- | |
| 1,6-hexanediol, 3-ethyl- | |
| 1,2-hexanediol, 2-ethyl- | |
| 1,2-hexanediol, 3-ethyl- | |
| 1,2-hexanediol, 4-ethyl- | |
| 2,3-hexanediol, 3-ethyl- | |
| 2,3-hexanediol, 4-ethyl- | |
| 3,4-hexanediol, 3-ethyl- | |
| 1,3-hexanediol, 3-ethyl- | |
| METHYLHEPTANEDIOL ISOMERS | |
| Operable Isomers | |
| 1,3-heptanediol, 2-methyl- | 109417-38-1 |
| 1,3-heptanediol, 3-methyl- | 165327-88-5 |
| 1,3-heptanediol, 4-methyl- | **Method C** |
| 1,3-heptanediol, 5-methyl- | **Method D** |
| 1,3-heptanediol, 6-methyl- | **Method C** |
| 1,4-heptanediol, 2-methyl- | 15966-03-7 |
| 1,4-heptanediol, 3-methyl- | 7748-38-1 |
| 1,4-heptanediol, 4-methyl- | 72473-94-0 |
| 1,4-heptanediol, 5-methyl- | 63003-04-3 |
| 1,4-heptanediol, 6-methyl- | 99799-25-4 |
| 1,5-heptanediol, 2-methyl- | 141605-00-7 |
| 1,5-heptanediol, 3-methyl- | **Method A** |

TABLE IV-continued

| OCTANEDIOL ISOMERS | |
|---|---|
| Chemical Name | CAS No. |
| 1,5-heptanediol, 4-methyl- | **Method A** |
| 1,5-heptanediol, 5-methyl- | 99799-26-5 |
| 1,5-heptanediol, 6-methyl- | 57740-00-8 |
| 1,6-heptanediol, 2-methyl- | 132148-22-2 |
| 1,6-heptanediol, 3-methyl- | **Method G** |
| 1,6-heptanediol, 4-methyl- | 156307-84-5 |
| 1,6-heptanediol, 5-methyl- | **Method A** |
| 1,6-heptanediol, 6-methyl- | 5392-57-4 |
| 2,4-heptanediol, 2-methyl- | 38836-26-9 |
| 2,4-heptanediol, 3-methyl- | 6964-04-1 |
| 2,4-heptanediol, 4-methyl- | 165326-87-4 |
| 2,4-heptanediol, 5-methyl- | **Method C** |
| 2,4-heptanediol, 6-methyl- | 79356-95-9 |
| 2,5-heptanediol, 2-methyl- | 141605-02-9 |
| 2,5-heptanediol, 3-methyl- | **Method G** |
| 2,5-heptanediol, 4-methyl- | 156407-38-4 |
| 2,5-heptanediol, 5-methyl- | 148843-72-5 |
| 2,5-heptanediol, 6-methyl- | 51916-46-2 |
| 2,6-heptanediol, 2-methyl- | 73304-48-0 |
| 2,6-heptanediol, 3-methyl- | 29915-96-6 |
| 2,6-heptanediol, 4-methyl- | 106257-69-6 |
| 3,4-heptanediol, 3-methyl- | 18938-50-6 |
| 3,5-heptanediol, 2-methyl- | **Method C** |
| 3,5-heptanediol, 3-methyl- | 99799-27-6 |
| 3,5-heptanediol, 4-methyl- | 156407-37-3 |
| More Preferred Isomers | |
| **1,3-heptanediol, 2-methyl-** | 109417-38-1 |
| **1,3-heptanediol, 3-methyl-** | 165327-88-5 |
| **1,3-heptanediol, 4-methyl-** | **Method C** |
| **1,3-heptanediol, 5-methyl-** | **Method D** |
| **1,3-heptanediol, 6-methyl-** | **Method C** |
| **1,4-heptanediol, 2-methyl-** | 15966-03-7 |
| **1,4-heptanediol, 3-methyl-** | 7748-38-1 |
| **1,4-heptanediol, 4-methyl-** | 72473-94-0 |
| **1,4-heptanediol, 5-methyl-** | 63003-04-3 |
| **1,4-heptanediol, 6-methyl-** | 99799-25-4 |
| **1,5-heptanediol, 2-methyl-** | 141605-00-7 |
| **1,5-heptanediol, 3-methyl-** | **Method A** |
| **1,5-heptanediol, 4-methyl-** | **Method A** |
| **1,5-heptanediol, 5-methyl-** | 99799-26-5 |
| **1,5-heptanediol, 6-methyl-** | 57740-00-8 |
| **1,6-heptanediol, 2-methyl-** | 132148-22-2 |
| **1,6-heptanediol, 3-methyl-** | **Method G** |
| **1,6-heptanediol, 4-methyl-** | 156307-84-5 |
| **1,6-heptanediol, 5-methyl-** | **Method A** |
| **1,6-heptanediol, 6-methyl-** | 5392-57-4 |
| **2,4-heptanediol, 2-methyl-** | 38836-26-9 |
| **2,4-heptanediol, 3-methyl-** | 6964-04-1 |
| **2,4-heptanediol, 4-methyl-** | 165326-87-4 |
| **2,4-heptanediol, 5-methyl-** | **Method C** |
| **2,4-heptanediol, 6-methyl-** | 79356-95-9 |
| **2,5-heptanediol, 2-methyl-** | 141605-02-9 |
| **2,5-heptanediol, 3-methyl-** | **Method H** |
| **2,5-heptanediol, 4-methyl-** | 156407-38-4 |
| **2,5-heptanediol, 5-methyl-** | 148843-72-5 |
| **2,5-heptanediol, 6-methyl-** | 51916-46-2 |
| **2,6-heptanediol, 2-methyl-** | 73304-48-0 |
| **2,6-heptanediol, 3-methyl-** | 29915-96-6 |
| **2,6-heptanediol, 4-methyl-** | 106257-69-6 |
| **3,4-heptanediol, 3-methyl-** | 18938-50-6 |
| **3,5-heptanediol, 2-methyl-** | **Method C** |
| **3,5-heptanediol, 4-methyl-** | 156407-37-3 |
| Inoperable Isomers | |
| 1,7-heptanediol, 2-methyl- | |
| 1,7-heptanediol, 3-methyl- | |
| 1,7-heptanediol, 4-methyl- | |
| 2,3-heptanediol, 2-methyl- | |
| 2,3-heptanediol, 3-methyl- | |
| 2,3-heptanediol, 4-methyl- | |
| 2,3-heptanediol, 5-methyl- | |
| 2,3-heptanediol, 6-methyl- | |
| 3,4-heptanediol, 2-methyl- | |
| 3,4-heptanediol, 4-methyl- | |

TABLE IV-continued

| OCTANEDIOL ISOMERS | |
|---|---|
| Chemical Name | CAS No. |
| 3,4-heptanediol, 5-methyl- | |
| 3,4-heptanediol, 6-methyl- | |
| 1,2-heptanediol, 2-methyl- | |
| 1,2-heptanediol, 3-methyl- | |
| 1,2-heptanediol, 4-methyl- | |
| 1,2-heptanediol, 5-methyl- | |
| 1,2-heptanediol, 6-methyl- | |
| OCTANEDIOL ISOMERS | |
| More Preferred Isomers | |
| **2,4-octanediol** | 90126-24-6 |
| **2,5-octanediol** | 4527-78-0 |
| **2,6-octanediol** | Method A |
| **2,7-octanediol** | 19686-96-5 |
| **3,5-octanediol** | 248929-55-5 |
| **3,6-octanediol** | 24434-09-1 |
| Inoperable Isomers | |
| 1,2-octanediol | 1117-86-8 |
| 1,3-octanediol | 23433-05-8 |
| 1,4-octanediol | 51916-47-3 |
| 1,5-octanediol | 2736-67-6 |
| 1,6-octanediol | 4060-76-6 |
| 1,7-octanediol | 13175-32-1 |
| 1,8-octanediol | 629-41-4 |
| 2,3-octanediol | e.g., 98363-24-5 |
| 3,4-octanediol | e.g., 99799-31-2 |
| 3,5-octanediol | e.g., 129025-63-4 |

TABLE V

| NONANEDIOL ISOMERS | |
|---|---|
| Chemical Name | CAS No. |
| Preferred Isomers | |
| 2,4-pentanediol, 2,3,3,4-tetramethyl- | 19424-43-2 |
| Operable Isomers | |
| 2,4-pentanediol, 3-tertiarybutyl- | 142205-14-9 |
| 2,4-hexanediol, 2,5,5-trimethyl- | 97460-08-7 |
| 2,4-hexanediol, 3,3,4-trimethyl- | Method D |
| 2,4-hexanediol, 3,3,5-trimethyl- | 27122-58-3 |
| 2,4-hexanediol, 3,5,5-trimethyl- | Method D |
| 2,4-hexanediol, 4,5,5-trimethyl- | Method D |
| 2,5-hexanediol, 3,3,4-trimethyl- | Method H |
| 2,5-hexanediol, 3,3,5-trimethyl- | Method G |
| Inoperable Isomers | |
| There are over 500 inoperable isomers including the following: | |
| 2,4-hexanediol, 2,4,5-trimethyl- | 36587-81-2 |
| 2,4-hexanediol, 2,3,5-trimethyl-, erythro- | 26344-20-7 |
| 2,4-hexanediol, 2,3,5-trimethyl-, threo- | 26343-49-7 |
| 1,3-propanediol, 2-butyl-2-ethyl- | 115-84-4 |
| 2,4-hexanediol, 2,3,5-trimethyl-, threo- | 26343-49-7 |

TABLE VI

| ALKYL GLYCERYL ETHERS, DI(HYDROXYALKYL) ETHERS, AND ARYL GLYCERYL ETHERS | |
|---|---|
| Preferred Monoglycerol Ethers and Derivatives | |
| 1,2-propanediol, 3-(butyloxy)-, triethoxylated | |
| 1,2-propanediol, 3-(butyloxy)-, tetraethoxylated | |

TABLE VI-continued

| ALKYL GLYCERYL ETHERS, DI(HYDROXYALKYL) ETHERS, AND ARYL GLYCERYL ETHERS | |
|---|---|
| More Preferred Monoglycerol Ethers and Derivatives | CAS No. |
| 1,2-propanediol, 3-(n-pentyloxy)- | 22636-32-4 |
| 1,2-propanediol, 3-(2-pentyloxy)- | |
| 1,2-propanediol, 3-(3-pentyloxy)- | |
| 1,2-propanediol, 3-(2-methyl-1-butyloxy)- | |
| 1,2-propanediol, 3-(iso-amyloxy)- | |
| 1,2-propanediol, 3-(3-methyl-2-butyloxy)- | |
| 1,2-propanediol, 3-(cyclohexyloxy)- | |
| 1,2-propanediol, 3-(1-cyclohex-1-enyloxy)- | |
| 1,3-propanediol, 2-(pentyloxy)- | |
| 1,3-propanediol, 2-(2-pentyloxy)- | |
| 1,3-propanediol, 2-(3-pentyloxy)- | |
| 1,3-propanediol, 2-(2-methyl-1-butyloxy)- | |
| 1,3-propanediol, 2-(iso-amyloxy)- | |
| 1,3-propanediol, 2-(3-methyl-2-butyloxy)- | |
| 1,3-propanediol, 2-(cyclohexyloxy)- | |
| 1,3-propanediol, 2-(1-cyclohex-1-enyloxy)- | |
| 1,2-propanediol, 3-(butyloxy)-, pentaethoxylated | |
| 1,2-propanediol, 3-(butyloxy)-, hexaethoxylated | |
| 1,2-propanediol, 3-(butyloxy)-, heptaethoxylated | |
| 1,2-propanediol, 3-(butyloxy)-, octaethoxylated | |
| 1,2-propanediol, 3-(butyloxy)-, nonaethoxylated | |
| 1,2-propanediol, 3-(butyloxy)-, monopropoxylated | |
| 1,2-propanediol, 3-(butyloxy)-, dibutyleneoxylated | |
| 1,2-propanediol, 3-(butyloxy)-, tributyleneoxylated | |
| More Preferred Di(hydroxyalkyl) Ethers | |
| bis(2-hydroxybutyl) ether | |
| bis(2-hydroxycyclopentyl) ether | |
| Inoperable Monoglycerol Ethers | |
| 1,2-propanediol, 3-ethyloxy- | |
| 1,2-propanediol, 3-propyloxy- | |
| 1,2-propanediol, 3-isopropyloxy- | |
| 1,2-propanediol, 3-butyloxy- | |
| 1,2-propanediol, 3-isobutyloxy- | |
| 1,2-propanediol, 3-tert-butyloxy- | |
| 1,2-propanediol, 3-octyloxy- | |
| 1,2-propanediol, 3-(2-ethylhexyloxy)- | |
| 1,2-propanediol, 3-(cyclopentyloxy)- | |
| 1,2-propanediol, 3-(1-cyclohex-2-enyloxy)- | |
| 1,3-propanediol, 2-(1-cyclohex-2-enyloxy)- | |
| AROMATIC GLYCERYL ETHERS | |
| Operable Aromatic Glyceryl Ethers | |
| 1,2-propanediol, 3-phenyloxy- | |
| 1,2-propanediol, 3-benzyloxy- | |
| 1,2-propanediol, 3-(2-phenylethyloxy)- | |
| 1,2-propanediol, 3-(1-phenyl-2-propanyloxy)- | |
| 1,3-propanediol, 2-phenyloxy- | |
| 1,3-propanediol, 2-(m-cresyloxy)- | |
| 1,3-propanediol, 2-(p-cresyloxy)- | |
| 1,3-propanediol, 2-benzyloxy- | |
| 1,3-propanediol, 2-(2-phenylethyloxy)- | |
| 1,3-propanediol, 2-(1-phenylethyloxy)- | |
| Preferred Aromatic Glyceryl Ethers | |
| 1,2-propanediol, 3-phenyloxy- | |
| 1,2-propanediol, 3-benzyloxy- | |
| 1,2-propanediol, 3-(2-phenylethyloxy)- | |
| 1,3-propanediol, 2-(m-cresyloxy)- | |
| 1,3-propanediol, 2-(p-cresyloxy)- | |
| 1,3-propanediol, 2-benzyloxy- | |
| 1,3-propanediol, 2-(2-phenylethyloxy)- | |
| Preferred Aromatic Glyceryl Ethers | |
| 1,2-propanediol, 3-phenyloxy- | |
| 1,2-propanediol, 3-benzyloxy- | |
| 1,2-propanediol, 3-(2-phenylethyloxy)- | |
| 1,3-propanediol, 2-(m-cresyloxy)- | |
| 1,3-propanediol, 2-(p-cresyloxy)- | |
| 1,3-propanediol, 2-(2-phenylethyloxy)- | |

TABLE VII

ALICYCLIC DIOLS AND DERIVATIVES

| Chemical Name | CAS No. |
|---|---|
| Preferred Cylic Diols and Derivatives | |
| 1-isopropyl-1,2-cyclobutanediol | 59895-32-8 |
| 3-ethyl-4-methyl-1,2-cyclobutanediol | |
| 3-propyl-1,2-cyclobutanediol | |
| 3-isopropyl-1,2-cyclobutanediol | 42113-90-6 |
| 1-ethyl-1,2-cyclopentanediol | 67396-17-2 |
| 1,2-dimethyl-1,2-cyclopentanediol | 33046-20-7 |
| 1,4-dimethyl-1,2-cyclopentanediol | 89794-56-9 |
| 2,4,5-trimethyl-1,3-cyclopentanediol | |
| 3,3-dimethyl-1,2-cyclopentanediol | 89794-57-0 |
| 3,4-dimethyl-1,2-cyclopentanediol | 70051-69-3 |
| 3,5-dimethyl-1,2-cyclopentanediol | 89794-58-1 |
| 3-ethyl-1,2-cyclopentanediol | |
| 4,4-dimethyl-1,2-cyclopentanediol | 70197-54-5 |
| 4-ethyl-1,2-cyclopentanediol | |
| 1,1-bis(hydroxymethyl)cyclohexane | 2658-60-8 |
| 1,2-bis(hydroxymethyl)cyclohexane | 76155-27-6 |
| 1,2-dimethyl-1,3-cyclohexanediol | 53023-07-7 |
| 1,3-bis(hydroxymethyl)cyclohexane | 13022-98-5 |
| 1,3-dimethyl-1,3-cyclohexanediol | 128749-93-9 |
| 1,6-dimethyl-1,3-cyclohexanediol | 164713-16-0 |
| 1-hydroxy-cyclohexaneethanol | 40894-17-5 |
| 1-hydroxy-cyclohexanemethanol | 15753-47-6 |
| 1-ethyl-1,3-cyclohexanediol | 10601-18-0 |
| 1-methyl-1,2-cyclohexanediol | 52718-65-7 |
| 2,2-dimethyl-1,3-cyclohexanediol | 114693-83-3 |
| 2,3-dimethyl-1,4-cyclohexanediol | 70156-82-0 |
| 2,4-dimethyl-1,3-cyclohexanediol | |
| 2,5-dimethyl-1,3-cyclohexanediol | |
| 2,6-dimethyl-1,4-cyclohexanediol | 34958-42-4 |
| 2-ethyl-1,3-cyclohexanediol | 155433-88-8 |
| 2-hydroxycyclohexaneethanol | 24682-42-6 |
| 2-hydroxyethyl-1-cyclohexanol | |
| 2-hydroxymethylcyclohexanol | 89794-52-5 |
| 3-hydroxyethyl-1-cyclohexanol | |
| 3-hydroxycyclohexaneethanol | 86576-87-6 |
| 3-hydroxymethylcyclohexanol | |
| 3-methyl-1,2-cyclohexanediol | 23477-91-0 |
| 4,4-dimethyl-1,3-cyclohexanediol | 14203-50-0 |
| 4,5-dimethyl-1,3-cyclohexanediol | |
| 4,6-dimethyl-1,3-cyclohexanediol | 16066-66-3 |
| 4-ethyl-1,3-cyclohexanediol | |
| 4-hydroxyethyl-1-cyclohexanol | |
| 4-hydroxymethylcyclohexanol | 33893-85-5 |
| 4-methyl-1,2-cyclohexanediol | 23832-27-1 |
| 5,5-dimethyl-1,3-cyclohexanediol | 51335-83-2 |
| 5-ethyl-1,3-cyclohexanediol | |
| 1,2-cycloheptanediol | 108268-28-6 |
| 2-methyl-1,3-cycloheptanediol | 101375-80-8 |
| 2-methyl-1,4-cycloheptanediol | |
| 4-methyl-1,3-cycloheptanediol | |
| 5-methyl-1,3-cycloheptanediol | |
| 5-methyl-1,4-cycloheptanediol | 90201-00-6 |
| 6-methyl-1,4-cycloheptanediol | |
| 1,3-cyclooctanediol | 101935-36-8 |
| 1,4-cyclooctanediol | 73982-04-4 |
| 1,5-cyclooctanediol | 23418-82-8 |
| 1,2-cyclohexanediol, diethoxylate | |
| 1,2-cyclohexanediol, triethoxylate | |
| 1,2-cyclohexanediol, tetraethoxylate | |
| 1,2-cyclohexanediol, pentaethoxylate | |
| 1,2-cyclohexanediol, hexaethoxylate | |
| 1,2-cyclohexanediol, heptaethoxylate | |
| 1,2-cyclohexanediol, octaethoxylate | |
| 1,2-cyclohexanediol, nonaethoxylate | |
| 1,2-cyclohexanediol, monopropoxylate | |
| 1,2-cyclohexanediol, monobutylenoxylate | |
| 1,2-cyclohexanediol, dibutylenoxylate | |
| 1,2-cyclohexanediol, tributylenoxylate | |
| More Preferred Cylic Diols and Derivatives | |
| 1-isopropyl-1,2-cyclobutanediol | 59895-32-8 |
| 3-ethyl-4-methyl-1,2-cyclobutanediol | |
| 3-propyl-1,2-cyclobutanediol | |

TABLE VII-continued

ALICYCLIC DIOLS AND DERIVATIVES

| Chemical Name | CAS No. |
|---|---|
| 3-isopropyl-1,2-cyclobutanediol | 42113-90-6 |
| 1-ethyl-1,2-cyclopentanediol | 67396-17-2 |
| 1,2-dimethyl-1,2-cyclopentanediol | 33046-20-7 |
| 1,4-dimethyl-1,2-cyclopentanediol | 89794-56-9 |
| 3,3-dimethyl-1,2-cyclopentanediol | 89794-57-0 |
| 3,4-dimethyl-1,2-cyclopentanediol | 70051-69-3 |
| 3,5-dimethyl-1,2-cyclopentanediol | 89794-58-1 |
| 3-ethyl-1,2-cyclopentanediol | |
| 4,4-dimethyl-1,2-cyclopentanediol | 70197-54-5 |
| 4-ethyl-1,2-cyclopentanediol | |
| 1,1-bis(hydroxymethyl)cyclohexane | 2658-60-8 |
| 1,2-bis(hydroxymethyl)cyclohexane | 76155-27-6 |
| 1,2-dimethyl-1,3-cyclohexanediol | 53023-07-7 |
| 1,3-bis(hydroxymethyl)cyclohexane | 13022-98-5 |
| 1-hydroxy-cyclohexanemethanol | 15753-47-6 |
| 1-methyl-1,2-cyclohexanediol | 52718-65-7 |
| 3-hydroxymethylcyclohexanol | |
| 3-methyl-1,2-cyclohexanediol | 23477-91-0 |
| 4,4-dimethyl-1,3-cyclohexanediol | 14203-50-0 |
| 4,5-dimethyl-1,3-cyclohexanediol | |
| 4,6-dimethyl-1,3-cyclohexanediol | 16066-66-3 |
| 4-ethyl-1,3-cyclohexanediol | |
| 4-hydroxyethyl-1-cyclohexanol | |
| 4-hydroxymethylcyclohexanol | 33893-85-5 |
| 4-methyl-1,2-cyclohexanediol | 23832-27-1 |
| 1,2-cycloheptanediol | 108268-28-6 |
| 1,2-cyclohexanediol, pentaethoxylate | |
| 1,2-cyclohexanediol, hexaethoxylate | |
| 1,2-cyclohexanediol, heptaethoxylate | |
| 1,2-cyclohexanediol, octaethoxylate | |
| 1,2-cyclohexanediol, nonaethoxylate | |
| 1,2-cyclohexanediol, monopropoxylate | |
| 1,2-cyclohexanediol, dibutylenoxylate | |
| The unsaturated alicyclic diols include the following known unsaturated alicyclic diols: | |
| Operable Unsaturated Alicyclic Diols | |
| 1,2-Cyclobutanediol, 1-ethenyl-2-ethyl- | 58016-14-1 |
| 3-Cyclobutene-1,2-diol, 1,2,3,4-tetramethyl- | 90112-64-4 |
| 3-Cyclobutene-1,2-diol, 3,4-diethyl- | 142543-60-0 |
| 3-Cyclobutene-1,2-diol, 3-(1,1-dimethylethyl)- | 142543-56-4 |
| 3-Cyclobutene-1,2-diol, 3-butyl- | 142543-55-3 |
| 1,2-Cyclopentanediol, 1,2-dimethyl-4-methylene- | 103150-02-3 |
| 1,2-Cyclopentanediol, 1-ethyl-3-methylene- | 90314-52-6 |
| 1,2-Cyclopentanediol, 4-(1-propenyl) | 128173-45-5 |
| 3-Cyclopentene-1,2-diol, 1-ethyl-3-methyl- | 90314-43-5 |
| 1,2-Cyclohexanediol, 1-ethenyl- | 134134-16-0 |
| 1,2-Cyclohexanediol, 1-methyl-3-methylene- | 98204-78-5 |
| 1,2-Cyclohexanediol, 1-methyl-4-methylene- | 133358-53-9 |
| 1,2-Cyclohexanediol, 3-ethenyl- | 55310-51-5 |
| 1,2-Cyclohexanediol, 4-ethenyl- | 85905-16-4 |
| 3-Cyclohexene-1,2-diol, 2,6-dimethyl- | 81969-75-7 |
| 3-Cyclohexene-1,2-diol, 6,6-dimethyl- | 61875-93-2 |
| 4-Cyclohexene-1,2-diol, 3,6-dimethyl- | 156808-73-0 |
| 4-Cyclohexene-1,2-diol, 4,5-dimethyl- | 154351-54-9 |
| 3-Cyclooctene-1,2-diol | 170211-27-5 |
| 4-Cyclooctene-1,2-diol | 124791-61-3 |
| 5-Cyclooctene-1,2-diol | 117468-07-2 |
| Inoperable Unsaturated Cyclic Diols | |
| 1,2-Cyclopentanediol, 1-(1-methylethenyl)- | 61447-83-4 |
| 1,2-Propanediol, 1-cyclopentyl- | 55383-20-5 |
| 1,3-Cyclopentanediol, 2-(1-methylethylidene)- | 65651-46-9 |
| 1,3-Propanediol, 2-(1-cyclopenten-1-yl)- | 77192-43-9 |
| 1,3-Propanediol, 2-(2-cyclopenten-1-yl)- | 25462-31-1 |
| 1,2-Ethanediol, 1-(1-cyclohexen-1-yl)- | 151674-61-2 |
| 1,2-Ethanediol, 1-(3-cyclohexen-1-yl) | 64011-53-6 |
| 2-Cyclohexene-1,4-diol, 5,5-dimethyl- | 147274-55-3 |
| 4-Cyclohexene-1,3-diol, 3,6-dimethyl- | 127716-90-9 |
| 1,3-Cycloheptanediol, 2-methylene- | 132292-67-2 |
| 5-Cycloheptene-1,3-diol, 1-methyl- | 160813-33-2 |
| 5-Cycloheptene-1,3-diol, 5-methyl- | 160813-32-1 |
| 2-Cyclooctene-1,4-diol | 37996-40-0 |

TABLE VIII

| $C_3C_7$DIOL ALKOXYLATED DERIVATIVES |
|---|
| In the following tables, "EO" means polyethoxylates, i.e., —$(CH_2CH_2O)_nH$; Me—$E_n$ means methyl-capped polyethoxylates —$(CH_2CH_2O)_nCH_3$; "2(Me—En)" means 2 Me—En groups needed; "PO" means polypropoxylates, —$(CH(CH_3)CH_2O)_nH$; "BO" means polybutyleneoxy groups, $(CH(CH_2CH_3)CH_2O)_nH$; and "n-BO" means poly(n-butyleneoxy) or poly(tetramethylene)oxy groups —$(CH_2CH_2CH_2CH_2O)_nH$. The indicated alkoxylated derivatives are all operable and those that are preferred are in bold type and listed on the second line. Non-limiting, typical synthesis methods to prepare the alkoxylated derivatives are given hereinafter. |

TABLE VIIIA

| Base Material[a] | Base Material CAS No. | EO's (b) | 1 (Me—En) (c) | 2 (Me—En) (d) | PO's (e) | n-BO's (f) | BO's (g) |
|---|---|---|---|---|---|---|---|
| 1,2-propanediol (C3) | 57-55-6 | | | 1–4 | | | |
| | | | | **3–4** | **4** | | |
| 1,2-propanediol, | 558-43-0 | | 4–10 | | | | 1 |
| 2-methyl- (C4) | | | **8–10** | **1** | **3** | | |
| 1,3-propanediol (C3) | 504-63-2 | | | 6–8 | 5–6 | | |
| | | | | **8** | **6** | | |
| 1,3-propanediol, | 115-76-4 | 1–7 | | | | 1–2 | |
| 2,2-diethyl- (C7) | | **4–7** | | | **1** | **2** | |
| 1,3-propanediol, | 126-30-7 | | | | 3–4 | | |
| 2,2-dimethyl- (C5) | | | | **1–2** | **4** | | |
| 1,3-propanediol, 2-(1- | 33673-01-7 | 1–7 | | | | 1–2 | |
| methylpropyl)- (C7) | | **4–7** | | | **1** | **2** | |
| 1,3-propanediol, 2-(2- | 26462-20-8 | 1–7 | | | | 1–2 | |
| methylpropyl)- (C7) | | **4–7** | | | **1** | **2** | |
| 1,3-propanediol, | 2612-29-5 | | 6–10 | | | | |
| 2-ethyl- (C5) | | | **9–10** | **1** | **3** | | |
| 1,3-propanediol, 2- | 77-84-9 | | 1–6 | | | | |
| ethyl-2-methyl- (C6) | | | **3–6** | | **2** | | **1** |
| 1,3-propanediol, | 2612-27-3 | | 1–6 | | | | |
| 2-isopropyl- (C6) | | | **3–6** | | **2** | | **1** |
| 1,3-propanediol, | 2163-42-0 | | | 2–5 | 4–5 | | |
| 2-methyl- (C4) | | | | **4–5** | **5** | | **2** |
| 1,3-propanediol, 2- | 2109-23-1 | 2–9 | | | | 1–3 | |
| methyl-2-isopropyl- | | **6–9** | | | **1** | **2–3** | |
| (C7) | | | | | | | |
| 1,3-propanediol, 2- | 78-26-2 | 1–7 | | | | 1–2 | |
| methyl-2-propyl- (C7) | | **4–7** | | | **1** | **2** | |
| 1,3-propanediol, | 2612-28-4 | | | | | | 1 |
| 2-propyl- (C6) | | | **1–4** | | **2** | | |

[a]The number of indicated alkoxylated groups in this and following Tables VIII are all operable, the generic limits being listed on the first line, and those that are preferred are in bold type and listed on the second line.
[b]The numbers in this column are average numbers of $(CH_2CH_2O)$ groups in the polyethoxylated derivative.
[c]The numbers in this column are average numbers of $(CH_2CH_2O)$ groups in the one methyl-capped polyethoxylate substituant in each derivative.
[d]The numbers in this column are average numbers of $(CH_2CH_2O)$ groups in each of the two methyl-capped polyethoxylate substituants in each derivative.
[e]The numbers in this column are average numbers of $(CH(CH_3)CH_2O)$ groups in the polypropoxylated derivative.
[f]The numbers in this column are average numbers of $(CH_2CH_2CH_2CH_2O)$ groups in the polytetramethyleneoxylated derivative.
[g]The numbers in this column are average numbers of $(CH(CH_2CH_3)CH_2O)$ groups in the polybutoxylated derivative.

TABLE VIIIB

| Base Material[a] | Base Material CAS No. | EO's (b) | 1 (Me—En) (c) | 2 (Me—En) (d) | PO's (e) | n-BO's (f) | BO's (g) |
|---|---|---|---|---|---|---|---|
| 1,2-butanediol (C4) | 584-03-2 | | 2–8 | | | | |
| | | | **6–8** | | **2–3** | | **1** |
| 1,2-butanediol, | 66553-15-9 | 1–6 | | | | 1–2 | |
| 2,3-dimethyl- (C6) | | **2–5** | | | | **1** | |
| 1,2-butanediol, | 66553-16-0 | | | | | | |
| 2-ethyl- (C6) | | **1–3** | | | | **1** | |

TABLE VIIIB-continued

| Base Material[a] | Base Material CAS No. | EO's [b] | 1 (Me—En) [c] | 2 (Me—En) [d] | PO's [e] | n-BO's [f] | BO's [g] |
|---|---|---|---|---|---|---|---|
| 1,2-butanediol, | 41051-72-3 | | | | | | |
| 2-methyl- (C5) | | | **1–2** | | **1** | | |
| 1,2-butanediol, | 59562-82-2 | 1–6 | | | | 1–2 | |
| 3,3-dimethyl- (C6) | | **2–5** | | | | **1** | |
| 1,2-butanediol, | 50468-22-9 | | | | | | |
| 3-methyl- (C5) | | | **1–2** | | **1** | | |
| 1,3-butanediol (C4) | 107-88-0 | | | 3–6 | 5 | | |
| | | | | **5–6** | | | **2** |
| 1,3-butanediol, 2, | 16343-75-2 | | | | 1–2 | | |
| 2,3-trimethyl- (C7) | | | **1–3** | | **2** | | |
| 1,3-butanediol, 2, | 76-35-7 | | 3–8 | | | | |
| 2-dimethyl- (C6) | | | **6–8** | | **3** | | |
| 1,3-butanediol, | 24893-35-4 | | 3–8 | | | | |
| 2,3-dimethyl- (C6) | | | **6–8** | | **3** | | |
| 1,3-butanediol, | 66553-17-1 | | 1–6 | | | | |
| 2-ethyl- (C6) | | | **4–6** | | **2 to 3** | | **1** |
| 1,3-butanediol, 2- | Method C | | | | | 2–4 | |
| ethyl-2-methyl- (C7) | | | **1** | | **1** | **3** | |
| 1,3-butanediol, 2- | 68799-03-1 | | | | | 2–4 | |
| ethyl-3-methyl- (C7) | | | **1** | | **1** | **3** | |
| 1,3-butanediol, | 66567-04-2 | | | | | 2–4 | |
| 2-isopropyl- (C7) | | | **1** | | **1** | **3** | |
| 1,3-butanediol, | 684-84-4 | | | 1–3 | | | |
| 2-methyl- (C5) | | | | **2–3** | **4** | | |
| 1,3-butanediol, | 66567-03-1 | 2–9 | | | | 1–3 | |
| 2-propyl- (C7) | | **6–8** | | | **1** | **2–3** | |
| 1,3-butanediol, | 2568-33-4 | | | 1–3 | | | |
| 3-methyl- (C5) | | | | **2–3** | **4** | | |
| 1,4-butanediol (C4) | 110-63-4 | | | 2–4 | 4–5 | | 2 |
| | | | | **3–4** | **4–5** | | |
| 1,4-butanediol, 2, | 162108-60-3 | 2–9 | | | | 1–3 | |
| 2,3-trimethyl- (C7) | | **6–9** | | | **1** | **2–3** | |
| 1,4-butanediol, | 32812-23-0 | | 1–6 | | | | |
| 2,2-dimethyl- (C6) | | | **3–6** | | **2** | | **1** |
| 1,4-butanediol, | 57716-80-0 | | 1–6 | | | | |
| 2,3-dimethyl- (C6) | | | **3–6** | | **2** | | **1** |
| 1,4-butanediol, | 57716-79-7 | | | | | | 1 |
| 2-ethyl- (C6) | | | **1–4** | | **2** | | |
| 1,4-butanediol, 2- | 76651-98-4 | 1–7 | | | | 1–2 | |
| ethyl-2-methyl- (C7) | | **4–7** | | | **1** | **2** | |
| 1,4-butanediol, 2- | 66225-34-1 | 1–7 | | | | 1–2 | |
| ethyl-3-methyl- (C7) | | **4–7** | | | **1** | **2** | |
| 1,4-butanediol, | 39497-66-0 | 1–7 | | | | 1–2 | |
| 2-isopropyl- (C7) | | **4–7** | | | **1** | **2** | |
| 1,4-butanediol, | 2938-98-9 | | 6–10 | | | | 1 |
| 2-methyl- (C5) | | | **9–10** | **1** | **3** | | |
| 1,4-butanediol, | 62946-68-3 | 1–5 | | | | 1–2 | |
| 2-propyl- (C7) | | **2–5** | | | | **1** | |
| 1,4-butanediol, 3- | Method F | 2–9 | | | | 1–3 | |
| ethyl-1-methyl- (C7) | | **6–8** | | | **1** | **2–3** | |
| 2,3-butanediol (C4) | 513-85-9 | | 6–10 | | | | 1 |
| | | | **9–10** | **1** | **3–4** | | |
| 2,3-butanediol, | 76-09-5 | 3–9 | | | | 1–3 | |
| 2,3-dimethyl- (C6) | | **7–9** | | | **1** | **2–3** | |
| 2,3-butanediol, | 5396-58-7 | | 1–5 | | | | |
| 2-methyl- (C5) | | | **2–5** | | **2** | | **1** |

[a]The number of indicated alkoxylated groups in this Table are all operable, the generic limits being listed on the first line, and those that are preferred are in bold type and listed on the second line.
[b]The numbers in this column are average numbers of ($CH_2CH_2O$) groups in the polyethoxylated derivative.
[c]The numbers in this column are average numbers of ($CH_2CH_2O$) groups in the one methyl-capped polyethoxylate substituant in each derivative.
[d]The numbers in this column are average numbers of ($CH_2CH_2O$) groups in each of the two methyl-capped polyethoxylate substituants in each derivative.
[e]The numbers in this column are average numbers of ($CH(CH_3)CH_2O$) groups in the polypropoxylated derivative.
[f]The numbers in this column are average numbers of ($CH_2CH_2CH_2CH_2O$) groups in the polytetramethyleneoxylated derivative.
[g]The numbers in this column are average numbers of ($CH(CH_2CH_3)CH_2O$) groups in the polybutoxylated derivative.

TABLE VIIIC

| Base Material[a] | Base Material CAS No. | EO's (b) | 1 (Me—En) (c) | 2 (Me—En) (d) | PO's (e) | n-BO's (f) | BO's (g) |
|---|---|---|---|---|---|---|---|
| 1,2-pentanediol | 5343-92-0 | 3–10 | | | | 2–3 | |
| (C5) | | **7–10** | | | **1** | **3** | |
| 1,2-pentanediol, | 20667-05-4 | | | | | | |
| 2-methyl- (C6) | | **1–3** | | | | **1** | |
| 1,2-pentanediol, | 159623-53-7 | | | | | | |
| 3-methyl- (C6) | | **1–3** | | | | **1** | |
| 1,2-pentanediol, | 72110-08-8 | | | | | | |
| 4-methyl- (C6) | | **1–3** | | | | **1** | |
| 1,3-pentanediol | 3174-67-2 | | | | | | |
| (C5) | | | | **1–2** | **3–4** | | |
| 1,3-pentanediol, | 2157-31-5 | | | | | 2–4 | |
| 2,2-dimethyl- (C7) | | | **1** | | **1** | **3** | |
| 1,3-pentanediol, | 66225-52-3 | | | | | 2–4 | |
| 2,3-dimethyl- (C7) | | | **1** | | **1** | **3** | |
| 1,3-pentanediol, | 60712-38-1 | | | | | 2–4 | |
| 2,4-dimethyl- (C7) | | | **1** | | **1** | **3** | |
| 1,3-pentanediol, | 29887-11-4 | 2–9 | | | | 1–3 | |
| 2-ethyl- (C7) | | **6–8** | | | **1** | **2–3** | |
| 1,3-pentanediol, | 149-31-5 | | 1–6 | | | | 1 |
| 2-methyl- (C6) | | | **4–6** | | **2–3** | | |
| 1,3-pentanediol, | 129851-50-9 | | | | | 2–4 | |
| 3,4-dimethyl- (C7) | | | **1** | | **1** | **3** | |
| 1,3-pentanediol, | 33879-72-0 | | 1–6 | | | | 1 |
| 3-methyl- (C6) | | | **4–6** | | **2–3** | | |
| 1,3-pentanediol, | 30458-16-3 | | | | | 2–4 | |
| 4,4-dimethyl- (C7) | | | **1** | | **1** | **3** | |
| 1,3-pentanediol, | 54876-99-2 | | 1–6 | | | | 1 |
| 4-methyl- (C6) | | | **4–6** | | **2–3** | | |
| 1,4-pentanediol | 626-95-9 | | | | | | |
| (C5) | | | | **1–2** | **3–4** | | |
| 1,4-pentanediol, | Method F | | | | | 2–4 | |
| 2,2-dimethyl- (C7) | | | **1** | | **1** | **3** | |
| 1,4-pentanediol, | Method F | | | | | 2–4 | |
| 2,3-dimethyl- (C7) | | | **1** | | **1** | **3** | |
| 1,4-pentanediol, | Method F | | | | | 2–4 | |
| 2,4-dimethyl- (C7) | | | **1** | | **1** | **3** | |
| 1,4-pentanediol, | 6287-17-8 | | 1–6 | | | | 1 |
| 2-methyl- (C6) | | | **4–6** | | **2–3** | | |
| 1,4-pentanediol, | 81887-62-9 | | | | | 2–4 | |
| 3,3-dimethyl- (C7) | | | **1** | | **1** | **3** | |
| 1,4-pentanediol, | 63521-36-8 | | | | | 2–4 | |
| 3,4-dimethyl- (C7) | | | **1** | | **1** | **3** | |
| 1,4-pentanediol, | 26787-63-3 | | 1–6 | | | | 1 |
| 3-methyl- (C6) | | | **4–6** | | **2–3** | | |
| 1,4-pentanediol, | 1462-10-8 | | 1–6 | | | | 1 |
| 4-methyl- (C6) | | | **4–6** | | **2–3** | | |
| 1,5-pentanediol | 111-29-5 | | 4–10 | | | | |
| (C5) | | | **8–10** | **1** | **3** | | |
| 1,5-pentanediol, | 3121-82-2 | 1–7 | | | | 1–2 | |
| 2,2-dimethyl- (C7) | | **4–7** | | | **1** | **2** | |
| 1,5-pentanediol, | 81554-20-3 | 1–7 | | | | 1–2 | |
| 2,3-dimethyl- (C7) | | **4–7** | | | **1** | **2** | |
| 1,5-pentanediol, | 2121-69-9 | 1–7 | | | | 1–2 | |
| 2,4-dimethyl- (C7) | | **4–7** | | | **1** | **2** | |
| 1,5-pentanediol, | 14189-13-0 | 1–5 | | | | 1–2 | |
| 2-ethyl- (C7) | | **2–5** | | | | **1** | |
| 1,5-pentanediol, | 42856-62-2 | | | | | | |
| 2-methyl- (C6) | | | **1–4** | | **2** | | |
| 1,5-pentanediol, | 53120-74-4 | 1–7 | | | | 1–2 | |
| 3,3-dimethyl- (C7) | | **4–7** | | | **1** | **2** | |
| 1,5-pentanediol, | 4457-71-0 | | | | | | |
| 3-methyl- (C6) | | | **1–4** | | **2** | | |
| 2,3-pentanediol | 42027-23-6 | | | | | | |
| (C5) | | | **1–3** | | **2** | | |
| 2,3-pentanediol, | 7795-80-4 | 1–7 | | | | 1–2 | |
| 2-methyl- (C6) | | **4–7** | | | **1** | **2** | |
| 2,3-pentanediol, | 63521-37-9 | 1–7 | | | | 1–2 | |
| 3-methyl- (C6) | | **4–7** | | | **1** | **2** | |
| 2,3-pentanediol, | 7795-79-1 | 1–7 | | | | 1–2 | |
| 4-methyl- (C6) | | **4–7** | | | **1** | **2** | |
| 2,4-pentanediol | 625-69-4 | | | 1–4 | | | |
| (C5) | | | | **2–4** | **4** | | |
| 2,4-pentanediol, | 24893-39-8 | | 1–4 | | | | |
| 2,3-dimethyl- (C7) | | | **2–4** | | **2** | | |

TABLE VIIIC-continued

| Base Material[a] | Base Material CAS No. | EO's (b) | 1 (Me—En) (c) | 2 (Me—En) (d) | PO's (e) | n-BO's (f) | BO's (g) |
|---|---|---|---|---|---|---|---|
| 2,4-pentanediol, | 24892-49-7 | | 1–4 | | | | |
| 2,4-dimethyl- (C7) | | | **2–4** | | **2** | | |
| 2,4-pentanediol, | 107-41-5 | | 5–10 | | | | |
| 2-methyl- (C6) | | | **8–10** | | **3** | | |
| 2,4-pentanediol, | 24892-50-0 | | 1–4 | | | | |
| 3,3-dimethyl- (C7) | | | **2–4** | | **2** | | |
| 2,4-pentanediol, | Method H | | 5–10 | | | | |
| 3-methyl- (C6) | | | **8–10** | | **3** | | |

[a]The number of indicated alkoxylated groups in this Table are all operable, the generic limits being listed on the first line, and those that are preferred are in bold type and listed on the second line.
[b]The numbers in this column are average numbers of ($CH_2CH_2O$) groups in the polyethoxylated derivative.
[c]The numbers in this column are average numbers of ($CH_2CH_2O$) groups in the one methyl-capped polyethoxylate substituant in each derivative.
[d]The numbers in this column are average numbers of ($CH_2CH_2O$) groups in each of the two methyl-capped polyethoxylate substituants in each derivative.
[e]The numbers in this column are average numbers of ($CH(CH_3)CH_2O$) groups in the polypropoxylated derivative.
[f]The numbers in this column are average numbers of ($CH_2CH_2CH_2CH_2O$) groups in the polytetramethyleneoxylated derivative.
[g]The numbers in this column are average numbers of ($CH(CH_2CH_3)CH_2O$) groups in the polybutoxylated derivative.

TABLE VIIID

| Base Material[a] | Base Material CAS No. | EO's (b) | 1 (Me—En) (c) | PO's (e) | n-BO's (f) | BO's (g) |
|---|---|---|---|---|---|---|
| 1,3-hexanediol | 21531-91-9 | | 1–5 | | | |
| (C6) | | | **2–5** | **2** | | **1** |
| 1,3-hexanediol, | 66072-21-7 | 2–9 | | | 1–3 | 1 |
| 2-methyl- (C7) | | **6–8** | | **1** | **2–3** | |
| 1,3-hexanediol, | Method D | 2–9 | | | 1–3 | |
| 3-methyl- (C7) | | **6–8** | | **1** | **2–3** | |
| 1,3-hexanediol, | Method C | 2–9 | | | 1–3 | |
| 4-methyl- (C7) | | **6–8** | | **1** | **2–3** | |
| 1,3-hexanediol, | 109863-14-1 | 2–9 | | | 1–3 | |
| 5-methyl- (C7) | | **6–8** | | **1** | **2–3** | |
| 1,4-hexanediol | 16432-53-4 | | 1–5 | | | |
| (C6) | | | **2–5** | **2** | | **1** |
| 1,4-hexanediol, | Method F | 2–9 | | | 1–3 | |
| 2-methyl- (C7) | | **6–8** | | **1** | **2–3** | |
| 1,4-hexanediol, | 66225-36-3 | 2–9 | | | 1–3 | |
| 3-methyl- (C7) | | **6–8** | | **1** | **2–3** | |
| 1,4-hexanediol, | 40646-08-0 | 2–9 | | | 1–3 | |
| 4-methyl- (C7) | | **6–8** | | **1** | **2–3** | |
| 1,4-hexanediol, | 38624-36-1 | 2–9 | | | 1–3 | |
| 5-methyl- (C7) | | **6–8** | | **1** | **2–3** | |
| 1,5-hexanediol | 928-40-5 | | 1–5 | | | |
| (C6) | | | **2–5** | **2** | | **1** |
| 1,5-hexanediol, | Method F | 2–9 | | | 1–3 | |
| 2-methyl- (C7) | | **6–8** | | **1** | **2–3** | |
| 1,5-hexanediol, | Method F | 2–9 | | | 1–3 | |
| 3-methyl- (C7) | | **6–8** | | **1** | **2–3** | |
| 1,5-hexanediol, | 66225-37-4 | 2–9 | | | 1–3 | |
| 4-methyl- (C7) | | **6–8** | | **1** | **2–3** | |
| 1,5-hexanediol, | 1462-11-9 | 2–9 | | | 1–3 | |
| 5-methyl- (C7) | | **6–8** | | **1** | **2–3** | |
| 1,6-hexanediol | 629-11-8 | | | | | |
| (C6) | | | **1–2** | **1–2** | **4** | |
| 1,6-hexanediol, | 25258-92-8 | 1–5 | | | 1–2 | |
| 2-methyl- (C7) | | **2–5** | | | **1** | |
| 1,6-hexanediol, | 4089-71-8 | 1–5 | | | 1–2 | |
| 3-methyl- (C7) | | **2–5** | | | **1** | |
| 2,3-hexanediol | 617-30-1 | 1–5 | | | 1–2 | |
| (C6) | | **2–5** | | | **1** | |
| 2,4-hexanediol | 19780-90-6 | | 3–8 | | | |
| (C6) | | | **5–8** | **3** | | |
| 2,4-hexanediol, | 66225-35-2 | | | | | |
| 2-methyl- (C7) | | | **1–2** | **1–2** | | |
| 2,4-hexanediol, | 116530-79-1 | | | | | |
| 3-methyl- (C7) | | | **1–2** | **1–2** | | |

TABLE VIIID-continued

| Base Material[a] | Base Material CAS No. | EO's (b) | 1 (Me—En) (c) | PO's (e) | n-BO's (f) | BO's (g) |
|---|---|---|---|---|---|---|
| 2,4-hexanediol, | 38836-25-8 | | | | | |
| 4-methyl- (C7) | | | **1–2** | **1–2** | | |
| 2,4-hexanediol, | 54877-00-8 | | | | | |
| 5-methyl- (C7) | | | **1–2** | **1–2** | | |
| 2,5-hexanediol | 2935-44-6 | | 3–8 | | | |
| (C6) | | | **5–8** | **3** | | |
| 2,5-hexanediol, | 29044-06-2 | | | | | |
| 2-methyl- (C7) | | | **1–2** | **1–2** | | |
| 2,5-hexanediol, | Method H | | | | | |
| 3-methyl- (C7) | | | **1–2** | **1–2** | | |
| 3,4-hexanediol | 922-17-8 | 1–5 | | | 1 | |
| (C6) | | **2–5** | | | | |

[a]The number of indicated alkoxylated groups in this Table are all operable, the generic limits being listed on the first line, and those that are preferred are in bold type and listed on the second line.
[b]The numbers in this column are average numbers of ($CH_2CH_2O$) groups in the polyethoxylated derivative.
[c]The numbers in this column are average numbers of ($CH_2CH_2O$) groups in the one methyl-capped polyethoxylate substituant in each derivative.
[e]The numbers in this column are average numbers of ($CH(CH_3)CH_2O$) groups in the polypropoxylated derivative.
[f]The numbers in this column are average numbers of ($CH_2CH_2CH_2CH_2O$) groups in the polytetramethyleneoxylated derivative.
[g]The numbers in this column are average numbers of ($CH(CH_2CH_3)CH_2O$) groups in the polybutoxylated derivative.

TABLE VIIIE

| Base Material (a) | Base Material CAS No. | EO's (b) | 1(Me-En) (c) | PO's (e) | n-BO's (f) |
|---|---|---|---|---|---|
| 1,3-heptanediol (C7) | 23433–04–7 | 1–7 | | | 1–2 |
| | | **3–6** | | **1** | **2** |
| 1,4-heptanediol (C7) | 40646–07–9 | 1–7 | | | 1–2 |
| | | **3–6** | | **1** | **2** |
| 1,5-heptanediol (C7) | 60096–09–5 | 1–7 | | | 1–2 |
| | | **3–6** | | **1** | **2** |
| 1,6-heptanediol (C7) | 13175–27–4 | 1–7 | | | 1–2 |
| | | **3–6** | | **1** | **2** |
| 1,7-heptanediol (C7) | 629–30–1 | | | | |
| | | **1–2** | | | **1** |

TABLE VIIIE-continued

| Base Material (a) | Base Material CAS No. | EO's (b) | 1(Me-En) (c) | PO's (e) | n-BO's (f) |
|---|---|---|---|---|---|
| 2,4-heptanediol (C7) | 20748–86–1 | 3–10 | | | |
| | | **7–10** | **1** | **1** | **3** |
| 2,5-heptanediol (C7) | 70444–25–6 | 3–10 | | | |
| | | **7–10** | **1** | **1** | **3** |
| 2,6-heptanediol (C7) | 5969–12–0 | 3–10 | | | |
| | | **7–10** | **1** | **1** | **3** |
| 3,5-heptanediol (C7) | 86632–40–8 | 3–10 | | | |
| | | **7–10** | **1** | **1** | **3** |

(a) The number of indicated alkoxylated groups in this Table are all operable, the generic limits being listed on the first line, and those that are preferred are in bold type and listed on the second line.
(b) The numbers in this column are average numbers of $(CH_2CH_2O)$ groups in the polyethoxylated derivative.
(c) The numbers in this column are average numbers of $(CH_2CH_2O)$ groups in the one methyl-capped polyethoxylate substituant in each derivative.
(e) The numbers in this column are average numbers of $(CH(CH_3)CH_2O)$ groups in the polypropoxylated derivative.
(f) The numbers in this column are average numbers of $(CH_2CH_2CH_2CH_2O)$ groups in the polytetramethyleneoxylated derivative.

TABLE IX

AROMATIC DIOLS

Suitable aromatic diols include:

| Chemical Name | CAS No. |
|---|---|
| Operable Aromatic Diols | |
| 1-phenyl-1,2-ethanediol | 93-56-1 |
| 1-phenyl-1,2-propanediol | 1855-09-0 |
| 2-phenyl-1,2-propanediol | 87760-50-7 |
| 3-phenyl-1,2-propanediol | 17131-14-5 |
| 1-(3-methylphenyl)-1,3-propanediol | 51699-43-5 |
| 1-(4-methylphenyl)-1,3-propanediol | 159266-06-5 |
| 2-methyl-1-phenyl-1,3-propanediol | 139068-60-3 |
| 1-phenyl-1,3-butanediol | 118100-60-0 |
| 3-phenyl-1,3-butanediol | 68330-54-1 |
| 1-phenyl-1,4-butanediol | 136173-88-1 |
| 2-phenyl-1,4-butanediol | 95840-73-6 |
| 1-phenyl-2,3-butanediol | 169437-68-7 |
| Preferred Aromatic Diols | |
| 1-phenyl-1,2-ethanediol | 93-56-1 |
| 1-phenyl-1,2-propanediol | 1855-09-0 |
| 2-phenyl-1,2-propanediol | 87760-50-7 |
| 3-phenyl-1,2-propanediol | 17131-14-5 |
| 1-(3-methylphenyl)-1,3-propanediol | 51699-43-5 |
| 1-(4-methylphenyl)-1,3-propanediol | 159266-06-5 |
| 2-methyl-1-phenyl-1,3-propanediol | 139068-60-3 |
| 1-phenyl-1,3-butanediol | 118100-60-0 |
| 3-phenyl-1,3-butanediol | 68330-54-1 |
| 1-phenyl-1,4-butanediol | 136173-88-1 |
| More Preferred Aromatic Diols | |
| 1-phenyl-1,2-propanediol | 1855-09-0 |
| 2-phenyl-1,2-propanediol | 87760-50-7 |
| 3-phenyl-1,2-propanediol | 17131-14-5 |
| 1-(3-methylphenyl)-1,3-propanediol | 51699-43-5 |
| 1-(4-methylphenyl)-1,3-propanediol | 159266-06-5 |
| 2-methyl-1-phenyl-1,3-propanediol | 139068-60-3 |
| 3-phenyl-1,3-butanediol | 68330-54-1 |
| 1-phenyl-1,4-butanediol | 136173-88-1 |
| Inoperable Aromatic Diols | |
| 1-phenyl-1,3-propanediol | |
| 2-phenyl-1,3-propanediol | |
| 1-phenyl-1,2-butanediol | 154902-08-6 |
| 2-phenyl-1,2-butanediol | 157008-55-4 |
| 3-phenyl-1,2-butanediol | 141505-72-8 |
| 4-phenyl-1,2-butanediol | 143615-31-0 |
| 2-phenyl-1,3-butanediol | 103941-94-2 |

TABLE IX-continued

AROMATIC DIOLS

Suitable aromatic diols include:

| Chemical Name | CAS No. |
|---|---|
| 4-phenyl-1,3-butanediol | 81096-91-5 |
| 2-phenyl-2,3-butanediol | 138432-94-7 |

X. principal solvents which are homologs, or analogs, of the above structures where the total number of hydrogen atoms is increased by the addition of one, or more additional $CH_2$ groups, the total number of hydrogen atoms being kept at the same number by introducing double bonds, are also useful with examples including the following known compounds:

TABLE X

EXAMPLES OF UNSATURATED COMPOUNDS

| Operable Unsaturated Diols | |
|---|---|
| 1,3-Propanediol, 2,2-di-2-propenyl- | 55038-13-6 |
| 1,3-Propanediol, 2-(1-pentenyl)- | 138436-18-7 |
| 1,3-Propanediol, 2-(2-methyl-2-propenyl)-2-(2-propenyl)- | 121887-76-1 |
| 1,3-Propanediol, 2-(3-methyl-1-butenyl)- | 138436-17-6 |
| 1,3-Propanediol, 2-(4-pentenyl)- | 73012-46-1 |
| 1,3-Propanediol, 2-ethyl-2-(2-methyl-2-propenyl)- | 91367-61-2 |
| 1,3-Propanediol, 2-ethyl-2-(2-propenyl)- | 27606-26-4 |
| 1,3-Propanediol, 2-methyl-2-(3-methyl-3-butenyl)- | 132130-95-1 |
| 1,3-Butanediol, 2,2-diallyl- | 103985-49-5 |
| 1,3-Butanediol, 2-(1-ethyl-1-propenyl)- | 116103-35-6 |
| 1,3-Butanediol, 2-(2-butenyl)-2-methyl- | 92207-83-5 |
| 1,3-Butanediol, 2-(3-methyl-2-butenyl)- | 98955-19-2 |
| 1,3-Butanediol, 2-ethyl-2-(2-propenyl)- | 122761-93-7 |
| 1,3-Butanediol, 2-methyl-2-(1-methyl-2-propenyl)- | 141585-58-2 |
| 1,4-Butanediol, 2,3-bis(1-methylethylidene)- | 52127-63-6 |
| 1,4-Butanediol, 2-(3-methyl-2-butenyl)-3-methylene- | 115895-78-8 |
| 2-Butene-1,4-diol, 2-(1,1-dimethylpropyl)- | 91154-01-7 |
| 2-Butene-1,4-diol, 2-(1-methylpropyl)- | 91154-00-6 |
| 2-Butene-1,4-diol, 2-butyl- | 153943-66-9 |
| 1,3-Pentanediol, 2-ethenyl-3-ethyl- | 104683-37-6 |
| 1,3-Pentanediol, 2-ethenyl-4,4-dimethyl- | 143447-08-9 |
| 1,4-Pentanediol, 3-methyl-2-(2-propenyl)- | 139301-86-3 |
| 1,5-Pentanediol, 2-(1-propenyl)- | 84143-44-2 |
| 1,5-Pentanediol, 2-(2-propenyl)- | 134757-01-0 |
| 1,5-Pentanediol, 2-ethylidene-3-methyl- | 42178-93-8 |
| 1,5-Pentanediol, 2-propylidene- | 58203-50-2 |
| 2,4-Pentanediol, 3-ethylidene-2,4-dimethyl- | 88610-19-9 |
| 4-Pentene-1,3-diol, 2-(1,1-dimethylethyl)- | 109788-04-7 |
| 4-Pentene-1,3-diol, 2-ethyl-2,3-dimethyl- | 90676-97-4 |
| 1,4-Hexanediol, 4-ethyl-2-methylene- | 66950-87-6 |
| 1,5-Hexadiene-3,4-diol, 2,3,5-trimethyl- | 18984-03-7 |
| 1,5-Hexadiene-3,4-diol, 5-ethyl-3-methyl- | 18927-12-3 |
| 1,5-Hexanediol, 2-(1-methylethenyl)- | 96802-18-5 |
| 1,6-Hexanediol, 2-ethenyl- | 66747-31-7 |
| 1-Hexene-3,4-diol, 5,5-dimethyl- | 169736-29-2 |
| 1-Hexene-3,4-diol, 5,5-dimethyl- | 120191-04-0 |
| 2-Hexene-1,5-diol, 4-ethenyl-2,5-dimethyl- | 70101-76-7 |
| 3-Hexene-1,6-diol, 2-ethenyl-2,5-dimethyl- | 112763-52-7 |
| 3-Hexene-1,6-diol, 2-ethyl- | 84143-45-3 |
| 3-Hexene-1,6-diol, 3,4-dimethyl- | 125032-66-8 |
| 4-Hexene-2,3-diol, 2,5-dimethyl- | 13295-61-9 |
| 4-Hexene-2,3-diol, 3,4-dimethyl- | 135367-17-8 |
| 5-Hexene-1,3-diol, 3-(2-propenyl)- | 74693-24-6 |
| 5-Hexene-2,3-diol, 2,3-dimethyl- | 154386-00-2 |
| 5-Hexene-2,3-diol, 3,4-dimethyl- | 135096-13-8 |
| 5-Hexene-2,3-diol, 3,5-dimethyl- | 134626-63-4 |
| 5-Hexene-2,4-diol, 3-ethenyl-2,5-dimethyl- | 155751-24-9 |
| 1,4-Heptanediol, 6-methyl-5-methylene- | 100590-29-2 |
| 1,5-Heptadiene-3,4-diol, 2,3-dimethyl- | 18927-06-5 |
| 1,5-Heptadiene-3,4-diol, 2,5-dimethyl- | 22607-16-5 |
| 1,5-Heptadiene-3,4-diol, 3,5-dimethyl- | 18938-51-7 |
| 1,7-Heptanediol, 2,6-bis(methylene)- | 139618-24-9 |
| 1,7-Heptanediol, 4-methylene- | 71370-08-6 |
| 1-Heptene-3,5-diol, 2,4-dimethyl- | 155932-77-7 |

TABLE X-continued

| EXAMPLES OF UNSATURATED COMPOUNDS | |
|---|---|
| 1-Heptene-3,5-diol, 2,6-dimethyl- | 132157-35-8 |
| 1-Heptene-3,5-diol, 3-ethenyl-5-methyl | 61841-10-9 |
| 1-Heptene-3,5-diol, 6,6-dimethyl- | 109788-01-4 |
| 2,4-Heptadiene-2,6-diol, 4,6-dimethyl- | 102605-95-8 |
| 2,5-Heptadiene-1,7-diol, 4,4-dimethyl- | 162816-19-5 |
| 2,6-Heptadiene-1,4-diol, 2,5,5-trimethyl- | 115346-30-0 |
| 2-Heptene-1,4-diol, 5,6-dimethyl- | 103867-76-1 |
| 2-Heptene-1,5-diol, 5-ethyl- | 104683-39-8 |
| 2-Heptene-1,7-diol, 2-methyl- | 74868-68-1 |
| 3-Heptene-1,5-diol, 4,6-dimethyl- | 147028-45-3 |
| 3-Heptene-1,7-diol, 3-methyl-6-methylene- | 109750-55-2 |
| 3-Heptene-2,5-diol, 2,4-dimethyl- | 98955-40-9 |
| 3-Heptene-2,5-diol, 2,5-dimethyl- | 24459-23-2 |
| 3-Heptene-2,6-diol, 2,6-dimethyl- | 160524-66-3 |
| 3-Heptene-2,6-diol, 4,6-dimethyl- | 59502-66-8 |
| 5-Heptene-1,3-diol, 2,4-dimethyl- | 123363-69-9 |
| 5-Heptene-1,3-diol, 3,6-dimethyl- | 96924-52-6 |
| 5-Heptene-1,4-diol, 2,6-dimethyl- | 106777-98-4 |
| 5-Heptene-1,4-diol, 3,6-dimethyl- | 106777-99-5 |
| 5-Heptene-2,4-diol, 2,3-dimethyl- | 104651-56-1 |
| 6-Heptene-1,3-diol, 2,2-dimethyl- | 140192-39-8 |
| 6-Heptene-1,4-diol, 4-(2-propenyl)- | 1727-87-3 |
| 6-Heptene-1,4-diol, 5,6-dimethyl- | 152344-16-6 |
| 6-Heptene-1,5-diol, 2,4-dimethyl- | 74231-27-9 |
| 6-Heptene-1,5-diol, 2-ethylidene-6-methyl- | 91139-73-0 |
| 6-Heptene-2,4-diol, 4-(2-propenyl)- | 101536-75-8 |
| 6-Heptene-2,4-diol, 5,5-dimethyl- | 98753-77-6 |
| 6-Heptene-2,5-diol, 4,6-dimethyl- | 134876-94-1 |
| 6-Heptene-2,5-diol, 5-ethenyl-4-methyl- | 65757-31-5 |
| 1,3-Octanediol, 2-methylene- | 108086-78-8 |
| 1,6-Octadiene-3,5-diol, 2,6-dimethyl- | 91140-06-6 |
| 1,6-Octadiene-3,5-diol, 3,7-dimethyl- | 75654-19-2 |
| 1,7-Octadiene-3,6-diol, 2,6-dimethyl- | 51276-33-6 |
| 1,7-Octadiene-3,6-diol, 2,7-dimethyl- | 26947-10-4 |
| 1,7-Octadiene-3,6-diol, 3,6-dimethyl- | 31354-73-1 |
| 1-Octene-3,6-diol, 3-ethenyl- | 65757-34-8 |
| 2,4,6-Octatriene-1,8-diol, 2,7-dimethyl- | 162648-63-7 |
| 2,4-Octadiene-1,7-diol, 3,7-dimethyl- | 136054-24-5 |
| 2,5-Octadiene-1,7-diol, 2,6-dimethyl- | 91140-07-7 |
| 2,5-Octadiene-1,7-diol, 3,7-dimethyl- | 117935-59-8 |
| 2,6-Octadiene-1,4-diol, 3,7-dimethyl-(Rosiridol) | 101391-01-9 |
| 2,6-Octadiene-1,8-diol, 2-methyl- | 149112-02-7 |
| 2,7-Octadiene-1,4-diol, 3,7-dimethyl- | 91140-08-8 |
| 2,7-Octadiene-1,5-diol, 2,6-dimethyl- | 91140-09-9 |
| 2,7-Octadiene-1,6-diol, 2,6-dimethyl-(8-Hydroxylinalool) | 103619-06-3 |
| 2,7-Octadiene-1,6-diol, 2,7-dimethyl- | 60250-14-8 |
| 2-Octene-1,4-diol | 40735-15-7 |
| 2-Octene-1,7-diol | 73842-95-2 |
| 2-Octene-1,7-diol, 2-methyl-6-methylene- | 91140-16-8 |
| 3,5-Octadiene-1,7-diol, 3,7-dimethyl- | 62875-09-6 |
| 3,5-Octadiene-2,7-diol, 2,7-dimethyl- | 7177-18-6 |
| 3,5-Octanediol, 4-methylene- | 143233-15-2 |
| 3,7-Octadiene-1,6-diol, 2,6-dimethyl- | 127446-29-1 |
| 3,7-Octadiene-2,5-diol, 2,7-dimethyl- | 171436-39-8 |
| 3,7-Octadiene-2,6-diol, 2,6-dimethyl- | 150283-67-3 |
| 3-Octene-1,5-diol, 4-methyl- | 147028-43-1 |
| 3-Octene-1,5-diol, 5-methyl- | 19764-77-3 |
| 4,6-Octadiene-1,3-diol, 2,2-dimethyl- | 39824-01-6 |
| 4,7-Octadiene-2,3-diol, 2,6-dimethyl- | 51117-38-5 |
| 4,7-Octadiene-2,6-diol, 2,6-dimethyl- | 59076-71-0 |
| 4-Octene-1,6-diol, 7-methyl- | 84538-24-9 |
| 4-Octene-1,8-diol, 2,7-bis(methylene)- | 109750-56-3 |
| 4-Octene-1,8-diol, 2-methylene- | 109750-58-5 |
| 5,7-Octadiene-1,4-diol, 2,7-dimethyl- | 105676-78-6 |
| 5,7-Octadiene-1,4-diol, 7-methyl- | 105676-80-0 |
| 5-Octene-1,3-diol | 130272-38-7 |
| 6-Octene-1,3-diol, 7-methyl- | 110971-19-2 |
| 6-Octene-1,4-diol, 7-methyl- | 152715-87-2 |
| 6-Octene-1,5-diol | 145623-79-6 |
| 6-Octene-1,5-diol, 7-methyl- | 116214-61-0 |
| 6-Octene-3,5-diol, 2-methyl- | 65534-66-9 |
| 6-Octene-3,5-diol, 4-methyl- | 156414-25-4 |
| 7-Octene-1,3-diol, 2-methyl- | 155295-38-8 |
| 7-Octene-1,3-diol, 4-methyl- | 142459-25-4 |
| 7-Octene-1,3-diol, 7-methyl- | 132130-96-2 |
| 7-Octene-1,5-diol | 7310-51-2 |
| 7-Octene-1,6-diol | 159099-43-1 |

TABLE X-continued

| EXAMPLES OF UNSATURATED COMPOUNDS | |
|---|---|
| 7-Octene-1,6-diol, 5-methyl- | 144880-56-8 |
| 7-Octene-2,4-diol, 2-methyl-6-methylene- | 72446-81-2 |
| 7-Octene-2,5-diol, 7-methyl- | 152344-12-2 |
| 7-Octene-3,5-diol, 2-methyl- | 98753-85-6 |
| 1-Nonene-3,5-diol | 119554-56-2 |
| 1-Nonene-3,7-diol | 23866-97-9 |
| 3-Nonene-2,5-diol | 165746-84-9 |
| 4,6-Nonadiene-1,3-diol, 8-methyl- | 124099-52-1 |
| 4-Nonene-2,8-diol | 154600-80-3 |
| 6,8-Nonadiene-1,5-diol | 108586-03-4 |
| 7-Nonene-2,4-diol | 30625-41-3 |
| 8-Nonene-2,4-diol | 119785-59-0 |
| 8-Nonene-2,5-diol | 132381-58-9 |
| 1,9-Decadiene-3,8-diol | 103984-04-9 |
| 1,9-Decadiene-4,6-diol | 138835-67-3 |
| Preferred Unsaturated Diols | |
| 1,3-Butanediol, 2,2-diallyl- | 103985-49-5 |
| 1,3-Butanediol, 2-(1-ethyl-1-propenyl)- | 116103-35-6 |
| 1,3-Butanediol, 2-(2-butenyl)-2-methyl- | 92207-83-5 |
| 1,3-Butanediol, 2-(3-methyl-2-butenyl)- | 98955-19-2 |
| 1,3-Butanediol, 2-ethyl-2-(2-propenyl)- | 122761-93-7 |
| 1,3-Butanediol, 2-methyl-2-(1-methyl-2-propenyl)- | 141585-58-2 |
| 1,4-Butanediol, 2,3-bis(1-methylethylidene)- | 52127-63-6 |
| 1,3-Pentanediol, 2-ethenyl-3-ethyl- | 104683-37-6 |
| 1,3-Pentanediol, 2,ethenyl-4,4-dimethyl- | 143447-08-9 |
| 1,4-Pentanediol, 3-methyl-2-(2-propenyl)- | 139301-86-3 |
| 4-Pentene-1,3-diol, 2-(1,1-dimethylethyl)- | 109788-04-7 |
| 4-Pentene-1,3-diol, 2-ethyl-2,3-dimethyl- | 90676-97-4 |
| 1,4-Hexanediol, 4-ethyl-2-methylene- | 66950-87-6 |
| 1,5-Hexadiene-3,4-diol, 2,3,5-trimethyl- | 18984-03-7 |
| 1,5-Hexanediol, 2-(1-methylethenyl)- | 96802-18-5 |
| 2-Hexene-1,5-diol, 4-ethenyl-2,5-dimethyl- | 70101-76-7 |
| 1,4-Heptanediol, 6-methyl-5-methylene- | 100590-29-2 |
| 2,4-Heptadiene-2,6-diol, 4,6-dimethyl- | 102605-95-8 |
| 2,6-Heptadiene-1,4-diol, 2,5,5-trimethyl- | 115346-30-0 |
| 2-Heptene-1,4-diol, 5,6-dimethyl- | 103867-76-1 |
| 3-Heptene-1,5-diol, 4,6-dimethyl- | 147028-45-3 |
| 5-Heptene-1,3-diol, 2,4-dimethyl- | 123363-69-9 |
| 5-Heptene-1,3-diol, 3,6-dimethyl- | 96924-52-6 |
| 5-Heptene-1,4-diol, 2,6-dimethyl- | 106777-98-4 |
| 5-Heptene-1,4-diol, 3,6-dimethyl- | 106777-99-5 |
| 6-Heptene-1,3-diol, 2,2-dimethyl- | 140192-39-8 |
| 6-Heptene-1,4-diol, 5,6-dimethyl- | 152344-16-6 |
| 6-Heptene-1,5-diol, 2,4-dimethyl- | 74231-27-9 |
| 6-Heptene-1,5-diol, 2-ethylidene-6-methyl- | 91139-73-0 |
| 6-Heptene-2,4-diol, 4-(2-propenyl)- | 101536-75-8 |
| 1-Octene-3,6-diol, 3-ethenyl- | 65757-34-8 |
| 2,4,6-Octatriene-1,8-diol, 2,7-dimethyl- | 162648-63-7 |
| 2,5-Octadiene-1,7-diol, 2,6-dimethyl- | 91140-07-7 |
| 2,5-Octadiene-1,7-diol, 3,7-dimethyl- | 117935-59-8 |
| 2,6-Octadiene-1,4-diol, 3,7-dimethyl-(Rosiridol) | 101391-01-9 |
| 2,6-Octadiene-1,8-diol, 2-methyl- | 149112-02-7 |
| 2,7-Octadiene-1,4-diol, 3,7-dimethyl- | 91140-08-8 |
| 2,7-Octadiene-1,5-diol, 2,6-dimethyl- | 91140-09-9 |
| 2,7-Octadiene-1,6-diol, 2,6-dimethyl-(8-Hydroxylinalool) | 103619-06-3 |
| 2,7-Octadiene-1,6-diol, 2,7-dimethyl- | 60250-14-8 |
| 2-Octene-1,7-diol, 2-methyl-6-methylene- | 91140-16-8 |
| 3,5-Octadiene-2,7-diol, 2,7-dimethyl- | 7177-18-6 |
| 3,5-Octanediol, 4-methylene- | 143233-15-2 |
| 3,7-Octadiene-1,6-diol, 2,6-dimethyl- | 127446-29-1 |
| 4-Octene-1,8-diol, 2-methylene- | 109750-58-5 |
| 6-Octene-3,5-diol, 2-methyl- | 65534-66-9 |
| 6-Octene-3,5-diol, 4-methyl- | 156414-25-4 |
| 7-Octene-2,4-diol, 2-methyl-6-methylene- | 72446-81-2 |
| 7-Octene-2,5-diol, 7-methyl- | 152344-12-2 |
| 7-Octene-3,5-diol, 2-methyl- | 98753-85-6 |
| 1-Nonene-3,5-diol | 119554-56-2 |
| 1-Nonene-3,7-diol | 23866-97-9 |
| 3-Nonene-2,5-diol | 165746-84-9 |
| 4-Nonene-2,8-diol | 154600-80-3 |
| 6,8-Nonadiene-1,5-diol | 108586-03-4 |
| 7-Nonene-2,4-diol | 30625-41-3 |
| 8-Nonene-2,4-diol | 119785-59-0 |
| 8-Nonene-2,5-diol | 132381-58-9 |

TABLE X-continued

| EXAMPLES OF UNSATURATED COMPOUNDS | |
|---|---|
| 1,9-Decadiene-3,8-diol | 103984-04-9 |
| 1,9-Decadiene-4,6-diol | 138835-67-3 |

; and

XI. mixtures thereof.

There are no $C_{1-2}$ mono-ols that provide the clear concentrated fabric softener compositions of this invention. Only one $C_3$ mono-ol, n-propanol, provides acceptable performance (forms a clear product and either keeps it clear to a temperature of about 4° C., or allows it to recover upon rewarming to room temperature), although its boiling point (BP) is undesirably low. Of the $C_4$ mono-ols, only 2-butanol and 2-methyl-2-propanol provide very good performance, but 2-methyl-2-propanol has a BP that is undesirably low. There are no $C_{5-6}$ mono-ols that provide clear products except for unsaturated mono-ols as described above and hereinafter.

It is found that some principal solvents which have two hydroxyl groups in their chemical formulas are suitable for use in the formulation of the liquid concentrated, clear fabric softener compositions of this invention. It is discovered that the suitability of each principal solvent is surprisingly very selective, dependent on the number of carbon atoms, the isomeric configuration of the molecules having the same number of carbon atoms, the degree of unsaturation, etc. Principal solvents with similar solubility characteristics to the principal solvents above and possessing at least some asymmetry will provide the same benefit. It is discovered that the suitable principal solvents have a C log P of from about 0.15 to about 0.64, preferably from about 0.25 to about 0.62, and more preferably from about 0.40 to about 0.60.

For example, for the 1,2-alkanediol principal solvent series having the general formula HO—$CH_2$—CHOH—$(CH_2)_n$—H, with n being from 1 to 8, only 1,2-hexanediol (n=4), which has a C log P value of about 0.53, which is within the effective C log P range of from about 0.15 to about 0.64, is a good principal solvent, and is within the claim of this invention, while the others, e.g., 1,2-propanediol, 1,2-butanediol, 1,2-pentanediol, 1,2-octanediol, 1,2-decanediol, having C log P values outside the effective 0.15–0.64 range, are not. Furthermore, of the hexanediol isomers, again, the 1,2-hexanediol is a good principal solvent, while many other isomers such as 1,3-hexanediol, 1,4-hexanediol, 1,5-hexanediol, 1,6-hexanediol, 2,4-hexanediol, and 2,5-hexanediol, having C log P values outside the effective 0.15–0.64 range, are not.

There are no $C_3$–$C_5$ diols that provide a clear concentrated composition in the context of this invention.

Although there are many $C_6$ diols that are possible isomers, only the ones listed above are suitable for making clear products and only: 1,2-butanediol, 2,3-dimethyl-; 1,2-butanediol, 3,3-dimethyl-; 2,3-pentanediol, 2-methyl-; 2,3-pentanediol, 3-methyl-; 2,3-pentanediol, 4-methyl-; 2,3-hexanediol; 3,4-hexanediol; 1,2-butanediol, 2-ethyl-; 1,2-pentanediol, 2-methyl-; 1,2-pentanediol, 3-methyl-; 1,2-pentanediol, 4-methyl-; and 1,2-hexanediol are preferred, of which the most preferred are: 1,2-butanediol, 2-ethyl-; 1,2-pentanediol, 2-methyl-; 1,2-pentanediol, 3-methyl-; 1,2-pentanediol, 4-methyl-; and 1,2-hexanediol.

There are more possible $C_7$ diol isomers, but only the listed ones provide clear products and the preferred ones are: 1,3-butanediol, 2-butyl-; 1,4-butanediol, 2-propyl-; 1,5-pentanediol, 2-ethyl-; 2,3-pentanediol, 2,3-dimethyl-; 2,3-pentanediol 2,4-dimethyl-; 2,3-pentanediol, 4,4-dimethyl-; 3,4-pentanediol, 2,3-dimethyl-; 1,6-hexanediol, 2-methyl-; 1,6hexanediol, 3-methyl-; 1,3-heptanediol; 1,4-heptanediol; 1,5-heptanediol; 1,6-heptanediol; of which the most preferred are: 2,3-pentanediol, 2,3-dimethyl-; 2,3-pentanediol, 2,4-dimethyl-; 2,3-pentanediol, 3,4-dimethyl-; 2,3-pentanediol, 4,4-dimethyl-; and 3,4-pentanediol, 2,3-dimethyl-.

Similarly, there are even more $C_8$ diol isomers, but only the listed ones provide clear products and the preferred ones are: 1,3-propanediol, 2-(1,1-dimethylpropyl)-; 1,3-propanediol, 2-(1,2-dimethylpropyl); 1,3-propanediol, 2-(1-ethylpropyl); 1,3-propanediol, 2,2,2-dimethylpropyl)-; 1,3-propanediol, 2-ethyl-2-isopropyl-; 1,3-propanediol, 2-methyl-2-(1-methylpropyl); 1,3-propanediol, 2-methyl-2-(2-methylpropyl); 1,3-propanediol, 2-tertiary-butyl-2-methyl-; 1,3-butanediol, 2,2-diethyl; 1,3-butanediol, 2-(1-methylpropyl); 1,3-butanediol, 2-butyl-; 1,3-butanediol, 2-ethyl-2,3-dimethyl-; 1,3-butanediol, 2,1,1-dimethylethyl)-; 1,3-butanediol, 2-(2-methylpropyl)-; 1,3-butanediol, 2-methyl-2-propyl-; 1,3-butanediol, 2-methyl-2-isopropyl-; 1,3-butanediol, 3-methyl-2-propyl-; 1,4-butanediol, 2,2-diethyl-; 1,4-butanediol, 2-ethyl-2,3-dimethyl-; 1,4-butanediol, 2-ethyl-3,3-dimethyl-; 1,4-butanediol, 2-(1,1-dimethylethyl); 1,4-butanediol, 3-methyl-24isopropyl-; 1,3-pentanediol, 2,2,3-trimethyl-; 1,3-pentanediol, 2,2,4-trimethyl-; 1,3-pentanediol, 2,3,4-trimethyl-, 1,3-pentanediol, 2,4,4-trimethyl-; 1,3-pentanediol, 3,4,4-trimethyl-; 1,4-pentanediol, 2,2,3-trimethyl-; 1,4-pentanediol, 2,2,4-trimethyl-; 1,4-pentanediol, 2,3,3-trimethyl-; 1,4-pentanediol, 2,3,4-trimethyl-; 1,4-pentanediol, 3,3,4-trimethyl-; 1,5-pentanediol, 2,2,3-trimethyl-; l,S-pentanediol, 2,2,4-trimethyl-; 1,5-pentanediol, 2,3,3-trimethyl-; 2,4-pentanediol, 2,3,4-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,5-pentanediol 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,4-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanedioL 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 1,5-heptanediol, 6-methyl-; 1,6-heptanediol, 2-methyl-; 1,6-heptanediol 3-methyl-; 1,6-heptanediol, 4-methyl-; 1,6-heptanediol, 5-methyl-, 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 4-methyl-; 2,4-octanediol; 2,5-octanediol; 2,6-octanediol; 2,7octanediol; 3,5-octanediol; and/or 3,6-octanediol of which the following are the most preferred: 1,3-propanediol, 2-(1,1-dimethylpropyl); 1,3-propanediol, 2-(1,2-diethylpropyl); 1,3-propanediol, 2-(1-ethylpropyl)-; 1,3-propanediol, 2-(2,2-dimethylpropyl); 1,3-propanediol, 2-ethyl-2-isopropyl-; 1,3-propanediol, 2-methyl-2-(1-methylpropyl); 1,3-propanediol, 2-methyl-2-(2-methylpropyl); 1,3-propanediol, 2-tertiary-butyl-2-methyl-; 1,3-butanediol, 2-(1-methylpropyl); 1,3-butanediol, 2-(2-methylpropyl); 1,3-butanediol, 2-butyl-; 1,3-butanediol, 2-methyl-2-propyl-; 1,3-butanediol, 3-methyl-2-propyl-; 1,4-butanediol, 2,2-diethyl-; 1,4-butanediol, 2-ethyl-2,3-dimethyl-; 1,4-butanediol, 2-ethyl-3,3-dimethyl-; 1,4-butanediol, 2-(1,1-dimethylethyl); 1,3-pentanediol, 2,3,4-trimethyl-; 1,5-pentanediol, 2,2,3-trimethyl-; 1,5-pentanediol, 2,2,4-trimethyl-; 1,5-pentanediol, 2,3,3-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,4-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-, 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 1,5-heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 4-methyl-; 2,4-octanediol; 2,5-octanediol; 2,6-octanediol; 2,7-octanediol; 3,5-octanediol; and/or 3,6-octanediol.

Preferred mixtures of eight-carbon-atom-1,3 diols can be formed by the condensation of mixtures of butyraldehyde, isobutyraldehyde and/or methyl ethyl ketone (2-butanone), so long as there are at least two of these reactants in the reaction mixture, in the presence of highly alkaline catalyst followed by conversion by hydrogenation to form a mixture of eight-carbon-1,3-diols, i.e., a mixture of 8-carbon-1,3-diols primarily consisting of: 2,2,4-trimethyl-1,3-pentanediol; 2-ethyl-1,3-hexanediol; 2,2-dimethyl-1,3-hexanediol; 2-ethyl-4-methyl-1,3-pentanediol; 2-ethyl-3-methyl-1,3-pentanediol; 3,5-octanediol; 2,2-dimethyl-2,4-hexanediol; 2-methyl-3,5-heptanediol; and/or 3-methyl-3,5-heptanediol, the level of 2,2,4-trimethyl-1,3-pentanediol being less than half of any mixture, possibly along with other minor isomers resulting from condensation on the methylene group of 2-butanone, when it is present, instead of on the methyl group.

The formulatability, and other properties, such as odor, fluidity, melting point lowering, etc., of some $C_{6-8}$ diols listed above in Tables II–IV which are not preferred, can be improved by polyalkoxylation. Also, some of the $C_{3-5}$ diols which are alkoxylated are preferred. Preferred alkoxylated derivatives of the above $C_{3-8}$ diols [In the following disclosure, "EO" means polyethoxylates, "$E_n$" means —$(CH_2CH_2O)_nH$; Me—$E_n$ means methyl-capped polyethoxylates —$(CH_2CH_2O)_nCH_3$; "2(Me—En)" means 2 Me—En groups needed; "PO" means polypropoxylates, —$(CH(CH_3)CH_2O)_nH$; "BO" means polybutyleneoxy groups, $(CH(CH_2CH_3)CH_2O)_nH$; and "n-BO" means poly (n-butyleneoxy) groups —$(CH_2CH_2CH_2CH_2O)_nH$.] include:

1. 1,2-propanediol (C3) 2(Me—$E_{3-4}$); 1,2-propanediol (C3) $PO_4$; 1,2-propanediol, 2-methyl-(C4) (Me—$E_{8-10}$); 1,2-propanediol, 2-methyl-(C4) 2(Me—$E_1$); 1,2-propanediol, 2-methyl-(C4) $PO_3$; 1,3-propanediol (C3) 2(Me—ES); 1,3-propanediol (C3) $PO_6$; 1,3-propanediol, 2,2-diethyl-(C7) $E_{4-7}$; 1,3-propanediol, 2,2-diethyl-(C7) $PO_1$; 1,3-propanediol, 2,2-diethyl-(C7) n-$BO_2$; 1,3-propanediol, 2,2-dimethyl-(C5) 2($MeE_{1-2}$); 1,3-propanediol, 2,2-dimethyl-(C5) $PO_4$; 1,3-propanediol, 2-(1-methylpropyl)-(C7) $E_{4-7}$; 1,3-propanediol, 2-(1-methylpropyl)-(C7) $PO_1$; 1,3-propanediol, 2-(1-methylpropyl)-(C7) n-$BO_2$; 1,3-propanediol 2-(2-methylpropyl)-(C7) $E_{4-7}$; 1,3-propanediol, 2-(2-methylpropyl)-(C7) $PO_1$; 1,3-propanediol, 2-(2-methylpropyl)-(C7) n-$BO_2$; 1,3-propanediol, 2-ethyl-(C5) ($MeE_{9-10}$); 1,3-propanediol, 2-ethyl-(C5) 2($MeE_1$); 1,3-propanediol, 2-ethyl-(C5) $PO_3$; 1,3-propanediol 2-ethyl-2-methyl-(C6) ($MeE_{3-6}$); 1,3-propanediol 2-ethyl-2-methyl-(C6) $PO_2$; 1,3-propanediol, 2-ethyl-2-methyl-(C6) $BO_1$; 1,3-propanediol, 2 -isopropyl-(C6) ($MeE_{3-6}$); 1,3-propanediol, 2-isopropyl-(C6) $PO_2$; 1,3-propanediol, 2-isopropyl-(C6) $BO_1$; 1,3-propanediol, 2-methyl-(C4) 2($MeE_{4-5}$); 1,3-propanediol, 2-methyl-(C4) $PO_5$; 1,3-propanediol, 2-methyl-(C4) $BO_2$; 1,3-propanediol, 2-methyl-2-isopropyl-(C7) $E_{6-9}$; 1,3-propanediol, 2-methyl-2-isopropyl-(C7) $PO_1$; 1,3-propanediol, 2-methyl-2-isopropyl-(C7) n-$BO_{2-3}$; 1,3-propanediol, 2-methyl-2-propyl-(C7) $E_{4-7}$; 1,3-propanediol, 2-methyl-2-propyl-(C7) $PO_1$; 1,3-propanediol, 2-methyl-2-propyl-(C7) n-$BO_2$; 1,3-propanediol, 2-propyl-(C6) ($MeE_{1-4}$); 1,3-propanediol, 2-propyl-(C6) $PO_2$;

2. 1,2-butanediol (C4) ($MeE_{6-8}$); 1,2-butanediol (C4) $PO_{2-3}$; 1,2-butanediol (C4) $BO_1$; 1,2-butanediol, 2,3-dimethyl-(C6) $E_{2-5}$; 1,2-butanediol, 2,3-dimethyl-(C6) n-$BO_1$; 1,2-butanediol, 2-ethyl-(C6) $E_{1-3}$; 1,2-butanediol, 2-ethyl-(C6) n-$BO_1$; 1,2-butanediol, 2-methyl-(C5) ($MeE_{1-2}$); 1,2-butanediol, 2-methyl-(C5) $PO_1$; 1,2-butanediol, 3,3-dimethyl-(C6) $E_{2-5}$; 1,2-butanediol, 3,3-dimethyl-(C6) n-$BO_1$; 1,2-butanediol, 3-methyl-(C5) ($MeE_{1-2}$); 1,2-butanediol, 3-methyl-(C5) $PO_1$; 1,3-butanediol (C4) 2($MeE_{5-6}$); 1,3-butanediol (C4) $BO_2$; 1,3-butanediol, 2,2,3-trimethyl-(C7) ($MeE_{1-3}$); 1,3-butanediol, 2,2,3-trimethyl-(C7) $PO_2$; 1,3-butanediol, 2,2-dimethyl-(C6) ($MeE_{6-8}$); 1,3-butanediol, 2,2-dimethyl-(C6) $PO_3$; 1,3-butanediol, 2,3-dimethyl-(C6) ($MeE_{6-8}$); 1,3-butanediol, 2,3-dimethyl-(C6) $PO_3$; 1,3-butanediol, 2-ethyl-(C6) ($MeE_{4-6}$); 1,3-butanediol, 2-ethyl-(C6) $PO_{2-3}$; 1,3-butanediol 2-ethyl-(C6) $BO_1$; 1,3-butanediol, 2-ethyl-2-methyl-(C7) ($MeE_1$); 1,3-butanediol, 2-ethyl-2-methyl-(C7) $PO_1$; 1,3-butanediol, 2-ethyl-2-methyl-(C7) n-$BO_3$; 1,3-butanediol, 2-ethyl-3-methyl-(C7) ($MeE_1$); 1,3-butanediol, 2-ethyl-3-methyl-(C7) $PO_1$; 1,3-butanediol, 2-ethyl-3-methyl-(C7) n-$BO_3$; 1,3-butanediol, 2-isopropyl-(C7) ($MeE_1$); 1,3-butanediol, 2-isopropyl-(C7) $PO_1$; 1,3-butanediol, 2-isopropyl-(C7) n-$BO_3$; 1,3-butanediol, 2-methyl-(C5) 2($MeE_{2-3}$); 1,3-butanediol, 2-methyl-(C5) $PO_4$; 1,3-butanediol, 2-propyl-(C7) $E_{6-8}$; 1,3-butanediol, 2-propyl-(C7) $PO_1$; 1,3-butanediol, 2-propyl-(C7) n-$BO_{2-3}$; 1,3-butanediol, 3-methyl-(C5) 2($MeE_{2-3}$); 1,3-butanediol, 3-methyl-(C5) $PO_4$; 1,4-butanediol (C4) 2($MeE_{3-4}$); 1,4-butanediol (C4) $PO_{4-5}$; 1,4-butanediol, 2,2,3-trimethyl-(C7) $E_{6-9}$; 1,4-butanediol, 2,2,3-trimethyl-(C7) $PO_1$; 1,4-butanediol, 2,2,3-trimethyl-(C7) n-$BO_{2-3}$; 1,4-butanediol, 2,2-dimethyl-(C6) ($MeE_{3-6}$); 1,4-butanediol, 2,2-dimethyl-(C6) $PO_2$; 1,4-butanediol, 2,2-dimethyl-(C6) $BO_1$; 1,4-butanediol, 2,3-dimethyl-(C6) ($MeE_{3-6}$); 1,4-butanediol, 2,3-dimethyl-(C6) $PO_2$; 1,4-butanediol, 2,3-dimethyl-(C6) $BO_1$; 1,4-butanediol, 2-ethyl-(C6) ($MeE_{1-4}$); 1,4-butanediol, 2-ethyl-(C6) $PO_2$; 1,4-butanediol, 2-ethyl-2-methyl-(C7) $E_{4-7}$; 1,4-butanediol, 2-ethyl-2-methyl-(C7) PO; 1,4-butanediol, 2-ethyl-2-methyl-(C7) n-$BO_2$; 1,4-butanediol, 2-ethyl-3-methyl-(C7) $E_{4-7}$; 1,4-butanediol, 2-ethyl-3-methyl-(C7) $PO_1$; 1,4-butanediol, 2 -ethyl-3-methyl-(C7) n-$BO_2$; 1,4-butanediol, 2-isopropyl-(C7) $E_{4-7}$; 1,4-butanediol, 2-isopropyl-(C7) $PO_1$; 1,4-butanediol, 2-isopropyl-(C7) n-$BO_2$; 1,4-butanediol, 2-methyl-(C5) ($MeE_{9-10}$); 1,4-butanediol, 2-methyl-(C5) 2($MeE_1$); 1,4-butanediol, 2-methyl-(C5) $PO_3$; 1,4-butanediol, 2-propyl-(C7) $E_{2-5}$; 1,4-butanediol, 2-propyl-(C7) n-$BO_1$; 1,4-butanediol, 3-ethyl-1-methyl-(C7) $E_{6-8;\ 1,4}$-butanediol, 3-ethyl-1-methyl-(C7) $PO_1$; 1,4-butanediol, 3-ethyl-1-methyl-(C7) n-$BO_{23}$; 2,3-butanediol (C4) ($MeE_{9-10}$); 2,3-butanediol (C4) 2($MeE_1$); 2,3-butanediol (C4) $PO_{3-4}$; 2,3-butanediol, 2,3-dimethyl-(C6) $E_{7-9}$; 2,3-butanediol, 2,3-dimethyl-(C6) $PO_1$; 2,3-butanediol, 2,3-dimethyl-(C6) $BO_{2-3}$; 2,3-butanediol, 2-methyl-(C5) ($MeE_{2-5}$); 2,3-butanediol, 2-methyl-(C5) $PO_2$; 2,3-butanediol, 2-methyl-(C5) $BO_1$;

3. 1,2-pentanediol (C5) $E_{7-10}$; 1,2-pentanediol, (C5) $PO_1$; 1,2-pentanediol, (C5) n-$BO_3$; 1,2-pentanediol, 2-methyl (C6) $E_{1-3}$; 1,2-pentanediol, 2-methyl (C6) n-$BO_1$; 1,2-pentanediol, 3-methyl (C6) $E_{1-3}$; 1,2-pentanediol, 3-methyl (C6) n-$BO_1$; 1,2-pentanediol, 4-methyl (C6) $E_{1-3}$; 1,2-pentanediol, 4-methyl (C6) n-$BO_1$; 1,3-pentanediol (C5) 2(Me—$E_{1-2}$); 1,3-pentanediol (C5) $PO_{3-4}$; 1,3-pentanediol, 2,2-dimethyl-(C7) (Me—$E_1$); 1,3-pentanediol, 2,2-dimethyl-(C7) $PO_1$; 1,3-pentanediol, 2,2-dimethyl-(C7) n-$BO_3$; 1,3-pentanediol, 2,3-dimethyl-(C7) (Me—$E_1$); 1,3-pentanediol, 2,3-dimethyl-(C7) $PO_1$; 1,3-pentanediol, 2,3-dimethyl-(C7) n-$BO_3$; 1,3-pentanediol, 2,4-dimethyl-(C7) (Me—$E_1$); 1,3-pentanediol, 2,4-dimethyl-(C7) $PO_1$; 1,3-pentanediol, 2,4-dimethyl-(C7) n-$BO_3$; 1,3-pentanediol, 2-ethyl-(C7) $E_{6-8}$; 1,3-pentanediol, 2-ethyl-(C7) $PO_1$; 1,3-pentanediol, 2-ethyl-(C7) n-$BO_{2-3}$; 1,3-pentanediol, 2-methyl-(C6) 2(Me—$E_{4-6}$); 1,3-pentanediol, 2-methyl-(C6) $PO_{2-3}$; 1,3-pentanediol, 3,4-dimethyl-(C7) (Me—$E_1$); 1,3-pentanediol, 3,4-dimethyl-(C7) $PO_1$; 1,3-pentanediol, 3,4-dimethyl-(C7) n-$BO_3$; 1,3-pentanediol, 3-methyl-(C6) 2(Me—$E_{4-6}$); 1,3-pentanediol, 3-methyl-(C6) $PO_{2-3}$; 1,3-pentanediol, 4,4-dimethyl-(C7) (Me—$E_1$); 1,3-pentanediol, 4,4-dimethyl-(C7) $PO_1$; 1,3-pentanediol, 4,4-dimethyl-(C7) n-$BO_3$; 1,3-pentanediol, 4-methyl-(C6) 2(Me—$E_{4-6}$); 1,3-pentanediol, 4-methyl-(C6) $PO_{2-3}$; 1,4-pentanediol, (C5) 2(Me—$E_{1-2}$); 1,4-pentanediol (C5) $PO_{3-4}$; 1,4-pentanediol, 2,2-dimethyl-(C7) (Me—$E_1$); 1,4-pentanediol, 2,2-dimethyl-(C7) $PO_1$; 1,4-pentanediol, 2,2-dimethyl-(C7) n-$BO_3$; 1,4-pentanediol, 2,3-dimethyl-(C7) (Me—$E_1$); 1,4-pentanediol, 2,3-dimethyl-(C7) $PO_1$; 1,4-pentanediol, 2,3-dimethyl-(C7) n-B03; 1,4-pentanediol, 2,4-dimethyl-(C7) (Me—$E_1$); 1,4-pentanediol, 2,4-dimethyl-(C7) $PO_1$; 1,4-pentanediol, 2,4-dimethyl-(C7) n-$BO_3$; 1,4-pentanediol, 2-methyl-(C6) (Me—$E_{4-6}$); 1,4-pentanediol, 2-methyl-(C6) $PO_{2-3}$; 1,4-pentanediol, 3,3-dimethyl-(C7) (Me—$E_1$); 1,4-pentanediol, 3,3-dimethyl-(C7) $PO_1$; 1,4-pentanediol, 3,3-dimethyl-(C7) n-$BO_3$; 1,4-pentanediol, 3,4-dimethyl-(C7) (Me—$E_1$); 1,4-pentanediol, 3,4-dimethyl-(C7) $PO_1$; 1,4-pentanediol, 3,4-dimethyl-(C7) n-$BO_3$; 1,4-pentanediol, 3-methyl-(C6) 2(Me—$E_{4-6}$); 1,4-pentanediol, 3-methyl-(C6) $PO_{2-3}$; 1,4-pentanediol, 4-methyl-(C6) 2(Me—$E_{4-6}$); 1,4-pentanediol, 4-methyl-(C6) $PO_{2-3}$; 1,5-pentanediol, (C5) (Me—$E_{8-10}$); 1,5-pentanediol (C5) 2(Me—$E_1$); 1,5-pentanediol (C5) $PO_3$; 1,5-pentanediol, 2,2-dimethyl-(C7) $E_{4-7}$; 1,5-pentanediol, 2,2dimethyl-(C7) $PO_1$; 1,5-pentanediol, 2,2-dimethyl-(C7) n-$BO_2$; 1,5-pentanediol, 2,3-dimethyl-(C7) $E_{4-7}$; 1,5-pentanediol, 2,3-dimethyl-(C7) $PO_1$; 1,5-pentanediol, 2,3-dimethyl-(C7) n-$BO_2$; 1,5-pentanediol, 2,4-dimethyl-(C7) $E_{4-7}$; 1,5-pentanediol, 2,4-dimethyl-(C7) $PO_1$; 1,5-pentanediol, 2,4-dimethyl-(C7) n-$BO_2$; 1,5-pentanediol, 2-ethyl-(C7) $E_{2-5}$; 1,5-pentanediol, 2-ethyl-(C7) n-$BO_1$; 1,5-pentanediol, 2-methyl-(C6) (Me—$E_{1-4}$); 1,5-pentanediol, 2-methyl-(C6) $PO_2$; 1,5-pentanediol, 3,3-dimethyl-(C7) $E_{4-7}$; 1,5-pentanediol, 3,3-dimethyl-(C7) $PO_1$; 1,5-pentanediol, 3,3-dimethyl-(C7) n-$BO_2$; 1,5-pentanediol, 3-methyl-(C6) (Me—$E_{1-4}$); 1,5-pentanediol, 3-methyl-(C6) $PO_2$; 2,3-pentanediol, (C5) (Me—$E_{1-3}$); 2,3-pentanediol, (C5)

$PO_2$; 2,3-pentanediol, 2-methyl-(C6) $E_{4-7}$; 2,3-pentanediol, 2-methyl-(C6) $PO_1$; 2,3-pentanediol, 2-(C6) methyl-n-$BO_2$; 2,3-pentanediol, 3-methyl-(C6) $E_{4-7}$; 2,3-pentanediol, 3-methyl-(C6) $PO_1$; 2,3-pentanediol, 3-methyl-(C6) n-$BO_2$; 2,3-pentanediol, 4-methyl-(C6) $E_{4-7}$; 2,3-pentanediol, 4-methyl-(C6) $PO_1$; 2,3-pentanediol, 4-methyl-(C6) n-$BO_2$; 2,4-pentanediol, (C5) 2(Me—$E_{2-4}$); 2,4-pentanediol (C5) $PO_4$; 2,4-pentanediol, 2,3-dimethyl-(C7) (Me—$E_{2-4}$); 2,4-pentanediol, 2,3-dimethyl-(C7) $PO_2$; 2,4-pentanediol, 2,4-dimethyl-(C7) (Me—$E_{24}$); 2,4-pentanediol, 2,4-ethyl-(C7) $PO_2$; 2,4-pentanediol , 2-methyl-(C7) (Me—$E_{8-10}$); 2,4-pentanediol, 2-methyl-(C7) $PO_3$; 2,4-pentanediol, 3,3-dimethyl-(C7) (Me—$E_{24}$); 2,4-pentanediol 3,3-methyl-(C7) $PO_2$; 2,4-pentanediol, 3-methyl-(C6) (Me—$E_{8-10}$); 2,4-pentanediol, 3-methyl-(C6) $PO_3$;

4. 1,3-hexanediol (C6) (Me—$E_{2-5}$); 1,3-hexanediol (C6) $PO_2$; 1,3-hexanediol (C6) $BO_1$; 1,3-hexanediol, 2-methyl-(C7) $E_{6-8}$; 1,3-hexanediol, 2-methyl-(C7) $PO_1$; 1,3-hexanediol, 2-methyl-(C7) n-$BO_{2-3}$; 1,3-hexanediol, 3-methyl-(C7) $E_{6-8}$; 1,3-hexanediol, 3-methyl-(C7) $PO_1$; 1,3-hexanediol, 3-methyl-(C7) n-$BO_{2-3}$; 1,3-hexanediol, 4-methyl-(C7) $E_{6-8}$; 1,3-hexanediol, 4-methyl-(C7) $PO_1$; 1,3-hexanediol, 4-methyl-(C7) n-$BO_{2-3}$; 1,3-hexanediol, 5-methyl-(C7) $E_{6-8}$; 1,3-hexanediol, 5-methyl-(C7) $PO_1$; 1,3-hexanediol, 5-methyl-(C7) n-$BO_{2-3}$; 1,4-hexanediol (C6) (Me—$E_{2-5}$); 1,4-hexanediol (C6) $PO_2$; 1,4-hexanediol (C6) $BO_1$; 1,4-hexanediol, 2-methyl-(C7) $E_{6-8}$; 1,4-hexanediol, 2-methyl-(C7) $PO_1$; 1,4-hexanediol, 2-methyl-(C7) n-$BO_{2-3}$; 1,4-hexanediol, 3-methyl-(C7) $E_{6-8}$; 1,4-hexanediol, 3-methyl-(C7) $PO_1$; 1,4-hexanediol, 3-methyl-(C7) n-$BO_{2-3}$; 1,4-hexanediol, 4-methyl-(C7) $E_{6-8}$; 1,4-hexanediol, 4-methyl-(C7) $PO_1$; 1,4 -hexanediol, 4-methyl-(C7) n-$BO_{2-3}$; 1,4-hexanediol, 5-methyl-(C7) $E_{6-8}$; 1,4-hexanediol, 5-methyl-(C7) $PO_1$; 1,4-hexanediol, 5-methyl-(C7) n-$BO_{2-3}$; 1,5-hexanediol (C6) (Me—$E_{2-5}$); 1,5-hexanediol (C6) $PO_2$; 1,5-hexanediol (C6) $BO_1$; 1,5-hexanediol, 2-methyl-(C7) $E_{6-8}$; 1,5-hexanediol, 2-methyl-(C7) $PO_1$; 1,5-hexanediol, 2-methyl-(C7) n-$BO_{2-3}$; 1,5-hexanediol, 3-methyl-(C7) $E_{6-8}$; 1,5-hexanediol, 3-methyl-(C7) $PO_1$; 1,5-hexanediol, 3-methyl-(C7) n-$BO_{2-3}$; 1,5-hexanediol 4-methyl-(C7) $E_{6-}8$; 1,5-hexanediol, 4-methyl-(C7) $PO_1$; 1,5-hexanediol 4-methyl-(C7) n-$BO_{2-3}$; 1,5-hexanediol, 5-methyl-(C7) $E_{6-8}$; 1,5-hexanediol 5-methyl-(C7) $PO_1$; 1,5-hexanediol, 5-methyl-(C7) n-$BO_{2-3}$; 1,6-hexanediol (C6) (Me—$E_{1-2}$); 1,6-hexanediol (C6) $PO_{1-2}$; 1,6-hexanediol (C6) n-$BO_4$; 1,6-hexanediol, 2-methyl-(C7) $E_{2-5}$; 1,6-hexanediol, 2-methyl-(C7) n-$BO_1$; 1,6-hexanediol, 3-methyl-(C7) $E_{2-5}$; 1,6-hexanediol, 3-methyl-(C7) n-$BO_1$; 2,3-hexanediol (C6) $E_{2-5}$; 2,3-hexanediol (C6) n-$BO_1$; 2,4-hexanediol (C6) (Me—$E_{5-8}$); 2,4-hexanediol (C6) $PO_3$; 2,4-hexanediol, 2-methyl-(C7) Me—$E_{1-2}$); 2,4-hexanediol 2-methyl-(C7) $PO_{1-2}$; 2,4-hexanediol, 3-methyl-(C7) (Me— $E_{1-2}$); 2,4-hexanediol 3-methyl-(C7) $PO_{1-2}$; 2,4-hexanediol, 4-methyl-(C7) (Me—$E_{1-2}$); 2,4-hexanediol 4-methyl-(C7) $PO_{1-2}$; 2,4-hexanediol, 5-methyl-(C7) (Me—$E_{1-2}$); 2,4-hexanediol 5-methyl-(C7) $PO_{1-2}$; 2,5-hexanediol (C6) (Me—$E_{5-8}$); 2,5-hexanediol (C6) $PO_3$; 2,5-hexanediol, 2-methyl-(C7) (Me—$E_{1-2}$); 2,5-hexanediol 2-methyl-(C7) $PO_{1-2}$; 2,5-hexanediol 3-methyl-(C7) (Me—$E_{1-2}$); 2,5-hexanediol 3-methyl-(C7) $PO_{1-2}$; 3,4-hexanediol (C6) $EO_{2-5}$; 3,4-hexanediol (C6) n-$BO_1$;

5. 1,3-heptanediol (C7) $E_{3-6}$; 1,3-heptanediol (C7) $PO_1$; 1,3-heptanediol (C7) n-$BO_2$; 1,4-heptanediol (C7) $E_{3-6}$; 1,4-heptanediol (C7) $PO_1$; 1,4-heptanediol (C7) n-$BO_2$; 1,5-heptanediol (C7) $E_{3-6}$; 1,5-heptanediol (C7) $PO_1$; 1,5-heptanediol (C7) n-$BO_2$; 1,6-heptanediol (C7) $E_{3-6}$; 1,6-heptanediol (C7) $PO_1$; 1,6-heptanediol (C7) n-$BO_2$; 1,7-heptanediol (C7) $E_{1-2}$; 1,7-heptanediol (C7) n-$BO_1$; 2,4-heptanediol (C7) $E_{7-10}$; 2,4-heptanediol (C7) (Me—$E_1$); 2,4-heptanediol (C7) $PO_1$; 2,4heptanediol (C7) n-$BO_3$; 2,5-heptanediol (C7) $E_{7-10}$; 2,5-heptanediol (C7) (Me—$E_1$); 2,5-heptanediol (C7) $PO_1$; 2,5-heptanediol (C7) n-$BO_3$; 2,6-heptanediol (C7) $E_{7-10}$; 2,6-heptanediol (C7) (Me—$E_1$); 2,6-heptanediol (C7) $PO_1$; 2,6-heptanediol (C7) n-$BO_3$; 3,5-heptanediol (C7) $E_{7-10}$; 3,5-heptanediol (C7) (Me—$E_1$); 3,5-heptanediol (C7) $PO_1$; 3,5-heptanediol (C7) n-$BO_3$;

6. 1,3-butanediol, 3-methyl-2-isopropyl-(C8) $PO_1$; 2,4-pentanediol, 2,3,3-trimethyl-(C8) $PO_1$; 1,3-butanediol, 2,2-diethyl-(C8) $E_{2-5}$; 2,4-hexanediol, 2,3-dimethyl-(C8) $E_{2-5}$; 2,4-hexanediol, 2,4-dimethyl-(C8) $E_{2-5}$; 2,4-hexanediol, 2,5-dimethyl-(C8) $E_{2-5}$; 2,4-hexanediol, 3,3-dimethyl-(C8) $E_{2-5}$; 2,4-hexanediol, 3,4-dimethyl-(C8) $E_{2-5}$; 2,4-hexanediol, 3,5-dimethyl-(C8) $E_{2-5}$; 2,4-hexanediol, 4,5-dimethyl-(C8) $E_{2-5}$; 2,4-hexanediol, 5,5-dimethyl-(C8) $E_{2-5}$; 2,5-hexanediol, 2,3-dimethyl-(C8) $E_{2-5}$; 2,5-hexanediol, 2,4-dimethyl-(C8) $E_{2-5}$; 2,5-hexanediol, 2,5-dimethyl-(C8) $E_{2-5}$; 2,5-hexanediol, 3,3-dimethyl-(C8) $E_{2-5}$; 2,5-hexanediol, 3,4-dimethyl-(C8) $E_{2-5}$; 3,5-heptanediol, 3-methyl-(C8) $E_{2-5}$; 1,3-butanediol, 2,2-diethyl-(C8) n-$BO_{1-2}$; 2,4-hexanediol, 2,3-dimethyl-(C8) n-$BO_{1-2}$; 2,4-hexanediol, 2,4-dimethyl-(C8) n-$BO_{1-2}$; 2,4-hexanediol, 2,5-dimethyl-(C8) n-$BO_{1-2}$; 2,4-hexanediol, 3,3-dimethyl-(C8) n-$BO_{1-2}$; 2,4-hexanediol, 3,4-dimethyl-(C8) n-$BO_{1-2}$; 2,4-hexanediol, 3,5-dimethyl-(C8) n-$BO_{1-2}$; 2,4-hexanediol, 4,5-dimethyl-(C8) n-$BO_{1-2}$; 2,4-hexanediol, 5,5-dimethyl-, n-$BO_{1-2}$; 2,5-hexanediol, 2,3-dimethyl-(C8) n-$BO_{1-2}$; 2,5-hexanediol, 2,4-dimethyl-(C8) n-$BO_{1-2}$; 2,5-hexanediol, 2,5-dimethyl-(C8) n-$BO_{1-2}$; 2,5-hexanediol, 3,3-dimethyl-(C8) n-$BO_{1-2}$; 2,5-hexanediol, 3,4-dimethyl-(C8) n-$BO_{1-2}$; 3,5-heptanediol, 3-methyl-(C8) n-$BO_{1-2}$; 1,3-propanediol, 2-(1,2-dimethylpropyl)-(C8) n-$BO_1$; 1,3-butanediol, 2-ethyl-2,3-dimethyl-(C8) n-$BO_1$; 1,3-butanediol, 2-methyl-2-isopropyl-(C8) n-$BO_1$; 1,4-butanediol, 3-methyl-2-isopropyl-(C8) n-$BO_1$; 1,3-pentanediol, 2,2,3-trimethyl-(C8) n-$BO_1$; 1,3-pentanediol, 2,2,4-trimethyl-(C8) n-$BO_1$; 1,3-pentanediol, 2,4,4-trimethyl-(C8) n-$BO_1$; 1,3-pentanediol, 3,4,4-trimethyl-(C8) n-$BO_1$; 1,4-pentanediol, 2,2,3-trimethyl-(C8) n-$BO_1$; 1,4-pentanediol, 2,2,4-trimethyl-(C8) n-$BO_1$; 1,4-pentanediol, 2,3,3-trimethyl-(C8) n-$BO_1$; 1,4-pentanediol, 2,3,4-trimethyl-(C8) n-$BO_1$; 1,4-pentanediol, 3,3,4-trimethyl-(C8) n-$BO_1$; 2,4-pentanediol, 2,3,4-trimethyl-(C5) n-$BO_1$; 2,4-hexanediol, 4-ethyl-(C8) n-$BO_1$; 2,4-heptanediol, 2-methyl-(C8) n-$BO_1$; 2,4-heptanediol, 3-methyl-(C8) n-$BO_1$; 2,4-heptanediol, 4-methyl-(C8) n-$BO_1$; 2,4-heptanediol, 5-methyl-(C8) n-$BO_1$; 2,4-heptanediol, 6-methyl-(C8) n-$BO_1$; 2,5-heptanediol, 2-methyl-(C8) n-$BO_1$; 2,5-heptanediol, 3-methyl-(C8) n-$BO_1$; 2,5-heptanediol, 4-methyl-(C8) n-$BO_1$; 2,5-heptanediol, 5-methyl-(C8) n-$BO_1$; 2,5-heptanediol, 6-methyl-(C8) n-$BO_1$; 2,6-heptanediol, 2-methyl-(C8) n-$BO_1$; 2,6-heptanediol, 3-methyl-(C8) n-$BO_1$; 2,6-heptanediol, 4-methyl-(C5) n-$BO_1$; 3,5-heptanediol, 2-methyl-(C8)

n-$BO_1$; 1,3-propanediol, 2-(1,2-dimethylpropyl)-(C8) $E_{1-3}$; 1,3-butanediol, 2-ethyl-2,3-dimethyl-(C8) $E_{1-3}$; 1,3-butanediol, 2-methyl-2-isopropyl-(C8) $E_{1-3}$; 1,4-butanediol, 3-methyl-2-isopropyl-(C8) $E_{1-3}$; 1,3-pentanediol, 2,2,3-trimethyl-(C8) $E_{1-3}$; 1,3-pentanediol, 2,2,4-trimethyl-(C8) $E_{1-3}$; 1,3-pentanediol, 2,4,4-trimethyl-(C8) $E_{1-3}$; 1,3-pentanediol, 3,4,4-trimethyl-(C8) $E_{1-3}$; 1,4-pentanediol, 2,2,3-trimethyl-(C8) $E_{1-3}$; 1,4-pentanediol, 2,2,4-trimethyl-(C8) $E_{1-3}$; 1,4-pentanediol, 2,3,3-trimethyl-(C8) $E_{1-3}$; 1,4-pentanediol, 2,3,4-trimethyl-(C8) $E_{1-3}$; 1,4-pentanediol, 3,3,4-trimethyl-(C8) $E_{1-3}$; 2,4-pentanediol, 2,3,4-trimethyl-(C8) $E_{1-3}$; 2,4-hexanediol, 4-ethyl-(C8) $E_{1-3}$; 2,4-heptanediol, 2-methyl-(C8) $E_{1-3}$; 2,4-heptanediol, 3-methyl-(C5) $E_{1-3}$; 2,4-heptanediol, 4-methyl-(C8) $E_{1-3}$; 2,4-heptanediol, 5-methyl-(C8) $E_{1-3}$; 2,4-heptanediol, 6-methyl-(C8) $E_{1-3}$; 2,5-heptanediol, 2-methyl-(C8) $E_{1-3}$; 2,5-heptanediol, 3-methyl-(C8) $E_{1-3}$; 2,5-heptanediol, 4-methyl-(C8) $E_{1-3}$; 2,5-heptanediol, 5-methyl-(C8) $E_{1-3}$; 2,5-heptanediol, 6-methyl-(C8) $E_{1-3}$; 2,6-heptanediol, 2-methyl-(C8) $E_{1-3}$; 2,6-heptanediol, 3-methyl-(C8) $E_{1-3}$; 2,6-heptanediol, 4-methyl-(C8) $E_{1-3}$; and/or 3,5-heptanediol, 2-methyl-(C8) $E_{1-3}$; and 7. mixtures thereof.

Of the nonane isomers, only 2,4-pentadiol, 2,3,3,4-tetramethyl- is highly preferred.

In addition to the aliphatic diol principal solvents, and some of their alkoxylated derivatives, discussed hereinbefore and hereinafter, some specific diol ethers are also found to be suitable principal solvents for the formulation of liquid concentrated, clear fabric softener compositions of the present invention. Similar to the aliphatic diol principal solvents, it is discovered that the suitability of each principal solvent is very selective, depending, e.g., on the number of carbon atoms in the specific diol ether molecules. For example, as given in Table VI, for the glyceryl ether series having the formula $HOCH_2—CHOH—CH_2—O—R$, wherein R is from C2 to C8 alkyl, only monopentyl ethers with the formula $HOCH_2—CHOH—CH_2—O—C_5H_{11}$ (3-pentyloxy-1,2-propanediol), wherein the $C_5H_{11}$ group comprises different pentyl isomers, have C log P values within the preferred C log P values of from about 0.25 to about 0.62 and are suitable for the formulation of liquid concentrated, clear fabric softeners of the present invention. It is also found that the cyclohexyl derivative, but not the cyclopentyl derivative, is suitable. Similarly, selectivity is exhibited in the selection of aryl glyceryl ethers. Of the many possible aromatic groups, only a few phenol derivatives are suitable.

The same narrow selectivity is also found for the di(hydroxyalkyl)ethers. It is discovered that bis(2-hydroxybutyl)ether, but not bis(2-hydroxypentyl)ether, is suitable. For the di(cyclic hydroxyalkyl)analogs, the bis(2-hydroxycyclopentyl)ether is suitable, but not the bis(2-hydroxycyclohexyl)ether. Non-limiting examples of synthesis methods for the preparation of some preferred di(hydroxyalkyl)ethers are given hereinafter.

The butyl monoglycerol ether (also named 3-butyloxy-1,2-propanediol) is not well suited to form liquid concentrated, clear fabric softeners of the present invention. However, its polyethoxylated derivatives, preferably from about triethoxylated to about nonaethoxylated, more preferably from pentaethoxylated to octaethoxylated, are suitable principal solvents, as given in Table VI.

All of the preferred alkyl glyceryl ethers and/or di(hydroxyalkyl)ethers that have been identified are given in Table VI and the most preferred are: 1,2-propanediol, 3-(n-pentyloxy)-; 1,2-propanediol, 3-(2-pentyloxy)-; 1,2-propanediol, 3-(3-pentyloxy); 1,2-propanediol, 3-(2-methyl-1-butyloxy)-; 1,2-propanediol, 3-(iso-amyloxy; 1,2-propanediol, 3-(3-methyl-2-butyloxy)-; 1,2-propanediol, 3-(cyclohexyloxy); 1,2-propanediol, 3-(1-cyclohex-1-enyloxy); 1,3-propanediol, 2-(pentyloxy); 1,3-propanediol, 2-(2-pentyloxy); 1,3-propanediol, 2-(3-pentyloxy)-; 1,3-propanediol, 2-(2-methyl-1-butyloxy); 1,3-propanediol, 2-(iso-amyloxy); 1,3-propanediol, 2-(3-methyl-2-butyloxy); 1,3-propanediol, 2-(cyclohexyloxy); 1,3-propanediol, 2-(1-cyclohex-1-enyloxy); 1,2-propanediol, 3-(butyloxy), pentaethoxylated; 1,2-propanediol, 3-(butyloxy), hexaethoxylated; 1,2-propanediol, 3-(butyloxy)-, heptaethoxylated; 1,2-propanediol, 3-(butyloxy)-, octaethoxylated; 1,2-propanediol, 3-(butyloxy), nonaethoxylated; 1,2-propanediol, 3-(butyloxy)-, monopropoxylated; 1,2-propanediol, 3(butyloxy)-, dibutyleneoxylated; and/or 1,2-propanediol, 3-(butyloxy)-, tributyleneoxylated. Preferred aromatic glyceryl ethers include: 1,2-propanediol, 3-phenyloxy-; 1,2-propanediol, 3-benzyloxy-; 1,2-propanediol, 3-(2-phenylethyloxy)-; 1,2-propanediol, 1,3-propanediol, 2-(m-cresyloxy)-; 1,3-propanediol, 2-(p-cresyloxy)-; 1,3-propanediol, 2-benzyloxy-; 1,3-propanediol, 2-(2-phenylethyloxy)-; and mixtures thereof. The more preferred aromatic glyceryl ethers include: 1,2-propanediol, 3-phenyloxy-; 1,2-propanediol, 3-benzyloxy-; 1,2-propanediol, 3-(2-phenylethyloxy)-; 1,2-propanediol, 1,3-propanediol, 2-(m-cresyloxy)-; 1,3-propanediol, 2(p-cresyloxy)-; 1,3-propanediol, 2-(2-phenylethyloxy)-; and mixtures thereof. The most preferred di(hydroxyalkyl)ethers include: bis(2-hydroxybutyl)ether, and bis(2-hydroxycyclopentyl)ether;

An illustrative and non-limiting example of synthesis methods to prepare the preferred alkyl and aryl monoglyceryl ethers is given hereinafter.

The alicyclic diols and their derivatives that are preferred include: (1) the saturated diols and their derivatives including: 1-isopropyl-1,2-cyclobutanediol; 3-ethyl-4-methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 2,4,5-trimethyl-1,3-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1,3-dimethyl-1,3-cyclohexanediol; 1,6-dimethyl-1,3-cyclohexanediol; 1-hydroxy-cyclohexaneethanol; 1-hydroxy-cyclohexanemethanol; 1-ethyl-1,3-cyclohexanediol; 1-methyl-1,2-cyclohexanediol; 2,2-dimethyl-1,3-cyclohexanediol; 2,3-dimethyl-1,4-cyclohexanediol; 2,4-dimethyl-1,3-cyclohexanediol; 2,5-dimethyl-1,3-cyclohexanediol; 2,6-dimethyl-1,4-cyclohexanediol; 2-ethyl-1,3-cyclohexanediol; 2-hydroxycyclohexaneethanol; 2-hydroxyethyl-1-cyclohexanol; 2-hydroxymethylcyclohexanol; 3-hydroxyethyl-1-cyclohexanol; 3-hydroxycyclohexaneethanol; 3-hydroxymethylcyclohexanol; 3-methyl-1,2-cyclohexanediol; 4,4-methyl-1,3-Cyclohexanediol; 4,5-dimethyl-1,3-cyclohexanediol; 4,6-dimethyl-1,3-cyclohexanediol; 4-ethyl-1,3-cyclohexanediol; 4-hydroxmethyl-1-cyclohexanol;

4-hydroxymethylcyclohexanol; 4-methyl-1,2-cyclohexanediol; 5,5-dimethyl-1,3-cyclohexanediol; 5-ethyl-1,3-cyclohexanediol; 1,2-cycloheptanediol; 2-methyl-1,3-cycloheptanediol; 2-methyl-1,4-cycloheptanediol; 4-methyl-1,3-cycloheptanediol; 5-methyl-1,3-cycloheptanediol; 5-methyl-1,4-cycloheptanediol; 6-methyl-1,4-cycloheptanediol; 1,3-cyclooctanediol; 1,4-cyclooctanediol; 1,5-cyclooctanediol; 1,2-cyclohexanediol, diethoxylate; 1,2-cyclohexanediol, triethoxylate; 1,2-cyclohexanediol, tetraethoxylate; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; 1,2-cyclohexanediol monobutylenoxylate; 1,2-cyclohexanediol, dibutylenoxylate; and/or 1,2-cyclohexanediol, tributylenoxylate. The most preferred saturated alicyclic diols and their derivatives are: 1-isopropyl-1,2-cyclobutanediol; 3-ethyl-4-methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1-hydroxycyclohexanemethanol; 1-methyl-1,2-cyclohexanediol; 3-hydroxymethylcyclohexanol; 3-methyl-1,2-cyclohexanediol; 4,4-dimethyl-1,3-cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-hydroxymethylcyclohexanol; 4-methyl-1,2-cyclohexanediol; 1,2-cycloheptanediol; ; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; and/or 1,2-cyclohexanediol, dibutylenoxylate.

Preferred aromatic diols include: 1-phenyl-1,2-ethanediol; 1-phenyl-1,2-propanediol; 2-phenyl-1,2-propanediol; 3-phenyl-1,2-propanediol; 1-(3-methylphenyl) 1,3-propanediol; 1-(4-methylphenyl)-1,3-propanediol; 2-methyl-1-phenyl-1,3-propanediol; 1-phenyl-1,3-butanediol; 3-phenyl-1,3-butanediol; and/or 1-phenyl-1,4-butanediol, of which, 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl-1,3-propanediol; and/or 1-phenyl-1,4-butanediol are the most preferred.

As discussed hereinbefore, all of the unsaturated materials that are related to the other preferred principal solvents herein by the same relationship, i.e., having one more $CH_2$ group than the corresponding saturated principal solvent and remaining within the effective C log P range are preferred. However, the specific preferred unsaturated diol principal solvents are: 1,3-butanediol, 2,2-diallyl-; 1,3-butanediol, 2-(1-ethyl-1-propenyl); 1,3-butanediol, 2-(2-butenyl)-2-methyl-; 1,3-butanediol 2-(3-methyl-2-butenyl); 1,3-butanediol, 2-ethyl-2-(2-propenyl); 1,3-butanediol, 2-methyl-2-(1-methyl-2-propenyl); 1,4-butanediol, 2,3-bis (1-methylethylidene)-; 1,3-pentanediol, 2-ethenyl-3-ethyl-; 1,3-pentanediol, 2-ethenyl-4,4-dimethyl-; 1,4-pentanediol, 3-methyl-2-(2-propenyl)-; 4-pentene-1,3-diol, 2-(1,1-dimethylethyl)-; 4-pentene-1,3-diol, 2-ethyl-2,3-dimethyl-; 1,4-hexanediol, 4-ethyl-2-methylene-; 1,5-hexadiene-3,4-diol, 2,3,5-trimethyl-; 1,5-hexanediol, 2-(1-methylethenyl)-; 2-hexene-1,5-diol, 4-methyl-2,5-methyl-; 1,4-heptanediol, 6-methyl-5-methylene-; 2,4-heptadiene-2,6-diol, 4,6-dimethyl-; 2,6-heptadiene-1,4-diol, 2,5,5-trimethyl-; 2-heptene-1,4-diol, 5,6-dimethyl-; 3-heptene-1,5-diol, 4,6-dimethyl-; 5-heptene-1,3-diol, 2,4-dimethyl-; 5-heptene-1, 3-diol, 3,6-dimethyl-; 5-heptene-1,4-ol, 2,6-dimethyl-; 5-heptene-1,4-diol, 3,6-dimethyl-; 6-heptene-1,3-diol, 2,2-dimethyl-; 6-heptene-1,4-diol, 5,6-dimethyl-; 6-heptene-1, 5-diol, 2,4-dimethyl-; 6-heptene-1,5-diol, 2-ethylidene-methyl-; 6-heptene-2,4-diol, 4-(2-propenyl)-; 1-octene-3,6-diol, 3-ethenyl-; 2,4,6-octatriene-1,8-diol, 2,7-dimethyl-; 2,5-octadiene-1,7-diol, 2,6-dimethyl-; 2,5-octadiene-1,7-diol, 3,7-dimethyl-; 2,6-octadiene-1,4-diol, 3,7-dimethyl-(Rosiridol); 2,6-octadiene-1,8-diol, 2-methyl-; 2,7-octadiene-1,4-diol, 3,7-dimethyl-; 2,7 octadiene-1,5-diol, 2,6-dimethyl-; 2,7-octadiene-1,6-diol, 2,6-dimethyl-(8-hydroxylinalool); 2,7-octadiene-1,6-diol, 2,7-dimethyl-; 2-octene-1,7-diol, 2-methyl-methylene-; 3,5-octadiene-2,7-diol, 2,7-dimethyl-; 3,5-octanediol, 4-methylene; 3,7 octadiene-1,6-diol, 2,6-dimethyl-; 4-octene-1,8-diol, 2-methylene-; 6-octene-3,5-diol, 2-methyl-; 6-octene-3,5-diol, 4-methyl-; 7-octene-2,4-diol, 2-methyl-6-methylene-; 7-octene-2,5-diol, 7-methyl-; 7-octene-3,5-diol, 2-methyl-; 1-nonene-3,5-diol; 1-nonene-3,7-diol; 3-nonene-2,5-diol; 4-nonene-2,8-diol; 6,8 -nonadiene-1,5-diol; 7-nonene-2,4-diol; 8-nonene-2,4-diol; 8-nonene-2,5-diol; 1,9-decadiene-3,8-diol; and/or 1,9-decadiene-4,6-diol.

Said principal alcohol solvent can also preferably be selected from the group consisting of: 2,5-dimethyl-2,5-hexanediol; 2-ethyl-1,3-hexanediol; 2-methyl-2-propyl-1,3-propanediol; 1,2-hexanediol; and mixtures thereof. More preferably said principal alcohol solvent is selected from the group consisting of 2-ethyl-1,3-hexanediol; 2-methyl-2-propyl-1,3-propanediol; 1,2-hexanediol; and mixtures thereof. Even more preferably, said principal alcohol solvent is selected from the groups consisting of 2-ethyl-1,3-hexanediol; 1,2-hexanediol; and mixtures thereof.

When several derivatives of the same diol with different alkyleneoxy groups can be used, e.g., 2-methyl-2,3-butanediol having 3 to 5-ethyleneoxy groups, or 2 propyleneoxy groups, or 1 butyleneoxy group, it is preferred to use the derivative with the lowest number of groups, i.e., in this case, the derivative with one butyleneoxy group. However, when only about one to about four ethyleneoxy groups are needed to provide good formulatability, such derivatives are also preferred.

Unsaturated Diols

It is found surprisingly that there is a clear similarity between the acceptability (formulatability) of a saturated diol and its unsaturated homologs, or analogs, having higher molecular weights. The unsaturated homologs/analogs have the same formulatability as the parent saturated principal solvent with the condition that the unsaturated principal solvents have one additional methylene (viz., $CH_2$) group for each double bond in the chemical formula In other words, there is an apparent "addition rule" in that for each good saturated principal solvent of this invention, which is suitable for the formulation of clear, concentrated fabric softener compositions, there are suitable unsaturated principal solvents where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant with respect to the chemical formula of the "parent" saturated principal solvent. This is due to a surprising fact that adding a —$CH_2$— group to a solvent chemical formula has an effect of increasing its C log P value by about 0.53, while removing two adjacent hydrogen atoms to form a double bond has an effect of decreasing its C log P value by about a similar amount, viz., about 0.48, thus about compensating for the —$CH_2$— addition. Therefore one goes from a preferred saturated principal solvent to the preferred higher molecular weight unsaturated analogs/homologs containing at least one more carbon atom by inserting one double bond for each additional $CH_2$ group, and thus the total number of hydrogen atoms is kept the same as in the parent saturated principal solvent, as long as the C log P value of the new solvent remains within the effective 0.15–0.64, preferably from about 0.25 to about 0.62, and more preferably from about 0.40 to about 0.60, range. The following are some illustrative examples:

2,2-Dimethyl-6-heptene-1,3-diol (CAS No. 140192-39-8) is a preferred C9-diol principal solvent and can be considered to be derived by appropriately adding a $CH_2$ group and a double bond to either of the following preferred C8-diol principal solvents: 2-methyl-1,3-heptanediol or 2,2-dimethyl-1,3-hexanediol.

2,4-Dimethyl-5-heptene-1,3-diol (CAS No. 123363-69-9) is a preferred C9-diol principal solvent and can be considered to be derived by appropriately adding a $CH_2$ group and a double bond to either of the following preferred C8-diol principal solvents: 2-methyl-1,3-heptanediol or 2,4-dimethyl-1,3-hexanediol.

2-(1-Ethyl-1-propenyl)-1,3-butanediol (CAS No. 116103-35-6) is a preferred C9-diol principal solvent and can be considered to be derived by appropriately adding a $CH_2$ group and a double bond to either of the following preferred C8-diol principal solvents: 2-(1-ethylpropyl)-1,3-propanediol or 2-(1-methylpropyl)-1,3-butanediol.

2-Ethenyl-3-ethyl-1,3-pentanediol (CAS No. 104683-37-6) is a preferred C9-diol principal solvent and can be considered to be derived by appropriately adding a $CH_2$ group and a double bond to either of the following preferred C8-diol principal solvents: 3-ethyl-2-methyl-1,3-pentanediol or 2-ethyl-3-methyl-1,3-pentanediol.

3,6-Dimethyl-5-heptene-1,4-diol (e.g., CAS No. 106777-99-5) is a preferred C9-diol principal solvent and can be considered to be derived by appropriately adding a $CH_2$ group and a double bond to any of the following preferred C8-diol principal solvents: 3-methyl-1,4-heptanediol; 6-methyl-1,4-heptanediol; or 3,5-dimethyl-1,4-hexanediol.

5,6-Dimethyl-6-heptene-1,4-diol (e.g., CAS No. 152344-16-6) is a preferred C9-diol principal solvent and can be considered to be derived by appropriately adding a $CH_2$ group and a double bond to any of the following preferred C8-diol principal solvents: 5-methyl-1,4-heptanediol; 6-methyl-1,4-heptanediol; or 4,5-dimethyl-1,3-hexanediol.

4-Methyl-6-octene-3,5-diol (CAS No. 156414-254) is a preferred C9-diol principal solvent and can be considered to be derived by appropriately adding a $CH_2$ group and a double bond to any of the following preferred C8-diol principal solvents: 3,5-octanediol, 3-methyl-2,4-heptanediol or 4-methyl-3,5-heptanediol.

Rosiridol (CAS No. 101391-01-9) and isorosiridol (CAS No. 149252-15-3) are two isomers of 3,7-dimethyl-2,6-octadiene-1,4-diol, and are preferred C10-diol principal solvents. They can be considered to be derived by appropriately adding two $CH_2$ groups and two double bonds to any of the following preferred C8-diol principal solvents: 2-methyl-1,3-heptanediol; 6-methyl-1,3-heptanediol; 3-methyl-1,4-heptanediol; 6-methyl-1,4-heptanediol; 2,5-dimethyl-1,3-hexanediol; or 3,5-dimethyl-1,4-hexanediol.

8-Hydroxylinalool (CAS No. 103619-06-3, 2,6-dimethyl-2,7-octadiene-1,6-diol) is a preferred C10-diol principal solvent and can be considered to be derived by appropriately adding two $CH_2$ groups and two double bonds to any of the following preferred C8-diol principal solvents: 2-methyl-1,5-heptanediol; 5-methyl-1,5-heptanediol; 2-methyl-1,6-heptanediol; 6-methyl-1,6-heptanediol; or 2,4-dimethyl-1,4-hexanediol.

2,7-Dimethyl-3,7-octadiene-2,5-diol (CAS No. 171436-39-8) is a preferred C10-diol principal solvent and can be considered to be derived by appropriately adding two $CH_2$ group and two double bond to any of the following preferred C8-diol principal solvents: 2,5-octanediol; 6-methyl-1,4-heptanediol; 2-methyl-2,4-heptanediol; 6-methyl-2,4-heptanediol; 2-methyl-2,5-heptanediol; 6-methyl-2,5-heptanediol; and 2,5-dimethyl-2,4-hexanediol.

4-Butyl-2-butene-1,4-diol (CAS No. 153943-66-9) is a preferred C8-diol principal solvent and can be considered to be derived by appropriately adding a $CH_2$ group and a double bond to any of the following preferred C7-diol principal solvents: 2-propyl-1,4-butanediol or 2-butyl-1,3-propanediol.

By the same token, there are cases where a higher molecular weight unsaturated homolog which is derived from a poor, inoperable saturated solvent is itself a poor solvent. For example, 3,5-dimethyl-5-hexene-2,4-diol (e.g., CAS No. 160429-40-3) is a poor unsaturated C8 solvent, and can be considered to be derived from the following poor saturated C7 solvents: 3-methyl-2,4-hexanediol; 5-methyl-2,4-hexanediol; or 2,4-dimethyl-1,3-pentanediol; and 2,6-dimethyl-5-heptene-1,2-diol (e.g., CAS No. 141505-71-7) is a poor unsaturated C9 solvent, and can be considered to be derived from the following poor saturated C8 solvents: 2-methyl-1,2-heptanediol; 6-methyl-1,2-heptanediol; or 2,5-dimethyl-1,2-hexanediol.

It is also found, surprisingly, that there is an exception to the above addition rule, in which saturated principal solvents always have unsaturated analogs/homologs with the same degree of acceptability. The exception relates to saturated diol principal solvents having the two hydroxyl groups situated on two adjacent carbon atoms. In some cases, but not always, inserting one, or more, $CH_2$ groups between the two adjacent hydroxyl groups of a poor solvent results in a higher molecular weight unsaturated homolog which is more suitable for the clear, concentrated fabric softener formulation. For example, the preferred unsaturated 6,6-dimethyl-1-heptene-3,5-diol (CAS No. 109788-01-4) having no adjacent hydroxyl groups can be considered to be derived from the inoperable 2,2-dimethyl-3,4-hexanediol which has adjacent hydroxyl groups. In this case, it is more reliable to consider that the 6,6-dimethyl-1-heptene-3,5-diol is derived from either 2-methyl-3,5-heptanediol or 5,5-dimethyl-2,4-hexanediol which are both preferred principal solvents and do not have adjacent hydroxyl groups. Conversely, inserting $CH_2$ groups between the adjacent hydroxyl groups of a preferred principal solvent can result in an inoperable higher molecular weight unsaturated diol solvent. For example, the inoperable unsaturated 2,4-dimethyl-5-hexene-2,4-diol (CAS No. 87604-24-8) having no adjacent hydroxyl groups can be considered to be derived from the preferred 2,3-dimethyl-2,3-pentanediol which has adjacent hydroxyl groups. In this case, it is more reliably to derive the inoperable unsaturated 2,4-dimethyl-5-hexene-2,4-diol from either 2-methyl-2,4-hexanediol or 4-methyl-2,4-hexanediol which are both inoperable solvents and do not have adjacent hydroxyl groups. There are also cases where an inoperable rash unsaturated solvent having no adjacent hydroxyl groups can be considered to be derived from an inoperable solvent which has adjacent hydroxyl groups, such as the pair 4,5-dimethyl-6-hexene-1,3-diol and 3,4-dimethyl-1,2-pentanediol. Therefore, in order to deduce the formulatability of an unsaturated solvent having no adjacent hydroxyl groups, one should start from a low molecular weight saturated homolog also not having adjacent hydroxyl groups. I.e., in general, the relationship is more reliable when the distance/relationship of the two hydroxy groups is maintained. I.e., it is reliable to start from a saturated solvent with adjacent hydroxyl groups to deduce the formulatability of the higher molecular weight unsaturated homologs also having adjacent hydroxyl groups.

It has been discovered that the use of these specific principal solvents can produce clear, low viscosity, stable fabric softener compositions at surprisingly low principal solvent levels, i.e., less than about 40%, by weight of the composition. It has also been discovered that the use of the principal alcohol solvents can produce highly concentrated fabric softener compositions, that are stable and can be diluted, e.g. from about 2:1 to about 10:1, to produce compositions with lower levels of fabric softener that are still stable.

Mixtures of the above principal solvents are particularly preferred, since one of the problems associated with large amounts of solvents is safety. Mixtures decrease the amount of any one material that is present. Odor and flammability can also be minimized by use of mixtures, especially when one of the principal solvents is volatile and/or has an odor, which is more likely for low molecular weight materials. Suitable solvents that can be used at levels that would not be sufficient to produce a clear product are 2,2,4-trimethyl-1,3-pentane diol; the ethoxylate, diethoxylate, or triethoxylate derivatives of 2,2,4-trimethyl-1,3-pentane diol; and/or 2-ethyl-1,3-hexanediol. For the purposes of this invention, these solvents should only be used at levels that will not provide a stable, or clear product. Preferred mixtures are those where the majority of the solvent is one, or more, that have been identified hereinbefore as most preferred. The use of mixtures of solvents is also preferred, especially when one, or more, of the preferred principal solvents are solid at room temperature. In this case, the mixtures are fluid, or have lower melting points, thus improving proccessability of the softener compositions.

It is also discovered that it is possible to substitute for part of a principal solvent or a mixture of principal solvents of this invention with a secondary solvent, or a mixture of secondary solvents, which by themselves are not operable as a principal solvent of this invention, as long as an effective amount of the operable principal solvent(s) of this invention is still present in the liquid concentrated, clear fabric softener composition. An effective amount of the principal solvent(s) of this invention is at least greater than about 5%, preferably more than about 7%, more preferably more than about 10% of the composition, when at least about 15% of the softener active is also present. The substitute solvent(s) can be used at any level, but preferably about equal to, or less than, the amount of operable principal solvent, as defined hereinbefore, that is present in the fabric softener composition.

For example, even though 1,2-pentanediol, 1,3-octanediol, and hydroxy pivalyl hydroxy pivalate (hereinafter, HPHP) having the following formula: $HOCH_2—C(CH_3)_2—CH_2—OCO—C(CH_3)_2CH_2—OH$ (CAS #1115-204) are inoperable solvents according to this invention, mixtures of these solvents with the principal solvent, e.g., with the preferred 1,2-hexanediol principal solvent, wherein the 1,2-hexanediol principal solvent is present at effective levels, also provide liquid concentrated, clear fabric softener compositions.

Some of the secondary solvents that can be used are those listed as inoperable hereinbefore and hereinafter, as well as some parent, non-alkoxylated solvents disclosed in Tables VII–VIII.

The principal solvent can be used to either make a composition translucent or clear, or can be used to reduce the temperature at which the composition is translucent or clear. Thus the invention also comprises the method of adding the principal solvent, at the previously indicated levels, to a composition that is not translucent, or clear, or which has a temperature where instability occurs that is too high, to make the composition translucent or clear, or, when the composition is clear, e.g., at ambient temperature, or down to a specific temperature, to reduce the temperature at which instability occurs, preferably by at least about 5° C., more preferably by at least about 10° C. The principal advantage of the principal solvent is that it provides the maximum advantage for a given weight of solvent. It is understood that "solvent", as used herein, refers to the effect of the principal solvent and not to its physical form at a given temperature, since some of the principal solvents are solids at ambient temperature.

Alkyl Lactates

Some alkyl lactate esters, e.g., ethyl lactate and isopropyl lactate have C log P values within the effective range of from about 0.15 to about 0.64, and can form liquid concentrated, clear fabric softener compositions with the fabric softener actives of this invention, but need to be used at a slightly higher level than the more effective diol solvents like 1,2-hexanediol. They can also be used to substitute for part of other principal solvents of this invention to form liquid concentrated, clear fabric softener compositions.

It has been discovered that the use of these specific solvents at specific molar ratios to the fabric softening active, namely the molar ratio of the principal solvent to the fabric softening active is not less than about 3, provides a final composition having surprisingly low viscosity and having excellent water dispersibility. It has also been discovered that the use of these specific solvents at specific molar ratios to the fabric softening active produce clear and stable fabric softener compositions. The amount of the principal solvent is not limited, as long as the molar ratio of the solvent to the fabric softening active is not less than 3. Preferably, the compositions of the present invention have low solvent levels such as not more than about 50% by weight of the composition, in order to produce highly concentrated fabric softener compositions. The use of solvent at low level eliminates the high cost of concentration. Also, the lower level of solvents of this type can help to alleviate flammability issues that may be associated with concentrated products that contain high levels of conventional non-aqueous solvents, i.e., ethanol, isopropanol, and other short chain alcohols.

III. Optional Ingredients (A) Low Molecular Weight Water Soluble Solvents

Low molecular weight water soluble solvents can also be used at levels of from (0% to about 12%, preferably from about 1% to about 10%, more preferably from about 2% to about 8%. The water soluble solvents cannot provide a clear product at the same low levels of the principal solvents described hereinbefore but can provide clear product when the principal solvent is not sufficient to provide completely clear product. The presence of these water soluble solvents is therefore highly desirable. Such solvents include: ethanol; isopropanol; 1,2-propanediol; 1,3-propanediol; propylene carbonate; etc. but do not include any of the principal solvents (B). These water soluble solvents have a greater affinity for water in the presence of hydrophobic materials like the softener active than the principal solvents.

(B) Brighteners

The compositions herein can also optionally contain from about 0.005% to 5% by weight of certain types of hydrophilic optical brighteners which also provide a dye transfer inhibition action. If used, the compositions herein will preferably comprise from about 0.001% to 1% by weight of such optical brighteners.

The hydrophilic optical brighteners useful in the present invention are those having the structural formula:

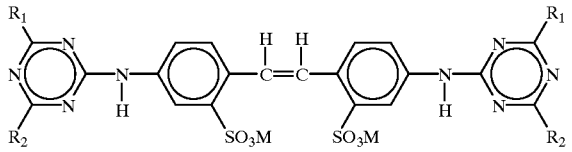

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morpholino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX® by Ciba-Geigy Corporation. Tinopal-UNPA-GX is the preferred hydrophilic optical brightener useful in the rinse added compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX® by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX® by Ciba Geigy Corporation.

(C) DispersibilitY Aids

The present invention can optionally contain dispersibility aids, e.g., those selected from the group consisting of mono-long chain alkyl cationic quaternary ammonium compounds, mono-long chain alkyl amine oxides, and mixture thereof. When said dispersibility aid is present, it is typically present at a total level of from about 2% to about 25%, preferably from about 3% to about 17%, more preferably from 4% to about 15%, and even more preferably from about 5% to about 13%, by weight of the composition. These aids are described in P&G Copending application Ser. No. 08/461,207, filed Jun. 5, 1995, Wahl et al., specifically on page 14, line 12 to page 20, line 12, which is herein incorporated by reference.

These materials can either be added as part of the active softener raw material, (formula (1)), e.g., the mono-long chain alkyl cationic surfactant or added as a separate component. The total level of dispersibility aid includes any amount that may be present as part of component (1).

(1) Mono-Alkyl Cationic Quaternary Ammonium Compound

When the mono-alkyl cationic quaternary ammonium compound is present, it is typically present at a level of from about 2% to about 25%, preferably from about 3% to about 17%, more preferably from about 4% to about 15%, and even more preferably from 5% to about 13% by weight of the composition, the total mono-alkyl cationic quaternary ammonium compound being at least at an effective level.

Such mono-alkyl cationic quaternary ammonium compounds useful in the present invention are, preferably, quaternary ammonium salts of the general formula:

$$[R^4N^+(R^5)_3]X^-$$

wherein $R^4$ is $C_8$–$C_{22}$ alkyl or alkenyl group, preferably $C_{10}$–$C_{18}$ alkyl or alkenyl group; more preferably $C_{10}$–$C_{14}$ or $C_{16}$–$C_{18}$ alkyl or alkenyl group;

each $R^5$ is a $C_1$–$C_6$ alkyl or substituted alkyl group (e.g., hydroxy alkyl), preferably $C_1$–$C_3$ alkyl group, e.g., methyl (most preferred), ethyl, propyl, and the like, a benzyl group, hydrogen, a polyethoxylated chain with from about 2 to about 20 oxyethylene units, preferably from about 2.5 to about 13 oxyethylene units, more preferably from about 3 to about 10 oxyethylene units, and mixtures thereof; and $X^-$ is as defined hereinbefore for Formula (I)).

Especially preferred dispersibility aids are monolauryl trimethyl ammonium chloride and monotallow trimethyl ammonium chloride available from Witco under the trade name Varisoft® 471 and monooleyl trimethyl ammonium chloride available from Witco under the tradename Varisoft® 417.

The $R^4$ group can also be attached to the cationic nitrogen atom through a group containing one, or more, ester, amide, ether, amine, etc., linking groups which can be desirable for increased concentratability of component (I), etc. Such linking groups are preferably within from about one to about three carbon atoms of the nitrogen atom.

Mono-alkyl cationic quaternary ammonium compounds also include $C_8$–$C_{22}$ alkyl choline esters. The preferred dispersibility aids of this type have the formula:

$$R^1C(O)—O—CH_2CH_2N^+(R)_3X^-$$

wherein $R^1$, R and $X^-$ are as defined previously.

Highly preferred dispersibility aids include $C_{12}$–$C_{14}$ coco choline ester and $C_{16}$–$C_{18}$ tallow choline ester.

Suitable biodegradable single-long-chain allyl dispersibility aids containing an ester linkage in the long chains are described in U.S. Pat. No. 4,840,738, Hardy and Walley, issued Jun. 20, 1989, said patent being incorporated herein by reference.

When the dispersibility aid comprises alkyl choline esters, preferably the compositions also contain a small amount, preferably from about 2% to about 5% by weight of the composition, of organic acid. Organic acids are described in European Patent Application No. 404,471, Machin et al., published on Dec. 27, 1990, supra, which is herein incorporated by reference. Preferably the organic acid is selected from the group consisting of glycolic acid, acetic acid, citric acid, and mixtures thereof.

Ethoxylated quaternary ammonium compounds which can serve as the dispersibility aid include ethylbis (polyethoxy ethanol)alkylammonium ethyl-sulfate with 17 moles of ethylene oxide, available under the trade name Variquat® 66 from Sherex Chemical Company; polyethylene glycol (15) oleammonium chloride, available under the trade name Ethoquad® 0/25 from Akzo; and polyethylene glycol (15) cocomonium chloride, available under the trade name Ethoquad® C/25 from Akzo.

Although the main function of the dispersibility aid is to increase the dispersibility of the ester softener, preferably the dispersibility aids of the present invention also have some softening properties to boost softening performance of the composition. Therefore, preferably the compositions of the present invention are essentially free of non-nitrogenous ethoxylated nonionic dispersibility aids which will decrease the overall softening performance of the compositions.

Also, quaternary compounds having only a single long alkyl chain, can protect the cationic softener from interacting with anionic surfactants and/or detergent builders that are carried over into the rinse from the wash solution.

(2) Amine Oxides

Suitable amine oxides include those with one alkyl or hydroxyalkyl moiety of about 8 to about 22 carbon atoms, preferably from about 10 to about 18 carbon atoms, more preferably from about 8 to about 14 carbon atoms, and two alkyl moieties selected from the group consisting of alkyl groups and hydroxyalkyl groups with about 1 to about 3 carbon atoms.

Examples include dimethyloctylamine oxide, diethyldecylamine oxide, bis-(2-hydroxyethyl)dodecyl-amine oxide, dimethyldodecylamine oxide, dipropyltetradecylamine oxide, methylethylhexadecylamine oxide, dimethyl-2-hydroxyoctadecylamine oxide, and coconut fatty alkyl dimethylamine oxide.

(D) Stabilizers

Stabilizers can be present in the compositions of the present invention. The term "stabilizer," as used herein, includes antioxidants, chelants, and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions Antioxidants and reductive agent stabilizers are especially critical for unscented or low scent products (no or low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox®-6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof, more preferably Irganox® 3125 alone or mixed with citric acid and/or other chelators such as isopropyl citrate, Dequest® 2010, available from Monsanto with a chemical name of 1-hydroxyethylidene-1, 1-diphosphonic acid (etidronic acid), and Tiron®, available from Kodak with a chemical name of 4,5-dihydroxy-m-benzene-sulfonic acid/sodium salt, and DTPA®, available from Aldrich with a chemical name of diethylenetriaminepentaacetic acid. Diethylenetriaminepentaacetic acid is a preferred material that is preferably present wherever the active is present.

The chemical names and CAS numbers for some of the above stabilizers which can be used in the compositions of the present invention are listed in Table I below.

(E) Soil Release Agent

In the present invention, an optional soil release agent can be added. The addition of the soil release agent can occur in combination with the premix, in combination with the acid/water seat, before or after electrolyte addition, or after the final composition is made. The softening composition prepared by the process of the present invention herein can contain from 0% to about 10%, preferably from 0.2% to about 5%, of a soil release agent. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon 4780® (from Dupont) and Milease T® (from ICI).

Highly preferred soil release agents are polymers of the generic formula:

$$X-(OCH_2CH_2)_p(O-\overset{O}{\overset{\|}{C}}-R^{14}-\overset{O}{\overset{\|}{C}}-OR^{15})_u(O-\overset{O}{\overset{\|}{C}}-R^{14}-O\overset{O}{\overset{\|}{C}}-O)(CH_2CH_2O)_n-X$$

in which each X can be a suitable capping group, with each X typically being selected from the group consisting of H, and alkyl or acyl groups containing from about 1 to about 4 carbon atoms. p is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^{14}$ moieties are essentially 1,4-phenylene moieties. As used herein, the term "the $R^{14}$ moieties are essentially 1,4-phenylene moieties" refers to compounds where the $R^{14}$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene, and mixtures thereof. Alkylene and alkenylene moieties which can be partially substituted include 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^{14}$ moieties, the degree of partial substitution with moieties other than 1,4-phenylene should be such that the soil release properties of the compound are not adversely affected to any great extent. Generally the degree of partial substitution which can be tolerated will depend upon the backbone length of the compound, i.e., longer backbones can have greater partial substitution for 1,4-phenylene moieties. Usually, compounds where the $R^{14}$ comprise from about 50% to about 100% 1,4-phenylene moieties (from 0% to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^{14}$ moieties consist entirely of (i.e., comprise 100%) 1,4-phenylene moieties, i.e., each $R^{14}$ moiety is 1,4-phenylene.

For the $R^{15}$ moieties, suitable ethylene or substituted ethylene moieties include ethylene, 1,2-propylene, 1,2-butylene, 1,2-hexylene, 3-methoxy-1,2-propylene, and mixtures thereof. Preferably, the $R^{15}$ moieties are essentially ethylene moieties, 1,2-propylene moieties, or mixtures thereof. Inclusion of a greater percentage of ethylene moieties tends to improve the soil release activity of compounds. Surprisingly, inclusion of a greater percentage of 1,2-propylene moieties tends to improve the water solubility of compounds.

A Therefore, the use of 1,2-propylene moieties or a similar branched equivalent is desirable for incorporation of any substantial part of the soil release component in the liquid fabric softener compositions. Preferably, from about 75% to about 100/%, are 1,2-propylene moieties.

The value for each p is at least about 6, and preferably is at least about 10. The value for each n usually ranges from about 12 to about 113. Typically the value for each p is in the range of from about 12 to about 43.

A more complete disclosure of soil release agents is contained in U.S. Pat. No.: 4,661,267, Decker, Konig, Straathof, and Gosselink, issued Apr. 28, 1987; U.S. Pat. No. 4,711,730, Gosselink and Diehl, issued Dec. 8, 1987; U.S. Pat. No. 4,749,596, Evans, Huntington, Stewart, Wolf, and Zimmerer, issued Jun. 7, 1988; U.S. Pat. No. 4,818,569, Trinh, Gosselink, and Rattinger, issued Apr. 4, 1989; U.S. Pat. No. 4,877,896, Maldonado, Trinh, and Gosselink issued Oct. 31, 1989; U.S. Pat. No. 4,956,447, Gosselink et al., issues Sep. 11, 1990; and U.S. Pat. No. 4,976,879, Maldonado, Trinh and Gosselink issued Dec. 11, 1990, all of said patents being incorporated herein by reference.

These soil release agents can also act as scum dispersants.

(F) Scum Dispersant

In the present invention, the premix can be combined with an optional scum dispersants, other than the soil release agent, and heated to a temperature at or above the melting point(s) of the components.

The preferred scum dispersants herein are formed by highly ethoxylating hydrophobic materials. The hydrophobic material can be a fatty alcohol, fatty acid, fatty amine, fatty acid amide, amine oxide, quaternary ammonium compound, or the hydrophobic moieties used to form soil release polymers. The preferred scum dispersants are highly ethoxylated, e.g., more than about 17, preferably more than about 25, more preferably more than about 40, moles of ethylene oxide per molecule on the average, with the polyethylene oxide portion being from about 76% to about 97%, preferably from about 81% to about 94%, of the total molecular weight.

The level of scum dispersant is sufficient to keep the scum at an acceptable, preferably unnoticeable to the consumer, level under the conditions of use, but not enough to adversely affect softening. For some purposes it is desirable that the scum is nonexistent. Depending on the amount of anionic or nonionic detergent, etc., used in the wash cycle of a typical laundering process, the efficiency of the rinsing steps prior to the introduction of the compositions herein, and the water hardness, the amount of anionic or nonionic detergent surfactant and detergency builder (especially phosphates and zeolites) entrapped in the fabric (laundry) will vary. Normally, the minimum amount of scum dispersant should be used to avoid adversely affecting softening properties. Typically scum dispersion requires at least about 2%, preferably at least about 4% (at least 6% and preferably at least 10% for maximum scum avoidance) based upon the level of softener active. However, at levels of about 10% (relative to the softener material) or more, one risks loss of softening efficacy of the product especially when the fabrics contain high proportions of nonionic surfactant which has been absorbed during the washing operation.

Preferred scum dispersants are: Brij 700®; Varonic U-250®; Genapol T-500®, Genapol T-800®; Plurafac A-79®; and Neodol 25-50®.

(G) Bactericides

Examples of bactericides used in the compositions of this invention include glutaraldehyde, formaldehyde, 2-bromo-2-nitro-propane-1,3-diol sold by Inolex Chemicals, located in Philadelphia, Pa., under the trade name Bronopol®, and a mixture of 5-chloro-2-methyl-4isothiazoline-3-one and 2-methyl-4-isothiazoline-3-one sold by Rohm and Haas Company under the trade name Kathon® about 1 to about 1,000 ppm by weight of the agent.

(H) Perfume

The present invention can contain any softener compatible perfume. Suitable perfumes are disclosed in U.S. Pat. No. 5,500,138, Bacon et al., issued Mar. 19, 1996, said patent being incorporated herein by reference.

As used herein, perfume includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Perfume can be present at a level of from 0% to about 10%, preferably from about 0.1% to about 5%, and more preferably from about 0.2% to about 3%, by weight of the finished composition. Fabric softener compositions of the present invention provide improved fabric perfume deposition.

(I) Chelating Agents

The compositions and processes herein can optionally employ one or more copper and/or nickel chelating agents ("chelators") over and above the chelating agent that is part of the stabilizer. Such water-soluble chelating agents can be selected from the group consisting of amino carboxylates, amino phosphonates, polyfunctionally-substituted aromatic chelating agents and mixtures thereof, all as hereinafter defined. The whiteness and/or brightness of fabrics are substantially improved or restored by such chelating agents and the stability of the materials in the compositions are improved.

Amino carboxylates useful as chelating agents herein include ethylenediaminetetraacetates (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DETPA), and ethanoldiglycines, including their water-soluble salts such as the alkali metal, ammonium, and substituted ammonium salts thereof and mixtures thereof.

Amino phosphonates are also suitable for use as chelating agents in the compositions of the invention when at least low levels of total phosphorus are permitted in detergent compositions, and include ethylenediaminetetrakis (methylenephosphonates), diethylenetriamine-N,N,N',N", N"-pentakis(methane phosphonate) (DETMP) and 1-hydroxyethane-1,1-diphosphonate (HEDP). Preferably, these amino phosphonates to not contain alkyl or alkenyl groups with more than about 6 carbon atoms.

The chelating agents are typically used in the present rinse process at levels from about 2 ppm to about 25 ppm, for periods from 1 minute up to several hours' soaking.

The preferred EDDS chelator used herein (also known as ethylenediamine-N,N'-disuccinate) is the material described in U.S. Pat. No. 4,704,233, cited hereinabove, and has the formula (shown in free acid form):

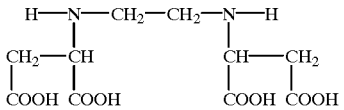

As disclosed in the patent, EDDS can be prepared using maleic anhydride and ethylenediamine. The preferred biodegradable [S,S] isomer of EDDS can be prepared by reacting L-aspartic acid with 1,2-dibromoethane. The EDDS has advantages over other chelators in that it is effective for chelating both copper and nickel cations, is available in a biodegradable form, and does not contain phosphorus. The EDDS employed herein as a chelator is typically in its salt form, i.e., wherein one or more of the four acidic hydrogens are replaced by a water-soluble cation M, such as sodium, potassium, ammonium, triethanolammonium, and the like. As noted before, the EDDS chelator is also typically used in the present rinse process at levels from about 2 ppm to about 25 ppm for periods from 1 minute up to several hours' soaking. At certain pH's the EDDS is preferably used in combination with zinc cations.

As can be seen from the foregoing, a wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 10%, more preferably from about 0.75% to about 5%, by weight of the compositions herein. Preferred chelators include DETMP, DETPA, NTA, EDDS and mixtures thereof.

(J) Other Optional Ingredients

The present invention can include optional components conventionally used in textile treatment compositions, for example: colorants; preservatives; surfactants; anti-shrinkage agents; fabric crisping agents; spotting agents; germicides; fungicides; anti-oxidants such as butylated hydroxy toluene, anti-corrosion agents, and the like.

Particularly preferred ingredients include water soluble calcium and/or magnesium compounds, which provide additional stability. The chloride salts are preferred, but acetate, nitrate, etc. salts can be used. The level of said calcium and/or magnesium salts is from 0% to about 2%, preferably from about 0.05% to about 0.5%, more preferably from about 0.1% to about 0.25%.

The present invention can also include other compatible ingredients, including those as disclosed in copending applications Ser. No.: 08/372,068, filed Jan. 12, 1995, Rusche, et al.; Ser. No. 08/372,490, filed Jan. 12, 1995, Shaw, et al.; and Ser. No. 08/277,558, filed Jul. 19, 1994, Hartman, et al., incorporated herein by reference.

All percentages, ratios and proportions herein are by weight, unless otherwise specified. All documents cited are, in relevant part, incorporated herein by reference.

EXAMPLES

The compositions in the Examples below are made by first preparing a softener premix by heating the softener active to melting at, e.g., about 130–150° F. (about 55–66° C.). The melted softener active is mixed using an IKA RW 25® mixer for about 2 to about 5 minutes at about 150 rpm. Separately, an acid/water seat is prepared by mixing the HCl with deionized (DI) water and heating this mixture to about 100° F. (about 38° C.) and maintaining said temperature with a water bath. The principal solvent(s) (melted at suitable temperatures if their melting points are above room temperature) are added to the softener premix and said premix is mixed for about 5 minutes. The acid/water seat is then added to the softener premix and mixed for about 20 to about 30 minutes or until the composition is clear and homogeneous. The composition is allowed to air cool to ambient temperature.

Example I

The following table shows the phase behaviour of the components (clarity, homogeneity, and viscosity of the components) having wide range of molar ratio of fabric softening active to principal solvent.

Note: In the following table, each dilution was made by cold water (25° C.)

Softener dosage is 5.31 g/50 L, which is 106 ppm in softening solution.

Active (DEQA[1], 42.5% in product): 45 ppm.

Primary Solvent (30% in product): 32 ppm.

| | 1 | 2 | 3 | 4 | 5 (comparative) | 6 (comparative) | 7 (comparative) |
|---|---|---|---|---|---|---|---|
| molar ratio of 1,2 HD/DEQA[1] | 25.8 | 6.45 | 3.6 | 3.0 | 2.15 | 0.72 | 0.34 |
| 10% dilution | C | C | C | C | C | not C | not C |
| | H | H | H | H | H | H | H |
| | Thin | Thin | Thin | Thin | Thin | Thick | Thick |
| 30% dilution | C | C | C | C | not C | not C | not C |
| | H | H | H | H | S | H | H |
| | Thin | Thin | Thin | Thin | Thick | Thick | Thick |
| 50% dilution | C | C | C | C | not C | not C | not C |
| | H | H | H | H | S | H | H |
| | Thin | Thin | Thin | Thin | Thick | Thick | Thick |

DEQA[1]: N,N-di(oleoyl)-N,N-dimethyl ammonium chloride
1,2-HD: 1,2-Hexanediol
C: clear
H: homogenous
S: separation Among the above compounds, each compound of examples 1 to 4 shows clear, homogenous product with low viscosity; each compound of comparative examples 5 to 7 does not have acceptable viscosity.

Example II

The following are non-limiting examples of the present invention:

The following Examples show clear and homogenous products with low viscosity.

| Component | 1 | 2 | 3 | 4 | 5 | 6 |
|---|---|---|---|---|---|---|
| molar ratio (principal solvent/fabric softening active) | 3.0 | 3.6 | 4.0 | 5.0 | 10.0 | 20.0 |
| | Wt. % | Wt. % | Wt. % | Wt. % | Wt. % | Wt. % |
| DEQA[1] | 42.5 | 42.5 | | | | 5.0 |
| DEQA[2] | | | 42.5 | 20.0 | 10.0 | |
| TMPD | | | | 22.0 | 29.0 | |
| 1:1 mixture of TMPD/HPHP | 35.0 | | | | | |
| 1,2-Hexanediol | | 28.0 | 31.0 | | | 17.0 |
| Ethanol | 8.0 | 8.0 | 8.0 | 3.5 | 1.8 | 0.88 |
| HCl (pH 2–3.5) | 0.005 | 0.005 | 0.005 | 0.005 | 0.005 | 0.005 |
| DI Water | Bal. | Bal. | Bal. | Bal. | Bal. | Bal. |

DEQA[1]: N,N-di(oleoyl-oxyethyl)-N,N-dimethyl ammonium chloride
DEQA[2]: N,N-di(coco-oyl-oxyethyl)-N,N-dimethyl ammonium chloride
1,2HD: 1,2-Hexanediol
TMPD: 2,2,4-trimethyl,1,3-pentanediol
TMPD-EO: 2,2,4-trimethyl,1,3-pentanediol EO (1 mole ethoxylate
HPHP: hydroxy pivalyl hydroxy pivalate Each of the composition of the example 2 is a clear, homogenous composition with low viscosity both at room temperature and at about 40° F. (about 4° C.).

For commercial purposes, the above compositions are introduced into containers, specifically bottles, and more specifically clear bottles (although translucent bottles can be used), made from polypropylene (although glass, oriented polyethylene, etc., can be substituted), the bottle having a light blue tint to compensate for any yellow color that is present, or that may develop during storage (although, for short times, and perfectly clear products, clear containers with no tint, or other tints, can be used), and having an ultraviolet light absorber in the bottle to minimize the effects of ultraviolet light on the materials inside, especially the highly unsaturated actives (the absorbers can also be on the surface). The overall effect of the clarity and the container being to demonstrate the clarity of the compositions, thus assuring the consumer of the quality of the product.

What is claimed is:

1. An aqueous, stable, fabric softener composition comprising:

(A) a fabric softener active selected from the group consisting of:

(1) softener having the formula:

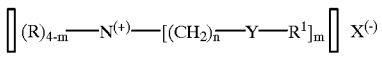

wherein each R substituent is a short chain $C_1$–$C_6$ alkyl or hydroxyalkyl group, or mixtures thereof; each m is 2 or 3; each n is from 1 to about 4; each Y is —O—(O)C—, or —C(O)—O—; and wherein the counterion $X^-$ is any softener-compatible anion;

(2) softener having the formula:

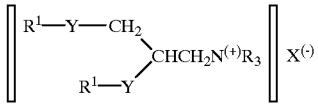

wherein each Y, R, $R^1$, and $X^{(-)}$ have the same meanings as before; and (3) mixtures thereof;

(B) less than about 40% by weight of the composition of principal solvent having a C log P of from about 0.15 to about 0.64, and an asymmetric structure;

(C) optionally, up to about 10% of low molecular weight water soluble solvents selected from the group consisting of: ethanol, isopropanol, propylene glycol, 1,3-propanediol, propylene carbonate, and mixtures thereof; and (D) water;

wherein the molar ratio of said principal solvent to said fabric softener active is at least about 3.

2. The aqueous, stable, fabric softener composition of claim 1 comprising:

A. said fabric softener active,

B. less than about 35% by weight of said principal solvent, said principal solvent being selected from the group consisting of:

I. hexane diol isomers selected from the group consisting of: 2,3-butanediol, 2,3-dimethyl-; 1,2-butanediol, 2,3-dimethyl-; 1,2-butanediol, 3,3-dimethyl-; 2,3-pentanediol, 2-methyl-; 2,3-pentanediol, 3-methyl-; 2,3-pentanediol, 4-methyl-; 2,3-hexanediol; 3,4-hexanediol; 1,2-butanediol, 2-ethyl-; 1,2-pentanediol, 2-methyl-; 1,2-pentanediol, 3-methyl-; 1,2-pentanediol, 4-methyl-; 1,2-hexanediol; and mixtures thereof;

II. heptane diol isomers selected from the group consisting of: 1,3-propanediol, 2-butyl-; 1,3-propanediol, 2,2-diethyl-; 1,3-propanediol, 2-(1-methylpropyl)-; 1,3-propanediol, 2-(2-methylpropyl)-; 1,3-propanediol, 2-methyl-2-propyl-; 1,2-butanediol, 2,3,3-trimethyl-; 1,4-butanediol, 2-ethyl-2-methyl-; 1,4-butanediol, 2-ethyl-3-methyl-; 1,4-butanediol, 2 -propyl-; 1,4-butanediol, 2-isopropyl-; 1,5-pentanediol, 2,2-dimethyl-; 1,5-pentanediol, 2,3-dimethyl-; 1,5-pentanediol, 2,4-dimethyl-; 1,5-pentanediol, 3,3-dimethyl-; 2,3-pentanediol, 2,3-dimethyl-; 2,3-pentanediol, 2,4-dimethyl-; 2,3-pentanediol, 3,4-dimethyl-; 2,3-pentanediol, 4,4-dimethyl-; 3,4-pentanediol, 2,3-dimethyl-; 1,5-pentanediol, 2-ethyl-; 1,6-hexanediol, 2-methyl-; 1,6-hexanediol, 3-methyl-; 2,3-hexanediol, 2-methyl-; 2,3-hexanediol, 3-methyl-; 2,3-hexanediol, 4-methyl-; 2,3-hexanediol, 5-methyl-; 3,4-hexanediol, 2-methyl-; 3,4-hexanediol, 3-methyl-; 1,3-heptanediol; 1,4-heptanediol; 1,5-heptanediol; 1,6-heptanediol; and mixtures thereof;

III. octane diol isomers selected from the group consisting of: 1,3-propanediol, 2-(2-methylbutyl)-; 1,3-propanediol, 2-(1,1-dimethylpropyl)-1,3-propanediol, 2-(1,2-dimethylpropyl)-; 1,3-propanediol, 2-(1-ethylpropyl)-; 1,3-propanediol, 2-(1-methylbutyl)-; 1,3-propanediol, 2-(2,2-dimethylpropyl)-; 1,3-propanediol, 2-(3-methylbutyl)-; 1,3-propanediol, 2-butyl-2-methyl-; 1,3-propanediol, 2-ethyl-2-isopropyl-; 1,3-propanediol, 2-ethyl-2-propyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2,2-diethyl-; 1,3-butanediol, 2-(1-methylpropyl)-; 1,3-butanediol, 2-butyl-; 1,3-butanediol, 2-ethyl-2,3-dimethyl-; 1,3-butanediol, 2-(1,1-dimethylethyl)-; 1,3-butanediol, 2-(2-methylpropyl)-; 1,3-butanediol, 2-methyl-2-isopropyl-; 1,3-butanediol, 2-methyl-2-propyl-; 1,3-butanediol, 3-methyl-2-isopropyl-; 1,3-butanediol, 3-methyl-2-propyl-; 1,4-butanediol, 2,2-diethyl-; 1,4-butanediol, 2-methyl-2-propyl-; 1,4-butanediol, 2-(1-methylpropyl)-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,4-butanediol, 2-(2-methylpropyl)-; 1,4-butanediol, 2-methyl-3-propyl-; 1,4-butanediol, 3-methyl-2-isopropyl-; 1,3-pentanediol, 2,2,3-trimethyl-; 1,3-pentanediol, 2,2,4-trimethyl-; 1,3-pentanediol, 2,3,4-trimethyl-; 1,3-pentanediol, 2,4,4-trimethyl-; 1,3-pentanediol, 3,4,4-trimethyl-; 1,4-pentanediol, 2,2,3-trimethyl-; 1,4-pentanediol, 2,2,4-trimethyl-; 1,4-pentanediol, 2,3,3-trimethyl-; 1,4-pentanediol, 2,3,4-trimethyl-; 1,4-pentanediol, 3,3,4-trimethyl-; 1,5-pentanediol, 2,2,3-trimethyl-; 1,5-pentanediol, 2,2,4-trimethyl-; 1,5-pentanediol, 2,3,3-trimethyl-; 1,5-pentanediol, 2,3,4-trimethyl-; 2,4-pentanediol, 2,3,3-trimethyl-; 2,4-pentanediol, 2,3,4-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,4-pentanediol, 3-ethyl-2-methyl-; 1,4-pentanediol, 3-ethyl-3-methyl-; 1,5-pentanediol, 2-ethyl-2-methyl-; 1,5-pentanediol, 2-ethyl-3-methyl-; 1,5-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 1,5-pentanediol, 2-isopropyl-; 2,4-pentanediol, 3-propyl-; 1,3 -hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,3-hexanediol, 4,4-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 1,6-hexanediol, 2,2-dimethyl-; 1,6-hexanediol, 2,3-dimethyl-; 1,6-hexanediol, 2,4-dimethyl-; 1,6-hexanediol, 2,5-dimethyl-; 1,6-hexanediol, 3,3-dimethyl-; 1,6-hexanediol, 3,4-dimethyl-; 2,4-hexanediol, 2,3-dimethyl-; 2,4-hexanediol, 2,4-dimethyl-; 2,4-hexanediol, 2,5-dimethyl-; 2,4-hexanediol, 3,3-dimethyl-; 2,4-hexanediol, 3,4-dimethyl-; 2,4-hexanediol, 3,5-dimethyl-; 2,4-hexanediol, 4,5-dimethyl-; 2,4-hexanediol, 5,5-dimethyl-; 2,5-hexanediol, 2,3-dimethyl-; 2,5-hexanediol, 2,4-dimethyl-; 2,5-hexanediol, 2,5-dimethyl-; 2,5-hexanediol, 3,3-dimethyl-; 2,5-hexanediol, 3,4-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 1,5-heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 3-methyl-; 3,5-heptanediol, 4-methyl-; 2,4-octanediol; 2,5-octanediol; 2,6-octanediol; 2,7-octanediol; 3,5-octanediol; 3,6-octanediol; and mixtures thereof;

IV. nonane diol isomers selected from the group consisting of: 2,4-pentanediol, 2,3,3,4-tetramethyl-; 2,4-pentanediol, 3-tertiarybutyl-; 2,4-hexanediol, 2,5,5-trimethyl-; 2,4-hexanediol, 3,3,4-trimethyl-; 2,4-hexanediol, 3,3,5-trimethyl-; 2,4-hexanediol, 3,5,5-trimethyl-; 2,4-hexanediol, 4,5,5-trimethyl-; 2,5-hexanediol, 3,3,4-trimethyl-; 2,5-hexanediol, 3,3,5-trimethyl-; and mixtures thereof; and V mixtures thereof;

C. optionally, up to about 10% of low molecular weight water soluble solvents selected from the group consisting of: ethanol, isopropanol, propylene glycol, 1,3-propanediol, propylene carbonate, and mixtures thereof; and D. the balance being water, wherein molar ratio of said principal solvent to said fabric softener active is from about 3.6 to about 50.

3. The aqueous, stable, fabric softener composition of claim 2 wherein the molar ratio of said principal solvent to said fabric softener active is from about 4 to about 25.

4. The aqueous, stable, fabric softener composition of claim 1 comprising:

from about 1% to about 10% of low molecular weight water soluble solvents selected from the group consisting of: ethanol, isopropanol, propylene glycol, 1,3-propanediol, propylene carbonate, and mixtures thereof.

5. The composition of claim 4 wherein said principal solvent comprises compounds selected from the group consisting of: 1,2-hexanediol; 2,2,4-trimethyl-1,3-pentanediol; 2,2,4-trimethyl-1,3-pentanediol (EO); and mixtures thereof; wherein each EO is a —$(CH_2CH_2O)H$ group.

6. The composition of claim 2 wherein said principal solvent comprises compounds selected from the group consisting of: 1,2-hexanediol; 2,2,4-trimethyl-1,3-pentanediol; 2,2,4-trimethyl-1,3-pentanediol (EO); an mixtures thereof; wherein each EO is a —$(CH_2CH_2O)H$ group.

7. The composition of claim 1 wherein said fabric softener active (A) is fabric softener active selected from the group consisting of:

softener having the formula:

$$\left[(R)_{4-m}—N^{(+)}—[(CH_2)_n—Y—R^1]_m\right] X^{(-)}$$

wherein each R substituent is a short chain $C_1$–$C_2$ alkyl or hydroxyalkyl group, or mixtures thereof; each m is 2 or 3; each n is from 1 to about 4; each Y is —O—(O)C; a total number of carbon atoms in each $YR^1$ moiety is from 6 to 22; and wherein no greater than one $YR^1$ moiety has less than about 12 carbon atoms; and at least one $YR^1$ moiety has at least about 16 carbon atoms; and wherein the counterion $X^-$ is selected from the group consisting of chloride, methylsulfate, sulfate, nitrate, and mixtures thereof.

8. The composition of claim 7 wherein each R is methyl and $X^-$ is selected from the group consisting of chloride, sulfate, methylsulfate, and mixtures thereof.

9. The composition of claim 7 wherein R is hydroxyethyl and $X^-$ is methyl sulfate.

10. The composition of claim 1 wherein said principal solvent is selected from the group consisting of:

(I) mono-ols selected from the group consisting of:

(a) 2-butanol;

(b) 2-methyl-1-propanol;

(c) 2-methyl-2-propanol; and (d) mixtures thereof;

(II) hexane diol isomers selected from the group consisting of: 2,3-butanediol, 2,3-dimethyl-; 1,2-butanediol, 2,3-dimethyl-; 1,2-butanediol, 3,3-dimethyl-; 2,3-pentanediol, 2-methyl-; 2,3-pentanediol, 3-methyl-; 2,3-pentanediol, 4-methyl-; 2,3-hexanediol;, 3,4-hexanediol; 1,2-butanediol, 2-ethyl-; 1,2-pentanediol, 2-methyl-; 1,2-pentanediol, 3-methyl-; 1,2-pentanediol, 4-methyl-; 1,2-hexanediol; and mixtures thereof;

(III) heptane diol isomers selected from the group consisting of: 1,3-propanediol, 2-butyl-; 1,3-propanediol, 2,2-diethyl-; 1,3-propanediol, 2-(1-methylpropyl)-; 1,3-propanediol, 2-(2-methylpropyl)-; 1,3-propanediol, 2-methyl-2-propyl-; 1,2-butanediol, 2,3,3-trimethyl-; 1,4-butanediol, 2-ethyl-2-methyl-; 1,4-butanediol, 2-ethyl-3-methyl-; 1,4-butanediol, 2-propyl-; 1,4-butanediol, 2-isopropyl-; 1,5-pentanediol, 2,2-dimethyl-; 1,5-pentanediol, 2,3-dimethyl-; 1,5-pentanediol, 2,4-dimethyl-; 1,5-pentanediol, 3,3-dimethyl-; 2,3-pentanediol, 2,3-dimethyl-; 2,3-pentanediol, 2,4-dimethyl-; 2,3-pentanediol, 3,4-dimethyl-; 2,3-pentanediol, 4,4-dimethyl-; 3,4-pentanediol, 2,3-dimethyl-; 1,5-pentanediol, 2-ethyl-; 1,6-hexanediol, 2-methyl-; 1,6-hexanediol, 3-methyl-; 2,3-hexanediol, 2-methyl-; 2,3-hexanediol, 3-methyl-; 2,3-hexanediol, 4-methyl-; 2,3-hexanediol, 5-methyl-; 3,4-hexanediol, 2-methyl-; 3,4-hexanediol, 3-methyl-; 1,3-heptanediol; 1,4-heptanediol; 1,5-heptanediol; 1,6-heptanediol; and mixtures thereof;

(IV) octane diol isomers selected from the group consisting of: 1,3-propanediol, 2-(2-methylbutyl)-; 1,3-propanediol, 2-(1,1-dimethylpropyl)-1,3-propanediol, 2-(1,2-dimethylpropyl)-; 1,3-propanediol, 2-(1-ethylpropyl)-; 1,3-propanediol, 2-(1-methylbutyl)-; 1,3-propanediol, 2-(2,2-dimethylpropyl)-; 1,3-propanediol, 2-(3-methylbutyl)-; 1,3-propanediol, 2-butyl-2-methyl-; 1,3-propanediol, 2-ethyl-2-isopropyl-; 1,3-propanediol, 2-ethyl-2-propyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2,2-diethyl-; 1,3-butanediol, 2-(1-methylpropyl)-; 1,3-butanediol, 2-butyl-; 1,3-butanediol, 2-ethyl-2,3-dimethyl-; 1,3-butanediol, 2-(1,1-dimethylethyl)-; 1,3-butanediol, 2-(2-methylpropyl)-; 1,3-butanediol, 2-methyl-2-isopropyl-; 1,3-butanediol, 2-methyl-2-propyl-; 1,3-butanediol, 3-methyl-2-isopropyl-; 1,3-butanediol, 3-methyl-2-propyl-; 1,4-butanediol, 2,2-diethyl-; 1,4-butanediol, 2-methyl-2-propyl-; 1,4-butanediol, 2-(1-methylpropyl)-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,4-butanediol, 2-(2-methylpropyl)-; 1,4-butanediol, 2-methyl-3-propyl-; 1,4-butanediol, 3-methyl-2-isopropyl-; 1,3-pentanediol, 2,2,3-trimethyl-; 1,3 -pentanediol, 2,2,4-trimethyl-; 1,3-pentanediol, 2,3,4-trimethyl-; 1,3-pentanediol, 2,4,4-trimethyl-; 1,3-pentanediol, 3,4,4-trimethyl-; 1,4-pentanediol, 2,2,3-trimethyl-; 1,4-pentanediol, 2,2,4-trimethyl-; 1,4-pentanediol, 2,3,3-trimethyl-; 1,4-pentanediol, 2,3,4-trimethyl-; 1,4-pentanediol, 3,3,4-trimethyl-; 1,5-pentanediol, 2,2,3-trimethyl-; 1,5-pentanediol, 2,2,4-trimethyl-; 1,5-pentanediol, 2,3,3-trimethyl-; 1,5-pentanediol, 2,3,4-trimethyl-; 2,4-pentanediol, 2,3,3-trimethyl-; 2,4-pentanediol, 2,3,4-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,4-pentanediol, 3-ethyl-2-methyl-; 1,4-pentanediol, 3-ethyl-3-methyl-; 1,5-pentanediol, 2-ethyl-2-methyl-; 1,5-pentanediol, 2-ethyl-3-methyl-; 1,5-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 1,5-pentanediol, 2-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,3-hexanediol, 4,4-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 1,6-hexanediol, 2,2-dimethyl-; 1,6-hexanediol, 2,3-dimethyl-; 1,6-hexanediol, 2,4-dimethyl-; 1,6-hexanediol, 2,5-dimethyl-; 1,6-hexanediol, 3,3-dimethyl-; 1,6-hexanediol, 3,4-dimethyl-; 2,4-hexanediol, 2,3-dimethyl-; 2,4-hexanediol, 2,4-dimethyl-; 2,4-hexanediol, 2,5-dimethyl-; 2,4-hexanediol, 3,3-dimethyl-; 2,4-hexanediol, 3,4-dimethyl-; 2,4-hexanediol, 3,5-dimethyl-; 2,4-hexanediol, 4,5-dimethyl-; 2,4-hexanediol, 5,5-dimethyl-; 2,5-hexanediol, 2,3-dimethyl-; 2,5-hexanediol, 2,4-dimethyl-; 2,5-hexanediol, 2,5-dimethyl-; 2,5-hexanediol, 3,3-dimethyl-; 2,5-hexanediol, 3,4-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 1,5 -heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 3-methyl-; 3,5-heptanediol, 4-methyl-; 2,4-octanediol; 2,5-octanediol; 2,6-octanediol; 2,7-octanediol; 3,5-octanediol; 3,6-octanediol; and mixtures thereof;

(V) nonane diol isomers selected from the group consisting of: 2,4-pentanediol, 2,3,3,4-tetramethyl-; 2,4-pentanediol, 3-tertiarybutyl-; 2,4-hexanediol, 2,5,5-trimethyl-; 2,4-hexanediol, 3,3,4-trimethyl-; 2,4-hexanediol, 3,3,5-trimethyl-; 2,4-hexanediol, 3,5,5-trimethyl-; 2,4-hexanediol, 4,5,5-trimethyl-; 2,5-hexanediol, 3,3,4-trimethyl-; 2,5-hexanediol, 3,3,5-trimethyl-; and mixtures thereof;

(VI) glyceryl ethers and/or di(hydroxyalkyl)ethers selected from the group consisting of: 1,2-propanediol, 3-(n-pentyloxy)-; 1,2-propanediol, 3-(2-pentyloxy)-; 1,2-propanediol, 3-(3-pentyloxy)-; 1,2-propanediol, 3-(2-methyl-1-butyloxy)-; 1,2-propanediol, 3-(iso-amyloxy)-; 1,2-propanediol, 3-(3-methyl-2-butyloxy)-; 1,2-propanediol, 3-(cyclohexyloxy)-; 1,2-propanediol, 3-(1-cyclohex-1-enyloxy)-; 1,3-propanediol, 2-(pentyloxy)-; 1,3-propanediol, 2-(2-pentyloxy)-; 1,3-propanediol, 2-(3-pentyloxy)-; 1,3-propanediol, 2-(2-methyl-1-butyloxy)-; 1,3-propanediol, 2-(iso-amyloxy)-; 1,3-propanediol, 2-(3-methyl-2-butyloxy)-; 1,3-propanediol, 2-(cyclohexyloxy)-; 1,3-propanediol, 2-(1-cyclohex-1-enyloxy)-; 1,2-propanediol, 3-(butyloxy)-, triethoxylated; 1,2-propanediol, 3-(butyloxy)-, tetraethoxylated; 1,2-propanediol, 3-(butyloxy)-, pentaethoxylated; 1,2-propanediol, 3-(butyloxy)-, hexaethoxylated; 1,2-propanediol, 3-(butyloxy)-, heptaethoxylated; 1,2-propanediol, 3-(butyloxy)-, octaethoxylated; 1,2-propanediol, 3-(butyloxy)-, nonaethoxylated; 1,2-propanediol, 3-(butyloxy)-, monopropoxylated; 1,2-propanediol, 3-(butyloxy)-, dibutyleneoxylated; 1,2-propanediol, 3-(butyloxy)-, tributyleneoxylated; 1,2-propanediol, 3-phenyloxy-; 1,2-propanediol, 3-benzyloxy-; 1,2-propanediol, 3-(2-phenylethyloxy)-; 1,2-propanediol, 3-(1-phenyl-2-propanyloxy)-; 1,3-propanediol, 2-phenyloxy-; 1,3-propanediol, 2-(m-cresyloxy)-; 1,3-propanediol, 2-(p-cresyloxy)-; 1,3-propanediol, -benzyloxy-; 1,3-propanediol, 2-(2-phenylethyloxy)-; 1,3-propanediol, 2-(1-phenylethyloxy)-; bis(2-hydroxybutyl)ether; bis(2-hydroxycyclopentyl)ether; and mixtures thereof;

(VII) saturated and unsaturated alicyclic diols and their derivatives selected from the group consisting of:

(a) saturated diols and their derivatives, selected from the group consisting of: 1-isopropyl-1,2-cyclobutanediol; 3-ethyl-4-methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 2,4,5-trimethyl-1,3-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1,3-dimethyl-1,3-cyclohexanediol; 1,6-dimethyl-1,3-cyclohexanediol; 1-hydroxy-cyclohexaneethanol; 1-hydroxy-cyclohexanemethanol; 1-ethyl-1,3-cyclohexanediol; 1-methyl-1,2-cyclohexanediol; 2,2-dimethyl-1,3-cyclohexanediol; 2,3-dimethyl-1,4-cyclohexanediol; 2,4-dimethyl-1,3-cyclohexanediol;

2,5-dimethyl-1,3-cyclohexanediol; 2,6-dimethyl-1,4-cyclohexanediol; 2-ethyl-1,3-cyclohexanediol; 2-hydroxycyclohexaneethanol; 2-hydroxyethyl-1-cyclohexanol; 2-hydroxymethylcyclohexanol; 3-hydroxyethyl-1-cyclohexanol; 3-hydroxycyclohexaneethanol; 3-hydroxymethylcyclohexanol; 3-methyl-1,2-cyclohexanediol; 4,4-dimethyl-1,3-cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-hydroxymethylcyclohexanol; 4-methyl-1,2-cyclohexanediol; 5,5-dimethyl-1,3-cyclohexanediol; 5-ethyl-1,3-cyclohexanediol; 1,2-cycloheptanediol; 2-methyl-1,3-cycloheptanediol; 2-methyl-1,4-cycloheptanediol; 4-methyl-1,3-cycloheptanediol; 5-methyl-1,3-cycloheptanediol; 5-methyl-1,4-cycloheptanediol; 6-methyl-1,4-cycloheptanediol; 1,3-cyclooctanediol; 1,4-cyclooctanediol; 1,5-cyclooctanediol; 1,2-cyclohexanediol, diethoxylate; 1,2-cyclohexanediol, triethoxylate; 1,2-cyclohexanediol, tetraethoxylate; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; 1,2-cyclohexanediol, monobutylenoxylate; 1,2-cyclohexanediol, dibutylenoxylate; 1,2-cyclohexanediol, tributylenoxylate; and mixtures thereof;

(b) unsaturated alicyclic diols selected from the group consisting of: 1,2-cyclobutanediol, 1-ethenyl-2-ethyl-; 3-cyclobutene-1,2-diol, 1,2,3,4-tetramethyl-; 3-cyclobutene-1,2-diol, 3,4-diethyl-; 3-cyclobutene-1,2-diol, 3-(1,1-dimethylethyl)-; 3-cyclobutene-1,2-diol, 3-butyl-; 1,2-cyclopentanediol, 1,2-dimethyl-4-methylene-; 1,2-cyclopentanediol, 1-ethyl-3-methylene-; 1,2-cyclopentanediol, 4-(1-propenyl); 3-cyclopentene-1,2-diol, 1-ethyl-3-methyl-; 1,2-cyclohexanediol, 1-ethenyl-; 1,2-cyclohexanediol, 1-methyl-3-methylene-; 1,2-cyclohexanediol, 1-methyl-4-methylene-; 1,2-cyclohexanediol, 3-ethenyl-; 1,2-cyclohexanediol, 4-ethenyl-; 3-cyclohexene-1,2-diol, 2,6-dimethyl-; 3-cyclohexene-1,2-diol, 6,6-dimethyl-; 4-cyclohexene-1,2-diol, 3,6-dimethyl-; 4 -cyclohexene-1,2-diol, 4,5-dimethyl-; 3-cyclooctene-1,2-diol; 4-cyclooctene-1,2-diol; 5-cyclooctene-1,2-diol; and mixtures thereof; and (c) mixtures thereof;

(VIII) alkoxylated derivatives of $C_{3-8}$ diols selected from the group consisting of:

1,2-propanediol 2(Me—$E_{1-4}$); 1,2-propanediol $PO_4$; 1,2-propanediol $BO_1$; 1,2-propanediol, 2-methyl-(Me—$E_{4-10}$); 1,2-propanediol, 2-methyl-2(Me—$E_1$); 1,2-propanediol, 2-methyl-$PO_3$; 1,2-propanediol, 2-methyl-n-$BO_{1-2}$; 1,3-propanediol 2(Me—$E_{6-8}$); 1,3-propanediol $PO_{5-6}$; 1,3-propanediol, 2,2-diethyl-$E_{1-7}$; 1,3-propanediol, 2,2-diethyl-$PO_1$; 1,3-propanediol, 2,2-diethyl-n-$BO_{1-2}$; 1,3-propanediol, 2,2-dimethyl-2($MeE_{1-2}$); 1,3-propanediol, 2,2-dimethyl-$PO_{3-4}$; 1,3-propanediol, 2-(1-methylpropyl)-$E_{1-7}$; 1,3-propanediol, 2-(1-methylpropyl)-$PO_1$; 1,3-propanediol, 2-(1-methylpropyl)-n-$BO_{1-2}$; 1,3-propanediol, 2-(2-methylpropyl)-$E_{1-7}$; 1,3-propanediol, 2-(2-methylpropyl)-$PO_1$; 1,3-propanediol, 2-(2-methylpropyl)-n-$BO_{1-2}$; 1,3-propanediol, 2-ethyl-($MeE_{6-10}$); 1,3-propanediol, 2-ethyl-2($MeE_1$); 1,3-propanediol, 2-ethyl-$PO_3$; 1,3-propanediol, 2-ethyl-$BO_1$; 1,3-propanediol, 2-ethyl-2-methyl-($MeE_{1-6}$); 1,3-propanediol, 2-ethyl-2-methyl-$PO_2$; 1,3-propanediol, 2-ethyl-2-methyl-$BO_1$; 1,3-propanediol, 2-isopropyl-($MeE_{1-6}$); 1,3-propanediol, 2-isopropyl-$PO_2$; 1,3-propanediol, 2-isopropyl-$BO_1$; 1,3-propanediol, 2-methyl-2($MeE_{2-5}$); 1,3-propanediol, 2-methyl-$PO_{4-5}$; 1,3-propanediol, 2-methyl-$BO_2$; 1,3-propanediol, 2-methyl-2-isopropyl-$E_{2-9}$; 1,3-propanediol, 2-methyl-2-isopropyl-$PO_1$; 1,3-propanediol, 2-methyl-2-isopropyl-n-$BO_{1-3}$; 1,3-propanediol, 2-methyl-2-propyl-$E_{1-7}$; 1,3-propanediol, 2-methyl-2-propyl-$PO_1$; 1,3-propanediol, 2-methyl-2-propyl-n-$BO_{1-2}$; 1,3-propanediol, 2-propyl-($MeE_{1-4}$); 1,3-propanediol, 2-propyl-$PO_2$; 1,3-propanediol, 2-propyl-$BO_1$;

1,2-butanediol ($MeE_{2-8}$); 1,2-butanediol $PO_{2-3}$; 1,2-butanediol $BO_1$; 1,2-butanediol, 2,3-dimethyl-$E_{1-6}$; 1,2-butanediol, 2,3-dimethyl-n-$BO_{1-2}$; 1,2-butanediol, 2-ethyl-$E_{1-3}$; 1,2-butanediol, 2-ethyl-$BO_1$; 1,2-butanediol, 2-methyl-($MeE_{1-2}$); 1,2-butanediol, 2-methyl-$PO_1$; 1,2-butanediol, 3,3-dimethyl-$E_{1-6}$; 1,2-butanediol, 3,3-dimethyl-$BO_{1-2}$; 1,2-butanediol, 3-methyl-($MeE_{1-2}$); 1,2-butanediol, 3-methyl-PO; 1,3-butanediol 2($MeE_{3-6}$); 1,3-butanediol $PO_5$; 1,3-butanediol $BO_2$; 1,3-butanediol, 2,2,3-trimethyl-($MeE_{1-3}$); 1,3-butanediol, 2,2,3-trimethyl-$PO_{1-2}$; 1,3-butanediol, 2,2-dimethyl-($MeE_{3-8}$); 1,3-butanediol, 2,2-dimethyl-$PO_3$; 1,3-butanediol, 2,3-dimethyl-($MeE_{3-8}$); 1,3-butanediol, 2,3-dimethyl-$PO_3$; 1,3-butanediol, 2-ethyl-($MeE_{1-6}$); 1,3-butanediol, 2-ethyl-$PO_{2-3}$; 1,3-butanediol, 2-ethyl-$BO_1$; 1,3-butanediol, 2-ethyl-2-methyl-($MeE_1$); 1,3-butanediol, 2-ethyl-2-methyl-$PO_1$; 1,3-butanediol, 2-ethyl-2-methyl-n-$BO_{2-4}$; 1,3-butanediol, 2-ethyl-3-methyl-($MeE_1$); 1,3-butanediol, 2-ethyl-3-methyl-$PO_1$; 1,3-butanediol, 2-ethyl-3-methyl-n-$BO_{2-4}$; 1,3-butanediol, 2-isopropyl-($MeE_1$); 1,3-butanediol, 2-isopropyl-$PO_1$; 1,3-butanediol, 2-isopropyl-n-$BO_{2-4}$; 1,3 -butanediol, 2-methyl-2($MeE_{1-3}$); 1,3-butanediol, 2-methyl-$PO_4$; 1,3-butanediol, 2-propyl-$E_{2-9}$; 1,3-butanediol, 2-propyl-$PO_1$; 1,3-butanediol, 2-propyl-n-$BO_{1-3}$; 1,3-butanediol, 3-methyl-2($MeE_{1-3}$); 1,3-butanediol, 3-methyl-$PO_4$; 1,4-butanediol 2($MeE_{2-4}$); 1,4-butanediol $PO_{4-5}$; 1,4-butanediol $BO_2$; 1,4-butanediol, 2,2,3-trimethyl-$E_{2-9}$; 1,4-butanediol, 2,2,3-trimethyl-$PO_1$; 1,4-butanediol, 2,2,3-trimethyl-n-$BO_{1-3}$; 1,4-butanediol, 2,2-dimethyl-($MeE_{1-6}$); 1,4-butanediol, 2,2-dimethyl-$PO_2$; 1,4-butanediol, 2,2-dimethyl-$BO_1$; 1,4-butanediol, 2,3-dimethyl-($MeE_{1-6}$); 1,4-butanediol, 2,3-dimethyl-$PO_2$; 1,4-butanediol, 2,3-dimethyl-$BO_1$; 1,4-butanediol, 2-ethyl-($MeE_{1-4}$); 1,4-butanediol, 2-ethyl-$PO_2$; 1,4-butanediol, 2-ethyl-$BO_1$; 1,4-butanediol, 2-ethyl-2-methyl-$E_{1-7}$; 1,4-butanediol, 2-ethyl-2-methyl-$PO_1$; 1,4-butanediol, 2-ethyl-2-methyl-n-$BO_{1-2}$; 1,4-butanediol, 2-ethyl-3-methyl-$E_{1-7}$; 1,4-butanediol, 2-ethyl-3-methyl-$PO_1$; 1,4-butanediol, 2-ethyl-3-methyl-n-$BO_{1-2}$; 1,4-butanediol, 2-isopropyl-$E_{1-7}$; 1,4-butanediol, 2-isopropyl-$PO_1$; 1,4-butanediol, 2-isopropyl-n-$BO_{1-2}$; 1,4-butanediol, 2-methyl-($MeE_{6-10}$); 1,4-butanediol, 2-methyl-2($MeE_1$); 1,4-butanediol, 2-methyl-$PO_1$; 1,4-butanediol, 2-methyl-$BO_1$; 1,4-butanediol, 2-propyl-$E_{1-5}$; 1,4-butanediol, 2-propyl-n-$BO_{1-2}$; 1,4-butanediol, 3-ethyl-1-methyl-$E_{2-9}$; 1,4-butanediol, 3-ethyl-1-methyl-$PO_1$; 1,4-butanediol, 3-ethyl-1-methyl-n-$BO_{1-3}$; 2,3-butanediol ($MeE_{1-6}$); 2,3-butanediol 2($MeE_1$); 2,3-butanediol $PO_{3-4}$; 2,3-butanediol $BO_1$; 2,3-butanediol, 2,3-dimethyl-$E_{3-9}$; 2,3-butanediol, 2,3-dimethyl-$PO_1$; 2,3-butanediol, 2,3-dimethyl-$BO_{1-3}$; 2,3-butanediol, 2-methyl-(Me$E_{1-5}$); 2,3-butanediol, 2-methyl-2$PO_2$; 2,3-butanediol, 2-methyl-n-$BO_1$; 2,3-butanediol, 2-methyl-$BO_1$;

1,2-pentanediol $E_{3-10}$; 1,2-pentanediol, $PO_1$; 1,2-pentanediol, n-$BO_{2-3}$; 1,2-pentanediol, 2-methyl $E_{1-3}$; 1,2-pentanediol, 2-methyl n-$BO_1$; 1,2-pentanediol, 2-methyl $BO_1$; 1,2-pentanediol, 3-methyl $E_{1-3}$; 1,2-pentanediol, 3-methyl n-$BO_1$; 1,2-pentanediol, 3-methyl $BO_1$; 1,2-pentanediol, 4-methyl $E_{1-3}$; 1,2-pentanediol, 4-methyl n-$BO_1$; 1,2-pentanediol, 4-methyl $BO_1$; 1,3-pentanediol 2(Me—$E_{1-2}$); 1,3-pentanediol $PO_{3-4}$; 1,3-pentanediol, 2,2-dimethyl-(Me—$E_1$); 1,3-pentanediol, 2,2-dimethyl-$PO_1$; 1,3-pentanediol, 2,2-dimethyl-n-$BO_{2-4}$; 1,3-pentanediol, 2,3-dimethyl-(Me—$E_1$); 1,3-pentanediol, 2,3-dimethyl-$PO_1$; 1,3-pentanediol, 2,3-dimethyl-n-$BO_{2-4}$; 1,3-pentanediol, 2,4-dimethyl-(Me—$E_1$); 1,3-pentanediol, 2,4-dimethyl-$PO_1$; 1,3-pentanediol, 2,4-dimethyl-n-$BO_{2-4}$; 1,3-pentanediol, 2-ethyl-$E_{2-9}$; 1,3-pentanediol, 2-ethyl-$PO_1$; 1,3-pentanediol, 2-ethyl-n-$BO_{1-3}$; 1,3-pentanediol, 2-methyl-2(Me—$E_{1-6}$); 1,3-pentanediol, 2-methyl-$PO_{2-3}$; 1,3-pentanediol, 2-methyl-n-$BO_1$; 1,3-pentanediol, 2-methyl-$BO_1$; 1,3-pentanediol, 3,4-dimethyl-(Me—$E_1$); 1,3-pentanediol, 3,4-dimethyl-$PO_1$; 1,3-pentanediol, 3,4-dimethyl-n-$BO_{2-4}$; 1,3-pentanediol, 3-methyl-2(Me—$E_6$); 1,3-pentanediol, 3-methyl-$PO_{2-3}$; 1,3-pentanediol, 3-methyl-n-$BO_1$; 1,3-pentanediol, 3-methyl-$BO_1$; 1,3-pentanediol, 4,4-dimethyl-(Me—$E_1$); 1,3-pentanediol, 4,4-dimethyl-$PO_1$; 1,3-pentanediol, 4,4-dimethyl-n-$BO_{2-4}$; 1,3-pentanediol, 4-methyl-2(Me—$E_{1-6}$); 1,3-pentanediol, 4-methyl-$PO_{2-3}$; 1,3-pentanediol, 4-methyl-$BO_1$; 1,4-pentanediol, 2(Me—$E_{1-2}$); 1,4-pentanediol $PO_{3-4}$; 1,4-pentanediol, 2,2-dimethyl-(Me—$E_1$); 1,4-pentanediol, 2,2-dimethyl-$PO_1$; 1,4-pentanediol, 2,2-dimethyl-n-$BO_{2-4}$; 1,4-pentanediol, 2,3-dimethyl-(Me—$E_1$); 1,4-pentanediol, 2,3-dimethyl-$PO_1$; 1,4-pentanediol, 2,3-dimethyl-n-$BO_{2-4}$; 1,4-pentanediol, 2,4-dimethyl-(Me—$E_1$); 1,4-pentanediol, 2,4-dimethyl-$PO_1$; 1,4-pentanediol, 2,4-dimethyl-n-$BO_{2-4}$; 1,4-pentanediol, 2-methyl-(Me—$E_{1-6}$); 1,4-pentanediol, 2-methyl-$PO_{2-3}$; 1,4-pentanediol, 2-methyl-n-$BO_1$; 1,4-pentanediol, 2-methyl-$BO_1$; 1,4-pentanediol, 3,3-dimethyl-(Me—$E_1$); 1,4-pentanediol, 3,3-dimethyl-$PO_1$; 1,4-pentanediol, 3,3-dimethyl-n-$BO_{2-4}$; 1,4-pentanediol, 3,4-dimethyl-(Me—$E_1$); 1,4-pentanediol, 3,4-dimethyl-$PO_1$; 1,4-pentanediol, 3,4-dimethyl-n-$BO_{2-4}$; 1,4-pentanediol, 3-methyl-2(Me—$E_{1-6}$); 1,4-pentanediol, 3-methyl-$PO_{2-3}$; 1,4-pentanediol, 3-methyl-$BO_1$; 1,4-pentanediol, 4-methyl-2(Me—$E_{1-6}$); 1,4-pentanediol, 4-methyl-$PO_{2-3}$; 1,4-pentanediol, 4-methyl-$BO_1$; 1,5-pentanediol, (Me—$E_{4-10}$); 1,5-pentanediol 2(Me—$E_1$); 1,5-pentanediol $PO_3$; 1,5-pentanediol, 2,2-dimethyl-$E_{1-7}$; 1,5-pentanediol, 2,2-dimethyl-$PO_1$; 1,5-pentanediol, 2,2-dimethyl-n-$BO_{1-2}$; 1,5-pentanediol, 2,3-dimethyl-$E_{1-7}$; 1,5-pentanediol, 2,3-dimethyl-$PO_1$; 1,5-pentanediol, 2,3-dimethyl-n-$BO_{1-2}$; 1,5-pentanediol, 2,4-dimethyl-$E_{1-7}$; 1,5-pentanediol, 2,4-dimethyl-$PO_1$; 1,5-pentanediol, 2,4-dimethyl-n-$BO_{1-2}$; 1,5-pentanediol, 2-ethyl-$E_{1-5}$; 1,5-pentanediol, 2-ethyl-n-$BO_{1-2}$; 1,5-pentanediol, 2-methyl-(Me—$E_{1-4}$); 1,5-pentanediol, 2-methyl-$PO_2$; 1,5-pentanediol, 3,3-dimethyl-$E_{1-7}$; 1,5-pentanediol, 3,3-dimethyl-$PO_1$; 1,5-pentanediol, 3,3-dimethyl-n-$BO_{1-2}$; 1,5-pentanediol, 3-methyl-(Me—$E_{1-4}$); 1,5-pentanediol, 3-methyl-$PO_2$; 2,3-pentanediol, (Me— $E_{1-3}$); 2,3-pentanediol, $PO_2$; 2,3-pentanediol, 2-methyl-$E_{1-7}$; 2,3-pentanediol, 2-methyl-$PO_1$; 2,3-pentanediol, 2-methyl-n-$BO_{1-2}$; 2,3-pentanediol, 3-methyl-$E_{1-7}$; 2,3-pentanediol, 3-methyl-$PO_1$; 2,3-pentanediol, 3-methyl-n-$BO_{1-2}$; 2,3-pentanediol, 4-methyl-$E_{1-7}$; 2,3-pentanediol, 4-methyl-$PO_1$; 2,3-pentanediol, 4-methyl-n-$BO_{1-2}$; 2,4-pentanediol, 2(Me—$E_{1-4}$); 2,4-pentanediol $PO_4$; 2,4-pentanediol, 2,3-dimethyl-(Me—$E_{1-4}$); 2,4-pentanediol, 2,3-dimethyl-$PO_2$; 2,4-pentanediol, 2,4-dimethyl-(Me—$E_{1-4}$); 2,4-pentanediol, 2,4-dimethyl-$PO_2$; 2,4-pentanediol, 2-methyl-(Me—$E_{5-10}$); 2,4-pentanediol, 2-methyl-$PO_3$; 2,4-pentanediol, 3,3-dimethyl-(Me—$E_{1-4}$); 2,4-pentanediol, 3,3-dimethyl-$PO_2$; 2,4-pentanediol, 3-methyl-(Me—$E_{5-10}$); 2,4-pentanediol, 3-methyl-$PO_3$;

1,3-hexanediol (Me—$E_{1-5}$); 1,3-hexanediol $PO_2$; 1,3-hexanediol $BO_1$; 1,3-hexanediol, 2-methyl-$E_{2-9}$; 1,3-hexanediol, 2-methyl-$PO_1$; 1,3-hexanediol, 2-methyl-n-$BO_{1-3}$; 1,3-hexanediol, 2-methyl-$BO_1$; 1,3-hexanediol, 3-methyl-$E_{2-9}$; 1,3-hexanediol, 3-methyl-$PO_1$; 1,3-hexanediol, 3-methyl-n-$BO_{1-3}$; 1,3-hexanediol, 4-methyl-$E_{2-9}$; 1,3-hexanediol, 4-methyl-$PO_1$; 1,3-hexanediol, 4-methyl-n-$BO_{1-3}$; 1,3-hexanediol, 5 -methyl-$E_{2-9}$; 1,3-hexanediol, 5-methyl-$PO_1$; 1,3-hexanediol, 5-methyl-n-$BO_{1-3}$; 1,4-hexanediol (Me—$E_{1-5}$); 1,4-hexanediol $PO_2$; 1,4-hexanediol $BO_1$; 1,4-hexanediol, 2-methyl-$E_{2-9}$; 1,4-hexanediol, 2-methyl-$PO_1$; 1,4-hexanediol, 2-methyl-n-$BO_{1-3}$; 1,4-hexanediol, 3-methyl-$E_{2-9}$; 1,4-hexanediol, 3-methyl-$PO_1$; 1,4-hexanediol, 3-methyl-n-$BO_{1-3}$; 1,4-hexanediol, 4-methyl-$E_{2-9}$; 1,4-hexanediol, 4-methyl-$PO_1$; 1,4-hexanediol, 4-methyl-n-$BO_{1-3}$; 1,4-hexanediol, 5-methyl-$E_{2-9}$; 1,4-hexanediol, 5-methyl-$PO_1$; 1,4-hexanediol, 5-methyl-n-$BO_{1-3}$; 1,5-hexanediol (Me—$E_{1-5}$); 1,5-hexanediol $PO_2$; 1,5-hexanediol $BO_1$; 1,5-hexanediol, 2-methyl-$E_{2-9}$; 1,5-hexanediol, 2-methyl-$PO_1$; 1,5-hexanediol, 2-methyl-n-$BO_{1-3}$; 1,5-hexanediol, 3-methyl-$E_{2-9}$; 1,5-hexanediol, 3-methyl-$PO_1$; 1,5-hexanediol, 3-methyl-n-$BO_{1-3}$; 1,5-hexanediol, 4-methyl-$E_{2-9}$; 1,5-hexanediol, 4-methyl-$PO_1$; 1,5-hexanediol, 4-methyl-n-$BO_{1-3}$; 1,5-hexanediol, 5-methyl-$E_{2-9}$; 1,5-hexanediol, 5-methyl-$PO_1$; 1,5-hexanediol, 5-methyl-n-$BO_{1-3}$; 1,6-hexanediol (Me—$E_{1-2}$); 1,6-hexanediol $PO_{1-2}$; 1,6-hexanediol n-$BO_4$; 1,6-hexanediol, 2-methyl-$E_{1-5}$; 1,6-hexanediol, 2-methyl-n-$BO_{1-2}$; 1,6-hexanediol, 3-methyl-$E_{1-5}$; 1,6-hexanediol, 3-methyl-n-$BO_{1-2}$; 2,3-hexanediol $E_{1-5}$; 2,3-hexanediol n-$BO_1$; 2,3-hexanediol $BO_1$; 2,4-hexanediol (Me—$E_{3-8}$); 2,4-hexanediol $PO_3$; 2,4-hexanediol, 2-methyl-(Me—$E_{1-2}$); 2,4-hexanediol 2-methyl-$PO_{1-2}$; 2,4-hexanediol, 3-methyl-(Me—$E_{1-2}$); 2,4-hexanediol 3-methyl-$PO_{1-2}$; 2,4-hexanediol, 4-methyl-(Me—$E_{1-2}$); 2,4-hexanediol 4-methyl-$PO_{1-2}$; 2,4-hexanediol, 5-methyl-(Me—$E_{1-2}$); 2,4-hexanediol 5-methyl-$PO_{1-2}$; 2,5-hexanediol (Me—$E_{3-8}$); 2,5-hexanediol $PO_3$; 2,5-hexanediol, 2-methyl-(Me—$E_{1-2}$); 2,5-hexanediol 2-methyl-$PO_{1-2}$; 2,5-hexanediol, 3-methyl-(Me—$E_{1-2}$); 2,5-hexanediol 3-methyl-$PO_{1-2}$; 3,4-hexanediol $E_{1-5}$; 3,4-hexanediol n-$BO_1$; 3,4-hexanediol $BO_1$;

1,3-heptanediol $E_{1-7}$; 1,3-heptanediol $PO_1$; 1,3-heptanediol n-$BO_{1-2}$; 1,4-heptanediol $E_{1-7}$; 1,4-heptanediol $PO_1$; 1,4-heptanediol n-$BO_{1-2}$; 1,5-heptanediol $E_{1-7}$; 1,5-heptanediol $PO_1$; 1,5-heptanediol n-$BO_{1-2}$; 1,6-heptanediol $E_{1-7}$; 1,6-heptanediol $PO_1$; 1,6-heptanediol n-$BO_{1-2}$; 1,7-heptanediol $E_{1-2}$; 1,7-heptanediol n-$BO_1$; 2,4-heptanediol $E_{3-10}$; 2,4-heptanediol (Me—$E_1$); 2,4-heptanediol $PO_1$; 2,4-heptanediol n-$BO_3$; 2,5-heptanediol $E_{3-10}$; 2,5-heptanediol (Me—$E_1$); 2,5-heptanediol $PO_1$; 2,5-heptanediol n-$BO_3$; 2,6-heptanediol $E_{3-10}$; 2,6-heptanediol (Me—$E_1$); 2,6-heptanediol $PO_1$; 2,6-heptanediol n-$BO_3$; 3,5-heptanediol $E_{3-10}$; 3,5-heptanediol (Me—$E_1$); 3,5-heptanediol $PO_1$; 3,5-heptanediol n-$BO_3$;

1,3-butanediol, 3-methyl-2-isopropyl-PO; 2,4-pentanediol, 2,3,3-trimethyl-PO; 1,3-butanediol, 2,2-diethyl-$E_{2-5}$; 2,4-hexanediol, 2,3-dimethyl-$E_{2-5}$; 2,4-hexanediol, 2,4-dimethyl-$E_{2-5}$; 2,4-hexanediol, 2,5-dimethyl-$E_{2-5}$; 2,4-hexanediol, 3,3-dimethyl-$E_{2-5}$; 2,4-hexanediol, 3,4-dimethyl-$E_{2-5}$; 2,4-hexanediol, 3,5-dimethyl-$E_{2-5}$; 2,4-hexanediol, 4,5-dimethyl-$E_{2-5}$; 2,4-hexanediol, 5,5-dimethyl-$E_{2-5}$; 2,5-hexanediol, 2,3-dimethyl-$E_{2-5}$; 2,5-hexanediol, 2,4-dimethyl-$E_{2-5}$; 2,5-hexanediol, 2,5-dimethyl-E $_{2-5}$; 2,5-hexanediol, 3,3-dimethyl-$E_{2-5}$; 2,5-hexanediol, 3,4-dimethyl-$E_{2-5}$; 3,5-heptanediol, 3-methyl-$E_{2-5}$; 1,3-butanediol, 2,2-diethyl-n-$BO_{1-2}$; 2,4-hexanediol, 2,3-dimethyl-n-$BO_{1-2}$; 2,4-hexanediol, 2,4-dimethyl-n-$BO_{1-2}$; 2,4-hexanediol, 2,5-dimethyl-n-$BO_{1-2}$; 2,4-hexanediol, 3,3-dimethyl-n-$BO_{1-2}$; 2,4-hexanediol, 3,4-dimethyl-n-$BO_{1-2}$; 2,4-hexanediol, 3,5-dimethyl-n-$BO_{1-2}$; 2,4-hexanediol, 4,5-dimethyl-n-$BO_{1-2}$; 2,4-hexanediol, 5,5-dimethyl-n-$BO_{1-2}$; 2,5-hexanediol, 2,3-dimethyl-n-$BO_{1-2}$; 2,5-hexanediol, 2,4-dimethyl-n-$BO_{1-2}$; 2,5-hexanediol, 2,5-dimethyl-n-$BO_{1-2}$; 2,5-hexanediol, 3,3-dimethyl-n-$BO_{1-2}$; 2,5-hexanediol, 3,4-dimethyl-n-$BO_{1-2}$; 3,5-heptanediol, 3-methyl-n-$BO_{1-2}$; 1,3-propanediol, 2-(1,2-dimethylpropyl)-n-BO; 1,3-butanediol, 2-ethyl-2,3-dimethyl-n-BO; 1,3-butanediol, 2-methyl-2-isopropyl-n-BO; 1,4-butanediol, 3-methyl-2-isopropyl-n-BO; 1,3-pentanediol, 2,2,3-trimethyl-n-BO; 1,3-pentanediol, 2,2,4-trimethyl-n-BO; 1,3-pentanediol, 2,4,4-trimethyl-n-BO; 1,3-pentanediol, 3,4,4-trimethyl-n-BO; 1,4-pentanediol, 2,2,3-trimethyl-n-BO; 1,4-pentanediol, 2,2,4-trimethyl-n-BO; 1,4-pentanediol, 2,3,3-trimethyl-n-BO; 1,4-pentanediol, 3,3,4-trimethyl-n-BO; 2,4-pentanediol, 2,3,4-trimethyl-n-BO; 2,4-hexanediol, 4-ethyl-n-BO; 2,4-heptanediol, 2-methyl-n-BO; 2,4-heptanediol, 3-methyl-n-BO; 2,4-heptanediol, 4-methyl-n-BO; 2,4-heptanediol, 5-methyl-n-BO; 2,4-heptanediol, 6-methyl-n-BO; 2,5-heptanediol, 2-methyl-n-BO; 2,5-heptanediol, 3-methyl-n-BO; 2,5-heptanediol, 4-methyl-n-BO; 2,5-heptanediol, 5-methyl-n-BO; 2,5-heptanediol, 6-methyl-n-BO; 2,6-heptanediol, 2-methyl-n-BO; 2,6-heptanediol, 3-methyl-n-BO; 2,6-heptanediol, 4-methyl-n-BO; 3,5-heptanediol, 2-methyl-n-BO; 1,3-propanediol, 2-(1,2-dimethylpropyl)-$E_{1-3}$; 1,3-butanediol, 2-ethyl-2,3-dimethyl-$E_{1-3}$; 1,3-butanediol, 2-methyl-2-isopropyl-$E_{1-3}$; 1,4-butanediol, 3-methyl-2-isopropyl-$E_{1-3}$; 1,3-pentanediol, 2,2,3-trimethyl-$E_{1-3}$; 1,3-pentanediol, 2,2,4-trimethyl-$E_{1-3}$; 1,3-pentanediol, 2,4,4-trimethyl-$E_{1-3}$; 1,3-pentanediol, 3,4,4-trimethyl-$E_{1-3}$; 1,4-pentanediol, 2,2,3-trimethyl-$E_{1-3}$; 1,4-pentanediol, 2,2,4-trimethyl-$E_{1-3}$; 1,4-pentanediol, 2,3,3-trimethyl-$E_{1-3}$; 1,4-pentanediol, 3,3,4-trimethyl-$E_{1\ 3}$; 2,4-pentanediol, 2,3,4-trimethyl-$E_{1-3}$; 2,4-hexanediol, 4-ethyl-$E_{1-3}$; 2,4-heptanediol, 2-methyl-$E_{1-3}$; 2,4-heptanediol, 3-methyl-$E_{1-3}$; 2,4-heptanediol, 4-methyl-$E_{1-3}$; 2,4-heptanediol, 5-methyl-$E_{1-3}$; 2,4-heptanediol, 6-methyl-$E_{1-3}$; 2,5-heptanediol, 2-methyl-$E_{1-3}$; 2,5-heptanediol, 3-methyl-$E_{1-3}$; 2,5-heptanediol, 4-methyl-$E_{1-3}$; 2,5-heptanediol, 5-methyl-$E_{1-3}$; 2,5-heptanediol, 6-methyl-$E_{1-3}$; 2,6-heptanediol, 2-methyl-$E_{1-3}$; 2,6-heptanediol, 3-methyl-$E_{1-3}$; 2,6-heptanediol, 4-methyl-$E_{1-3}$; 3,5-heptanediol, 2-methyl-$E_{1-3}$; and mixtures thereof;

(IX) aromatic diols selected from the group consisting of: 1-phenyl-1,2-ethanediol; 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl- 1,3-propanediol; 1-phenyl-1,3-butanediol; 3-phenyl-1,3-butanediol; 1-phenyl-1,4-butanediol; 2-phenyl-1,4-butanediol; 1-phenyl-2,3-butanediol; and mixtures thereof;

(X) principal solvents which are homologs, or analogs, of said principal solvents of groups (I) to (IX), and have a C log P value of from about 0.15 to about 0.64, where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant, selected from the group consisting of: 1,3-Propanediol, 2,2-di-2-propenyl-; 1,3-Propanediol, 2-(1-pentenyl)-; 1,3-Propanediol, 2-(2-methyl-2-propenyl)-2-(2-propenyl)-; 1,3-Propanediol, 2-(3-methyl-1-butenyl)-; 1,3-Propanediol, 2-(4-pentenyl)-; 1,3-Propanediol, 2-ethyl-2-(2-methyl-2-propenyl)-; 1,3-Propanediol, 2-ethyl-2-(2-propenyl)-; 1,3-Propanediol, 2-methyl-2-(3-methyl-3-butenyl)-; 1,3-Butanediol, 2,2-diallyl-; 1,3-Butanediol, 2-(1-ethyl-1-propenyl)-; 1,3-Butanediol, 2-(2-butenyl)-2-methyl-; 1,3-Butanediol, 2-(3-methyl-2-butenyl)-; 1,3-Butanediol, 2-ethyl-2-(2-propenyl)-; 1,3-Butanediol, 2-methyl-2-(1-methyl-2-propenyl)-; 1,4-Butanediol, 2,3-bis(1-methylethylidene)-; 1,4-Butanediol, 2-(3-methyl-2-butenyl)-3-methylene-; 2-Butene-1,4-diol, 2-(1,1-dimethylpropyl)-; 2-Butene-1,4-diol, 2-(1-methylpropyl)-; 2-Butene-1,4-diol, 2-butyl-; 1,3-Pentanediol, 2-ethenyl-3-ethyl-; 1,3-Pentanediol, 2-ethenyl-4,4-dimethyl-; 1,4-Pentanediol, 3-methyl-2-(2-propenyl)-; 1,5-Pentanediol, 2-(1-propenyl)-; 1,5-Pentanediol, 2-(2-propenyl)-; 1,5-Pentanediol, 2-ethylidene-3-methyl-; 1,5-Pentanediol, 2-propylidene-; 2,4-Pentanediol, 3-ethylidene-2,4-dimethyl-; 4-Pentene-1,3-diol, 2-(1,1-dimethylethyl)-; 4-Pentene-1,3-diol, 2-ethyl-2,3-dimethyl-; 1,4-Hexanediol, 4-ethyl-2-methylene-; 1,5-Hexadiene-3,4-diol, 2,3,5-trimethyl-; 1,5-Hexadiene-3,4-diol, 5-ethyl-3-methyl-; 1,5-Hexanediol, 2-(1-methylethenyl)-; 1,6-Hexanediol, 2-ethenyl-; 1-Hexene-3,4-diol, 5,5-dimethyl-; 1-Hexene-3,4-diol, 5,5-dimethyl-; 2-Hexene-1,5-diol, 4-ethenyl-2, 5-dimethyl-; 3-Hexene-1,6-diol, 2-ethenyl-2,5-dimethyl-; 3-Hexene-1,6-diol, 2-ethyl-; 3-Hexene-1,6-diol, 3,4-dimethyl-; 4-Hexene-2,3-diol, 2,5-dimethyl-; 4-Hexene-2,3-diol, 3,4-dimethyl-; 5-Hexene-1,3-diol, 3-(2-propenyl)-; 5-Hexene-2,3-diol, 2,3-dimethyl-; 5-Hexene-2,3-diol, 3,4-dimethyl-; 5-Hexene-2,3-diol, 3,5-dimethyl-; 5-Hexene-2,4-diol, 3-ethenyl-2,5-dimethyl-; 1,4-Heptanediol, 6-methyl-5-methylene-; 1,5-Heptadiene-3,4-diol, 2,3-dimethyl-; 1,5-Heptadiene-3,4-diol, 2,5-dimethyl-; 1,5-Heptadiene-3,4-diol, 3,5-dimethyl-; 1,7-Heptanediol, 2,6-bis(methylene)-; 1,7-Heptanediol, 4-methylene-; 1-Heptene-3,5-diol, 2,4-dimethyl-; 1-Heptene-3,5-diol, 2,6-dimethyl-; 1-Heptene-3,5-diol, 3-ethenyl-5-methyl; 1-Heptene-3,5-diol, 6,6-dimethyl-; 2,4-Heptadiene-2,6-diol, 4,6-dimethyl-; 2,5-Heptadiene-1,7-diol, 4,4-dimethyl-; 2,6-Heptadiene-1,4-diol, 2,5,5-trimethyl-; 2-Heptene-1,4-diol, 5,6-dimethyl-; 2-Heptene-1,5-diol, 5-ethyl-; 2-Heptene-1,7-diol, 2-methyl-; 3-Heptene-1,5-diol, 4,6-dimethyl-; 3-Heptene-1,7-diol, 3-methyl-6-methylene-; 3-Heptene-2,5-diol, 2,4-dimethyl-; 3-Heptene-2,5-diol, 2,5-dimethyl-; 3-Heptene-2,6-diol, 2,6-dimethyl-; 3-Heptene-2,6-diol, 4,6-dimethyl-; 5-Heptene-1,3-diol, 2,4-dimethyl-; 5-Heptene-1,3-diol, 3,6-dimethyl-; 5-Heptene-1,4-diol, 2,6-dimethyl-; 5-Heptene-1,4-diol, 3,6-dimethyl-; 5-Heptene-2,4-diol, 2,3-dimethyl-; 6-Heptene-1,3-diol, 2,2-dimethyl-; 6-Heptene-1,4-diol, 4-(2-propenyl)-; 6-Heptene-1,4-diol, 5,6-dimethyl-; 6-Heptene-1,5-diol, 2,4-dimethyl-; 6-Heptene-1,5-diol, 2-ethylidene-6-methyl-; 6-Heptene-2,4-diol, 4-(2-propenyl)-; 6-Heptene-2,4-diol, 5,5-dimethyl-; 6-Heptene-2,5-diol, 4,6-dimethyl-; 6-Heptene-2,5-diol, 5-ethenyl-4-methyl-; 1,3-Octanediol, 2-methylene-; 1,6-Octadiene-3,5-diol, 2,6-dimethyl-; 1,6-Octadiene-3,5-diol, 3,7-dimethyl-; 1,7-Octadiene-3,6-diol, 2,6-dimethyl-; 1,7-Octadiene-3,6-diol, 2,7-dimethyl-; 1,7-Octadiene-3,6-diol, 3,6-dimethyl-; 1-Octene-3,6-diol, 3-ethenyl-; 2,4,6-Octatriene-1,8-diol, 2,7-dimethyl-; 2,4-Octadiene-1,7-diol, 3,7-dimethyl-; 2,5-Octadiene-1,7-diol, 2,6-dimethyl-; 2,5-Octadiene-1,7-diol, 3,7-dimethyl-; 2,6-Octadiene-1,4-diol, 3,7-dimethyl- ; 2,6-Octadiene-1,8-diol, 2-methyl-; 2,7-Octadiene-1,4-diol, 3,7-dimethyl-; 2,7-Octadiene-1,5-diol, 2,6-dimethyl-; 2,7-Octadiene-1,6-diol, 2,6-dimethyl-; 2,7-Octadiene-1,6-diol, 2,7-dimethyl-; 2-Octene-1,4-diol; 2-Octene-1,7-diol; 2-Octene-1,7-diol, 2-methyl-6-methylene-; 3,5-Octadiene-1,7-diol, 3,7-dimethyl-; 3,5-Octadiene-2,7-diol, 2,7-dimethyl-; 3,5-Octanediol, 4-methylene-; 3,7-Octadiene-1,6-diol, 2,6-dimethyl-; 3,7-Octadiene-2,5-diol, 2,7-dimethyl-; 3,7-Octadiene-2,6-diol, 2,6-dimethyl-; 3-Octene-1,5-diol, 4-methyl-; 3-Octene-1,5-diol, 5-methyl-; 4,6-Octadiene-1,3-diol, 2,2-dimethyl-; 4,7-Octadiene-2,3-diol, 2,6-dimethyl-; 4,7-Octadiene-2,6-diol, 2,6-dimethyl-; 4-Octene-1,6-diol, 7-methyl-; 2,7-bis(methylene)-; 2-methylene-; 5,7-Octadiene-1,4-diol, 2,7-dimethyl-; 5,7-Octadiene-1,4-diol, 7-methyl-; 5-Octene-1,3-diol; 6-Octene-1,3-diol, 7-methyl-; 6-Octene-1,4-diol, 7-methyl-; 6-Octene-1,5-diol; 6-Octene-1,5-diol, 7-methyl-; 6-Octene-3,5-diol, 2-methyl-; 6-Octene-3,5-diol, 4-methyl-; 7-Octene-1,3-diol, 2-methyl-; 7-Octene-1,3-diol, 4-methyl-; 7-Octene-1,3-diol, 7-methyl-; 7-Octene-1,5-diol; 7-Octene-1,6-diol; 7-Octene-1,6-diol, 5-methyl-; 7-Octene-2,4-diol, 2-methyl-6-methylene-; 7-Octene-2,5-diol, 7-methyl-; 7-Octene-3,5-diol, 2-methyl-; 1-Nonene-3,5-diol; 1-Nonene-3,7-diol; 3-Nonene-2,5-diol; 4,6-Nonadiene-1,3-diol, 8-methyl-; 4-Nonene-2,8-diol; 6,8-Nonadiene-1,5-diol; 7-Nonene-2,4-diol; 8-Nonene-2,4-diol; 8-Nonene-2,5-diol; 1,9-Decadiene-3,8-diol; 1,9-Decadiene-4,6-diol; and (XI) mixtures thereof, wherein each Me—$E_n$ is a —$(CH_2CH_2O)_nCH_3$ group; each $PO_n$ is a —$(CH(CH_3)CH_2O)_nH$ group; each $BO_n$ is a —$(CH(CH_2CH_3)CH_2O)_nH$ group; each n-$BO_n$ is a —$(CH_2CH_2CH_2CH_2O)_nH$ group; and each $E_n$ is a —$(CH_2CH_2O)_nH$ group.

11. A fabric softener premix composition consisting essentially of:

(A) a fabric softener active selected from the group consisting of:

(1) softener having the formula:

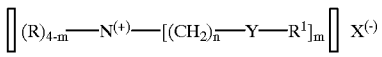

wherein each $R^1$ is a long chain $C_8$–$C_{22}$ hydrocarbyl, or substituted hydrocarbyl substituent; and wherein R substituent is a short chain $C_1$–$C_6$ alkyl or hydroxyalkyl group, or mixtures thereof; each m is 2 or 3; each n is from 1 to about 4; each Y is —O—(O)C—, or —C(O)—O—; and wherein the counterion $X^-$ is any softener-compatible anion;

(2) softener having the formula:

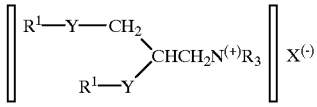

wherein each Y, R, $R^1$, and $X^{(-)}$ have the same meanings as before; and (3) mixtures thereof;

(B) less than about 40% by weight of the composition of principal solvent having a C log P of from about 0.15 to about 0.64, and an asymmetric structure;

(C) optionally, up to about 10% of low molecular weight water soluble solvents selected from the group consisting of: ethanol, isopropanol, propylene glycol, 1,3-propanediol, propylene carbonate, and mixtures thereof; and (D) water;

wherein the molar ratio of said principal solvent to said fabric softener active is at least about 3.

12. The process of making a clear fabric softening composition, comprising the step of diluting the premix of claim 11 with water.

* * * * *